US010889984B2

(12) United States Patent
Arguin et al.

(10) Patent No.: US 10,889,984 B2
(45) Date of Patent: Jan. 12, 2021

(54) BUILDING ASSEMBLY

(71) Applicant: NewAge Products Inc., Vaughan (CA)

(72) Inventors: Claudel Arguin, Toronto (CA); Robert Vandenham, North York (CA)

(73) Assignee: NewAge Products Inc., Vaughan (CA)

( * ) Notice: Subject to any disclaimer, the term of this patent is extended or adjusted under 35 U.S.C. 154(b) by 9 days.

(21) Appl. No.: 16/184,016

(22) Filed: Nov. 8, 2018

(65) Prior Publication Data

US 2020/0149273 A1 May 14, 2020

(51) Int. Cl.

| | |
|---|---|
| ***E04B 2/72*** | (2006.01) |
| ***E04F 13/08*** | (2006.01) |
| ***A47B 5/00*** | (2006.01) |
| ***E04H 1/12*** | (2006.01) |
| ***E04F 15/02*** | (2006.01) |

(Continued)

(52) U.S. Cl.

CPC ..... *E04B 2/721* (2013.01); *A47B 5/00* (2013.01); *E04B 5/02* (2013.01); *E04B 7/026* (2013.01); *E04F 13/0894* (2013.01); *E04F 15/02* (2013.01); *E04H 1/1205* (2013.01)

(58) Field of Classification Search

CPC . E04B 2/721; E04B 2/702; E04B 5/02; E04B 7/026; E04B 2001/5856; E04B 1/5831; E04B 1/34326; E04B 2/62; E04F 13/0894; E04F 15/02; E04D 3/3608; E04H 1/1205

See application file for complete search history.

(56) References Cited

U.S. PATENT DOCUMENTS 755,749 A * 3/1904 Cooley ..... B65D 90/026 217/4
1,402,438 A * 1/1922 Nichols ..... A63H 33/044 446/106

(Continued)

FOREIGN PATENT DOCUMENTS

CA 2157721 A1 3/1997
CA 2286745 C 8/2006

(Continued)

OTHER PUBLICATIONS

English language abstract for CN 104428473 extracted from espacenet.com database on Sep. 5, 2019, 2 pages.

(Continued)

*Primary Examiner* — Adriana Figueroa
(74) *Attorney, Agent, or Firm* — Howard & Howard Attorneys PLLC

(57) ABSTRACT

A building assembly includes a floor frame, a roof, and walls extending between the floor frame and the roof and interconnected to define an interior and exterior of the building assembly. Each wall includes panels each defining an axis and having first and second ends, inner and outer sides, top and bottom surfaces, an upper notch formed through the top surface, and a lower notch formed through the bottom surface. Each notch is spaced inwardly along the axis from at least one end. The panels include first and second panels. The lower notch of the first panel mates with the upper notch of the second panel to form an interlocking joint to interconnect the first and second panels and form adjacent interconnected walls of the building assembly.

49 Claims, 26 Drawing Sheets

(51) Int. Cl.
*E04B 5/02* (2006.01)
*E04B 7/02* (2006.01)

(56) References Cited

U.S. PATENT DOCUMENTS 1,459,761 A * 6/1923 Andrews ..... E04B 1/26 52/92.1
2,110,787 A * 3/1938 Brandjord ..... E04B 2/708 52/233
2,337,224 A * 12/1943 Benoist ..... E04B 2/702 52/261
3,257,762 A * 6/1966 Steiner ..... E04B 2/702 52/233
3,742,665 A * 7/1973 Henry ..... E04B 2/56 52/284
3,751,865 A 8/1973 Brigham
3,908,322 A * 9/1975 Shoaf ..... E04B 2/70 52/92.1
3,969,859 A * 7/1976 Hisey ..... E04B 2/702 52/233
4,051,641 A 10/1977 Elliott
4,115,967 A 9/1978 Kragt
4,179,788 A 12/1979 Kragt
4,429,500 A * 2/1984 Farmont ..... E04B 2/702 411/458
4,619,089 A * 10/1986 Stein ..... E04B 2/702 403/326
4,630,418 A 12/1986 Degut
4,742,657 A 5/1988 Veech
4,805,783 A 2/1989 Mayer
5,036,634 A 8/1991 Lessard et al.
5,184,436 A 2/1993 Sadler
5,193,325 A * 3/1993 Allison ..... E04H 1/1205 52/125.2
5,236,625 A 8/1993 Bardo et al.
5,247,773 A 9/1993 Weir
5,293,725 A * 3/1994 Matticks ..... E04B 1/34315 52/126.1
5,331,778 A 7/1994 Mazpule et al.
5,398,468 A 3/1995 Erickson
5,447,000 A 9/1995 Larsen
5,540,014 A 7/1996 Smith
5,566,844 A 10/1996 Bernardin
5,577,356 A * 11/1996 Hubbard ..... E04B 2/702 52/233
5,607,070 A * 3/1997 Hellyer ..... A47F 5/108 211/189
5,690,239 A * 11/1997 Ballard ..... A47F 5/04 211/187
5,782,046 A * 7/1998 Karlsson ..... E04B 2/702 52/233
5,857,578 A 1/1999 Fishman
5,944,203 A 8/1999 Vlah et al.
5,983,574 A 11/1999 Holztrager
6,164,467 A 12/2000 DePottey et al.
6,250,022 B1 6/2001 Paz et al.
6,295,778 B1 * 10/2001 Burt ..... E04B 1/12 52/233
6,349,507 B1 2/2002 Muellerliele
6,564,952 B1 5/2003 Suttles
6,591,558 B1 * 7/2003 De Zen ..... E04B 1/12 52/91.1
6,688,056 B2 2/2004 Von Hoyningen Huene et al.
6,763,957 B1 7/2004 Mullerleile
6,889,475 B2 5/2005 De Zen
6,892,743 B2 5/2005 Armstrong et al.
6,931,803 B1 * 8/2005 Davis ..... E04B 1/28 52/251
6,935,085 B2 8/2005 Little, Jr.
6,948,280 B2 9/2005 Marcinkowski et al.
D552,894 S 10/2007 Loew
7,444,782 B2 11/2008 Crowell
7,581,357 B2 9/2009 Richardson et al.
7,607,271 B2 * 10/2009 Griffin ..... E04C 2/296 52/478
8,205,395 B2 6/2012 Jakiel
8,365,483 B2 2/2013 Hijazi
8,468,752 B2 6/2013 Lin
8,578,867 B2 11/2013 Gustavsson
8,800,216 B2 8/2014 Phillips et al.
8,973,320 B2 * 3/2015 Harper ..... E04B 1/26 446/106
8,973,335 B2 3/2015 Wilson
9,032,670 B2 5/2015 Vogler et al.
9,151,068 B2 10/2015 Vogler et al.
9,428,901 B2 8/2016 Price
9,428,907 B2 8/2016 Gupta
9,428,926 B2 8/2016 Kramer
9,596,948 B1 3/2017 McGinnis
9,863,142 B2 * 1/2018 Stein ..... E04B 1/18
9,995,034 B2 6/2018 Rothenberg
10,370,847 B2 8/2019 Caffaratti Giro
2002/0095888 A1 * 7/2002 Winskye ..... E04B 1/24 52/234
2004/0255531 A1 * 12/2004 Middleton ..... E04G 21/1858 52/233
2005/0126084 A1 * 6/2005 Woksa ..... E04B 2/702 52/79.1
2005/0127016 A1 6/2005 Fischer
2006/0048459 A1 3/2006 Moore
2007/0062146 A1 * 3/2007 Van Dijk ..... E04B 1/86 52/580
2007/0175108 A1 8/2007 Stein et al.
2007/0209295 A1 9/2007 Mower et al.
2008/0061018 A1 3/2008 Keller
2008/0110484 A1 5/2008 Doran
2008/0216426 A1 9/2008 Bunker
2008/0263968 A1 10/2008 Day
2009/0044461 A1 2/2009 Diamond
2011/0185669 A1 * 8/2011 Dueker ..... E04C 3/02 52/519
2011/0303798 A1 12/2011 Bader et al.
2012/0102861 A1 5/2012 Diamond
2013/0067846 A1 3/2013 Kvols et al.
2015/0113885 A1 4/2015 Le Carpentier et al.
2015/0135605 A1 5/2015 Price
2015/0247316 A1 9/2015 Coupe
2016/0069062 A1 3/2016 Dynon
2016/0120135 A1 5/2016 Herrick
2016/0145852 A1 5/2016 Ito et al.
2016/0265244 A1 9/2016 Watson
2016/0366837 A1 12/2016 Smith et al.
2017/0037591 A1 * 2/2017 Stein ..... E04B 5/326
2017/0058523 A1 * 3/2017 Kennedy ..... E04D 11/02
2017/0089061 A1 3/2017 Rothenberg
2017/0306610 A1 10/2017 Leahy
2018/0023309 A1 * 1/2018 Brawner ..... E04B 1/35 52/745.06
2018/0223527 A1 * 8/2018 Marcio ..... E04B 2/702

FOREIGN PATENT DOCUMENTS

CA 2454941 C 11/2006
CN 104428473 3/2015
CN 104428473 A 3/2015
DE 3232747 3/1984
DE 3232747 A1 3/1984
DE 20003242 4/2000
DE 20003242 U1 4/2000
DE 20020354 7/2001
DE 20020354 U1 7/2001
DE 10234357 7/2003
DE 10234357 A1 7/2003
DE 202004011312 10/2004
DE 202004011312 U1 10/2004
EP 3181782 6/2017
EP 3181782 A1 6/2017
FR 2785006 4/2000
FR 2785006 A1 4/2000
FR 3024477 8/2016
FR 3024477 B1 8/2016

(56) References Cited

FOREIGN PATENT DOCUMENTS

| | | | |
|---|---|---|---|
| GB | 1300283 | A | 12/1972 |
| GB | 2251005 | B | 11/1994 |
| GB | 2398578 | A | 8/2004 |
| GB | 2376030 | B | 2/2005 |
| GB | 2483800 | A | 3/2012 |
| GB | 2526165 | A | 11/2015 |
| GB | 2549305 | A | 10/2017 |
| WO | 8600360 | A1 | 1/1986 |
| WO | 9814670 | A1 | 4/1998 |
| WO | 0104431 | A1 | 1/2001 |
| WO | 2004106657 | A1 | 12/2004 |
| WO | 2005094319 | A2 | 10/2005 |
| WO | 2005094342 | A2 | 10/2005 |
| WO | 2005094359 | A2 | 10/2005 |
| WO | 2005098167 | A2 | 10/2005 |
| WO | 2005098168 | A2 | 10/2005 |
| WO | 2006004396 | A1 | 1/2006 |
| WO | 2005094359 | A3 | 11/2006 |
| WO | 2005098167 | A3 | 3/2007 |
| WO | 2007084833 | A2 | 7/2007 |
| WO | 2007084833 | A3 | 10/2008 |
| WO | 2005094319 | A3 | 4/2009 |
| WO | 2005094342 | A3 | 4/2009 |
| WO | 2005098168 | A3 | 5/2009 |
| WO | 2011112205 | A1 | 9/2011 |
| WO | 2012022973 | A1 | 2/2012 |
| WO | 2013171605 | A1 | 11/2013 |
| WO | 2014114299 | A1 | 7/2014 |
| WO | 2014170611 | A9 | 2/2015 |
| WO | WO 2014170611 | | 2/2015 |
| WO | 2015044204 | A1 | 4/2015 |
| WO | 2015050572 | A1 | 4/2015 |
| WO | WO 2015044204 | | 4/2015 |
| WO | 2015127506 | A1 | 9/2015 |
| WO | 2015185199 | A1 | 12/2015 |
| WO | WO 2015185199 | | 12/2015 |
| WO | 2016102723 | A1 | 6/2016 |
| WO | WO 2016102723 | | 6/2016 |
| WO | 2016141472 | A1 | 9/2016 |
| WO | 2016084042 | A9 | 1/2017 |

OTHER PUBLICATIONS

English language abstract for DE 3232747 extracted from espacenet.com database on Sep. 5, 2019, 1 page.

English language abstract and computer-generated English language translation for DE 20003242 extracted from espacenet.com database on Sep. 5, 2019, 15 pages.

English language abstract and computer-generated English language translation for DE 20020354 extracted from espacenet.com database on Sep. 5, 2019, 8 pages.

English language abstract for DE 10234357 extracted from espacenet.com database on Sep. 5, 2019, 1 page.

English language abstract for DE 202004011312 extracted from espacenet.com database on Sep. 5, 2019, 1 page.

Computer-generated English language abstract for EP 3181782 extracted from espacenet.com database on Sep. 5, 2019, 2 page.

English language abstract for FR 2785006 extracted from espacenet.com database on Sep. 5, 2019, 1 page.

Computer-generated English language abstract for FR 3024477 extracted from espacenet.com database on Sep. 5, 2019, 2 pages.

English language abstract for WO 2014170611 extracted from espacenet.com database on Sep. 5, 2019, 1 page.

English language abstract for WO 2015044204 extracted from espacenet.com database on Sep. 5, 2019, 1 page.

English language abstract for WO 2015185199 extracted from espacenet.com database on Sep. 5, 2019, 1 page.

English language abstract for WO 2016102723 extracted from espacenet.com database on Sep. 5, 2019, 2 pages.

* cited by examiner

BUILDING ASSEMBLY

FIELD OF THE DISCLOSURE

The present disclosure relates generally to a building assembly.

BACKGROUND

Outdoor rooms are often constructed in outdoor spaces, and are usable for a variety of purposes such as to extend the usable living space of a home, to create a hobby or work area, for storage, etc. Many outdoor rooms have a complicated assembly, often including components that are heavy and/or bulky. Assembly of these rooms typically require multiple people and/or a professional builder, as well as many tools. Such complicated assemblies also lead to longer assembly times. The present disclosure is aimed at solving the problems identified above.

SUMMARY

In an embodiment, the building assembly comprises a floor frame, a roof spaced from said floor frame, and a plurality of walls extending between the floor frame and the roof and interconnected to define an interior and an exterior of the building assembly. At least one of the plurality of walls defines an opening. Each of the plurality of walls includes a plurality of panels with each panel defining a longitudinal axis and each panel having first and second ends, opposing top and bottom surfaces, an upper notch formed through the top surface and an opposing lower notch formed through the bottom surface with each of the upper and lower notches spaced inwardly along the longitudinal axis from at least one of the first and second ends. The plurality of panels includes first and second panels and the lower notch of the first panel mates with the upper notch of the second panel to form an interlocking joint between the first and second panels to interconnect the first and second panels and form adjacent interconnected walls of the plurality of walls of the building assembly.

In another embodiment, a building assembly comprises a floor frame having a plurality of floor panels each having first and second ends with the first end of one of the plurality of floor panels mating with the second end of an adjacent one of the plurality of floor panels to interconnect the plurality of floor panels, a plurality of posts each having first and second post ends with the first post end coupled to the floor frame. The at least one panel frame having first and second frame ends with the first frame end coupled to the floor frame and at least one window frame having an upper segment, a lower segment, and first and second side segments. The at least one window frame is interconnected to one of the posts such that the interconnected window frame, plurality of posts, panel frame, and floor frame collectively form a skeleton of the building assembly.

In yet another embodiment, a method of manufacturing a building assembly comprises the steps of: forming a floor; forming a roof spaced from the floor; forming a plurality of walls extending between the floor and the roof with each of the plurality of walls including a plurality of panels with each panel defining a longitudinal axis and each panel having first and second ends, opposing inner and outer sides, opposing top and bottom surfaces, an upper notch formed through the top surface and an opposing lower notch formed through the bottom surface with each of the upper and lower notches spaced inwardly along the longitudinal axis from at least one of the first and second ends, a first mounting channel formed in the inner side extending along the longitudinal axis, and a second mounting channel formed in the outer side extending along the longitudinal axis, with the plurality of panels including first and second panels; mating the lower notch of the first panel with the upper notch of the second panel to form an interlocking joint between the first and second panels thereby interconnecting the first and second panels and forming adjacent interconnected walls of the plurality of walls, wherein the interconnected plurality of walls defines an interior and an exterior of the building assembly with at least one of the plurality of walls defining an opening; and coupling a door to at least one of the plurality of walls such that the door is movable between an open position in which the door is spaced from the opening and a closed position in which the door covers the opening.

BRIEF DESCRIPTION OF THE DRAWINGS

The advantages of the present disclosure will be readily appreciated as the same becomes better understood by reference to the following detailed description when considered in connection with the accompanying drawings. It is to be understood that the drawings are purely illustrative and are not necessarily drawn to scale.

DETAILED DESCRIPTION

Figure 1:
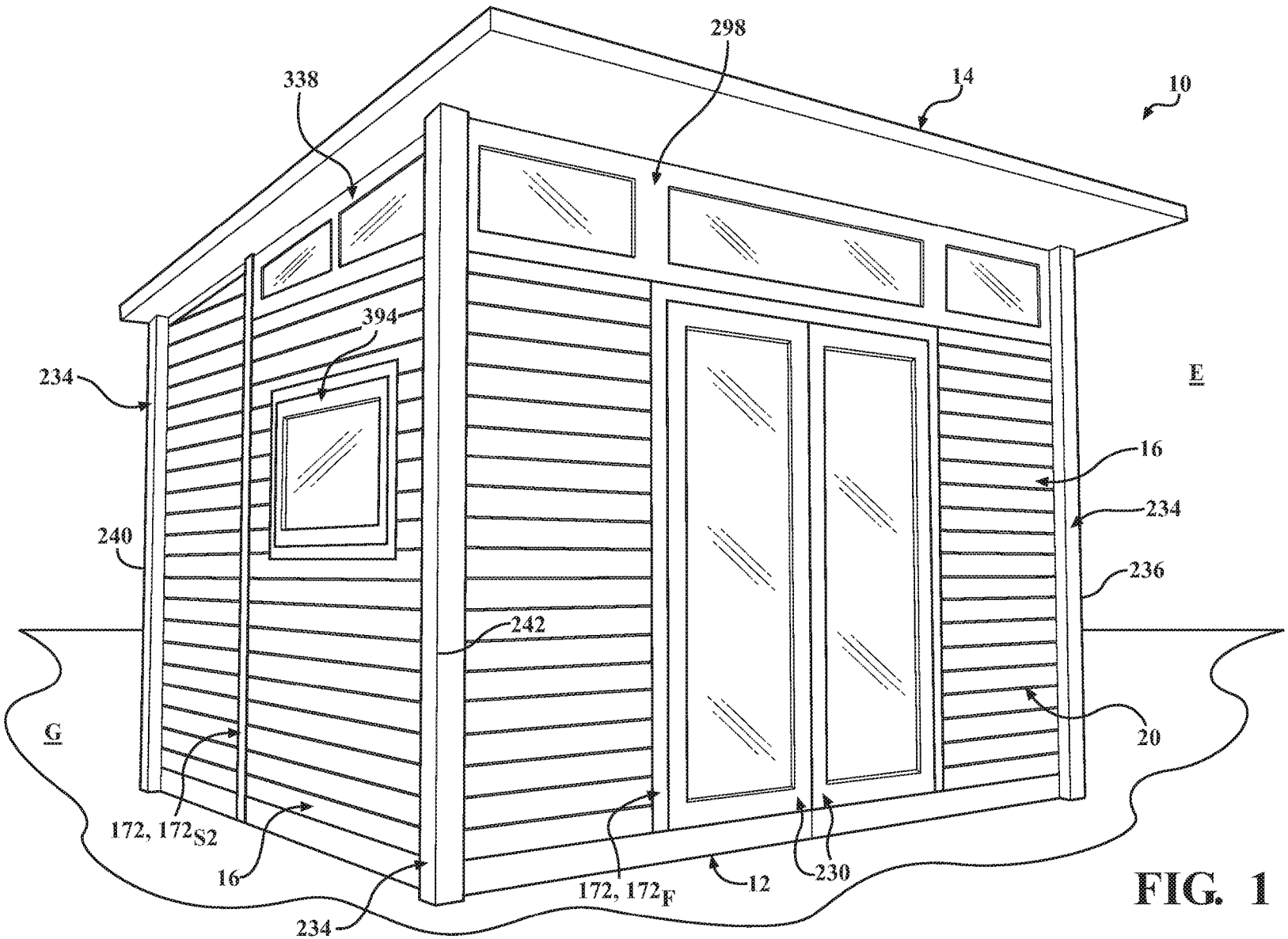
FIG. 1 is a front perspective view of a building assembly according to an embodiment of the present disclosure.

Referring now to the figures, wherein like numerals indicate corresponding parts throughout the several views, embodiments of a building assembly 10 are shown throughout the figures and described in detail below. The building assembly 10 is a standalone, roofed structure adapted to receive and/or hold objects, people, animals, etc. Alternatively, the building assembly 10 could be modified and/or adapted to be attached to a pre-existing building and may not, in this alternative example, be considered a standalone structure. Additionally, the building assembly 10 may be portable.

In an example, the building assembly 10 may be adapted for storing objects such as personal possessions, household items, furniture, yard or lawn equipment, office supplies and/or equipment, etc., and may be referred to as a storage shed, a garden shed, and/or the like. In another example, the building assembly 10 may be adapted for use by one or more persons as a workshop, a studio, an office, a hobby room, a garden or green room, a cabin or retreat, etc. In yet another example, the building assembly 10 may be adapted for providing shelter for animals, such as a shelter for dogs (i.e., a dog house), a shelter for chickens (i.e., a chicken coop), etc. Typically, the building assembly 10 is usable outdoors (such as outside of a permanent building or structure) and/or indoors (such as inside a permanent building or structure). It should be appreciated that the building assembly 10 can be adapted for use in any desired location and for any desirable purpose, including those purposes not specifically identified above.

The building assembly 10 may have any configuration. In the embodiments shown throughout the figures and described below, the building assembly 10 has a quadrilateral configuration (such as a square shape or a rectangular shape) in cross-section, and includes a front, a rear, a first side, and a second side. Alternatively, the building assembly 10 could have a cross-sectional configuration that is round, circular, oval, triangular, pentagonal, hexagonal, or any other geometry.

In the embodiments described below, the building assembly 10 is configured so that an end user or consumer can easily construct the building assembly 10 from a kit. The kit includes all of the components of the building assembly 10 available in a packaging available from a store. The individual components of the building assembly 10 are small enough so the user can easily place the packaging within the user's vehicle and/or the packaging can be easily delivered to the user by a delivery service or the like. In addition, many of the individual components of the building assembly 10, such as the panels 84 of the walls 16 of the building assembly 10, are formed from one or more lightweight materials, such as aluminum, vinyl, plastic, plywood, fiberboard, etc. The lightweight material(s) allows the user to easily handle the individual components at least during assembly of the building assembly 10. It should be appreciated that the building assembly 10 can alternatively have any size and/or include components formed from materials that are not necessarily lightweight. In this alternative embodiment, the building assembly 10 may or may not be available in the form of a kit.

Details of the building assembly 10 will now be described. As shown in FIG. 1, the building assembly 10 includes a floor frame 12, a roof 14 spaced from the floor frame 12, and a plurality of walls 16 extending between the floor frame 12 and the roof 14. The plurality of walls 16 are interconnected to define an exterior 20 of the building assembly 10. As shown, for example, in FIG. 9, the plurality of walls 16 are also interconnected to define an interior 18 of the building assembly 10. The interior 18 of the building assembly 10 refers to the inside of the building assembly 10 that is spaced or separated from an environment E external to or surrounding the building assembly 10. The exterior 20 of the building assembly 10 refers to the outside of the building assembly 10 which is exposed to environment E surrounding the building assembly 10.

Figure 7:
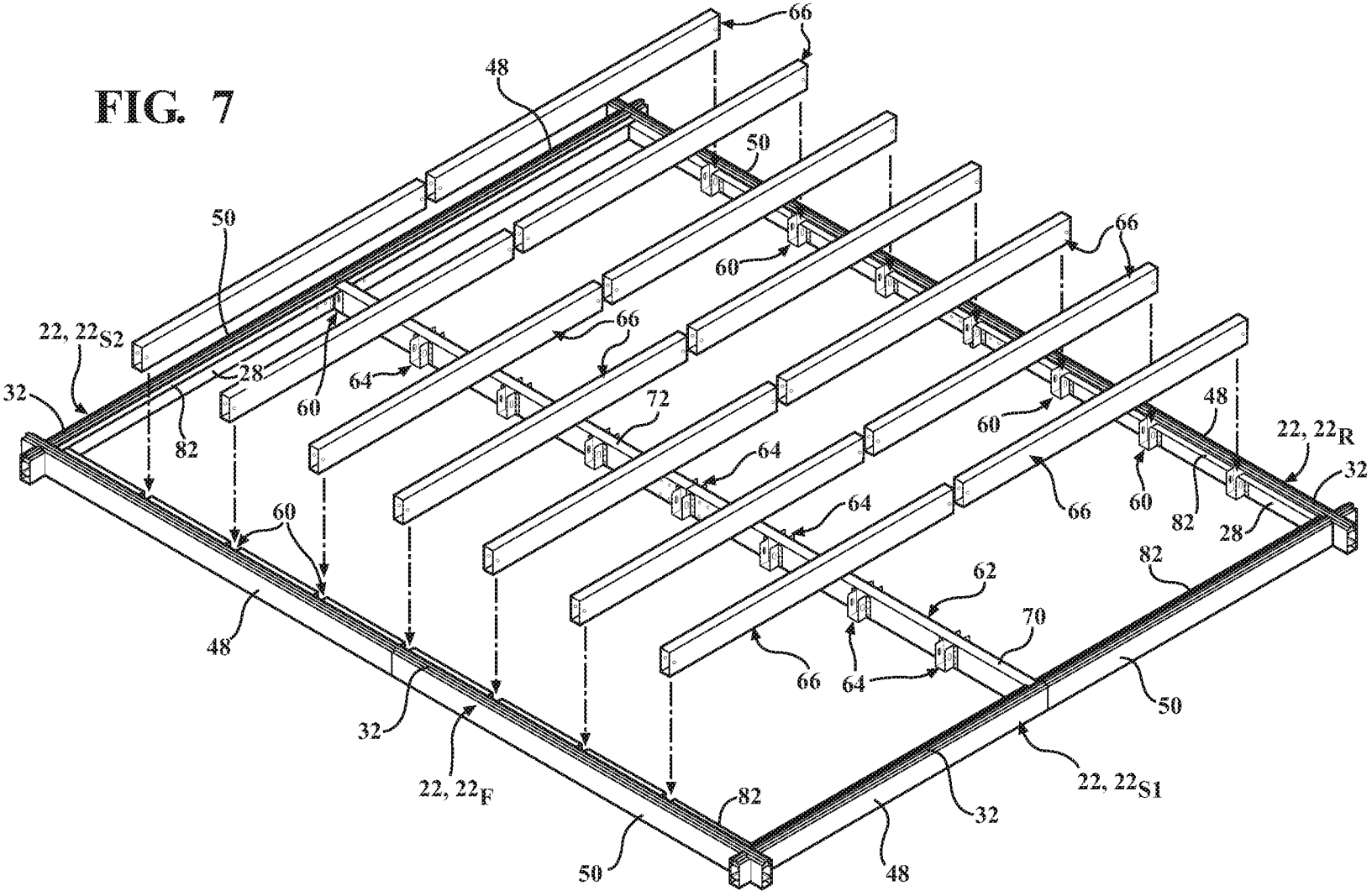
FIG. 7 is a partially exploded, perspective view of the plurality of interconnected floor panels, the first floor joist, and a plurality of second floor joists forming the floor frame of the building assembly.
Figure 8:
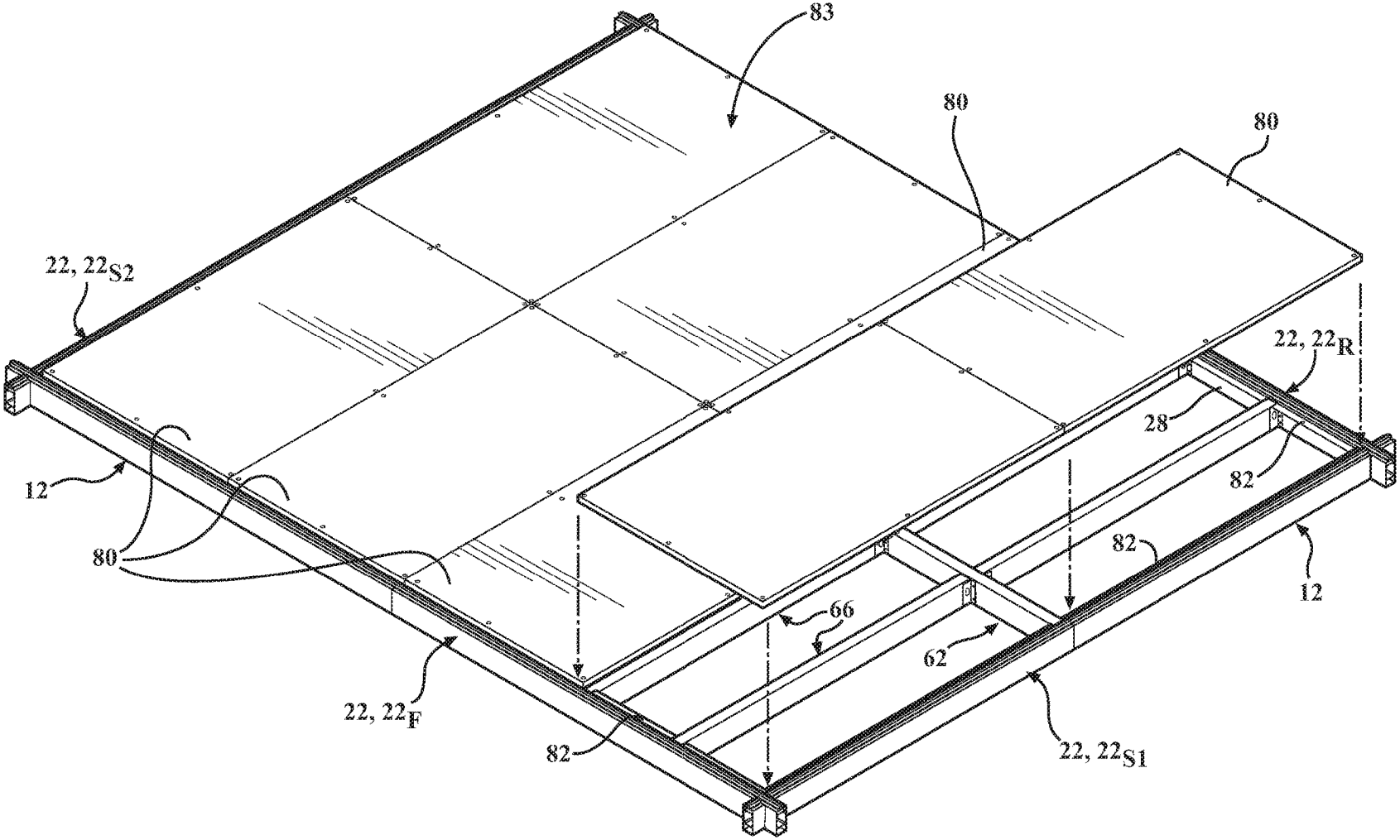
FIG. 8 is a partially exploded, perspective view of the floor frame and a plurality of floor boards disposed on and supported by the floor frame.

Details of the floor frame 12 and how the floor frame 12 is formed are described below with reference to FIGS. 1-7. As shown in FIG. 1, the floor frame 12 is adapted to be seated against and/or rest on the ground G of the environment E. The floor frame 12 is also adapted to support the plurality of walls 16 and the roof 14 of the building assembly 10. As shown in FIG. 8, the floor frame 12 supports at least one floor board 80 to form a floor 83 of the building assembly 10. Alternatively, the floor frame 12 could be modified to support just the walls 16 and the roof 14. In this alternative embodiment, the building assembly 10 does not have any floor boards 80, and the floor 83 of the building assembly 10 would be the ground G of the environment E. Alternative flooring for the building assembly 10 are also contemplated.

Figure 2:
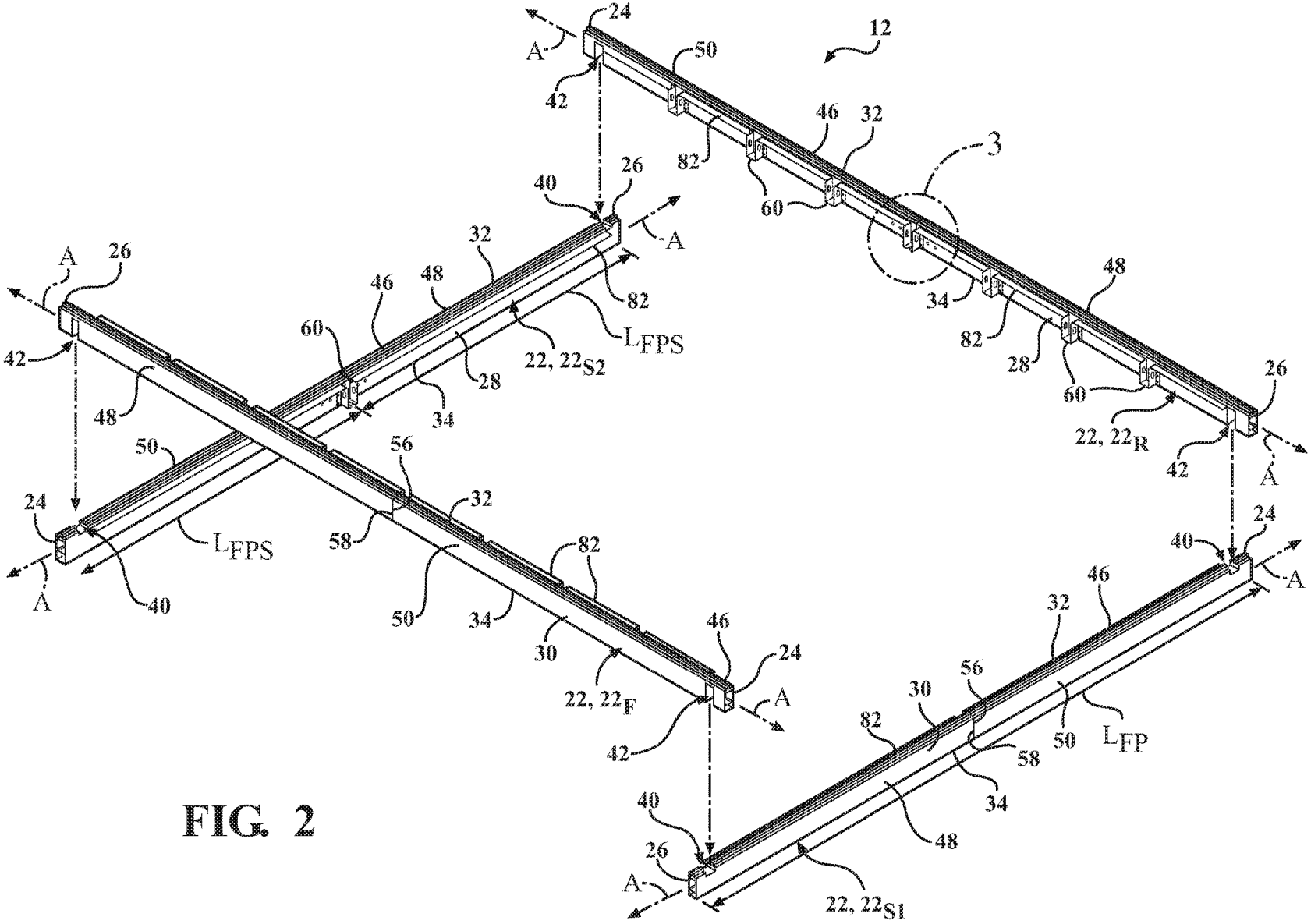
FIG. 2 is a partially exploded view of a plurality of floor panels partially forming a floor frame of the building assembly.

As shown at least in FIG. 2, the floor frame 12 comprises a plurality of floor panels 22 each defining a longitudinal axis A and having a length $L_{FP}$ extending along the longitudinal axis A. Each floor panel 22 has first 24 and second 26 ends, opposing inner 28 and outer 30 sides, and opposing top 32 and bottom 34 surfaces. The inner side 28 of each of the floor panels 22 faces inwardly toward the inside of the building assembly 10 and forms part of the building interior 18. The outer side 30 of each of the floor panels 22 faces outwardly toward the environment E surrounding the building assembly 10 and forms part of the building exterior 20. As shown, for example, in FIG. 3, the inner 28 and outer 30 sides are spaced from one another to define a slot 36 between the sides 28, 30. In the illustrated embodiment, each floor panel 22 further includes at least one support rib 38 disposed within the slot 36 and extending along the longitudinal axis A.

Figure 4:
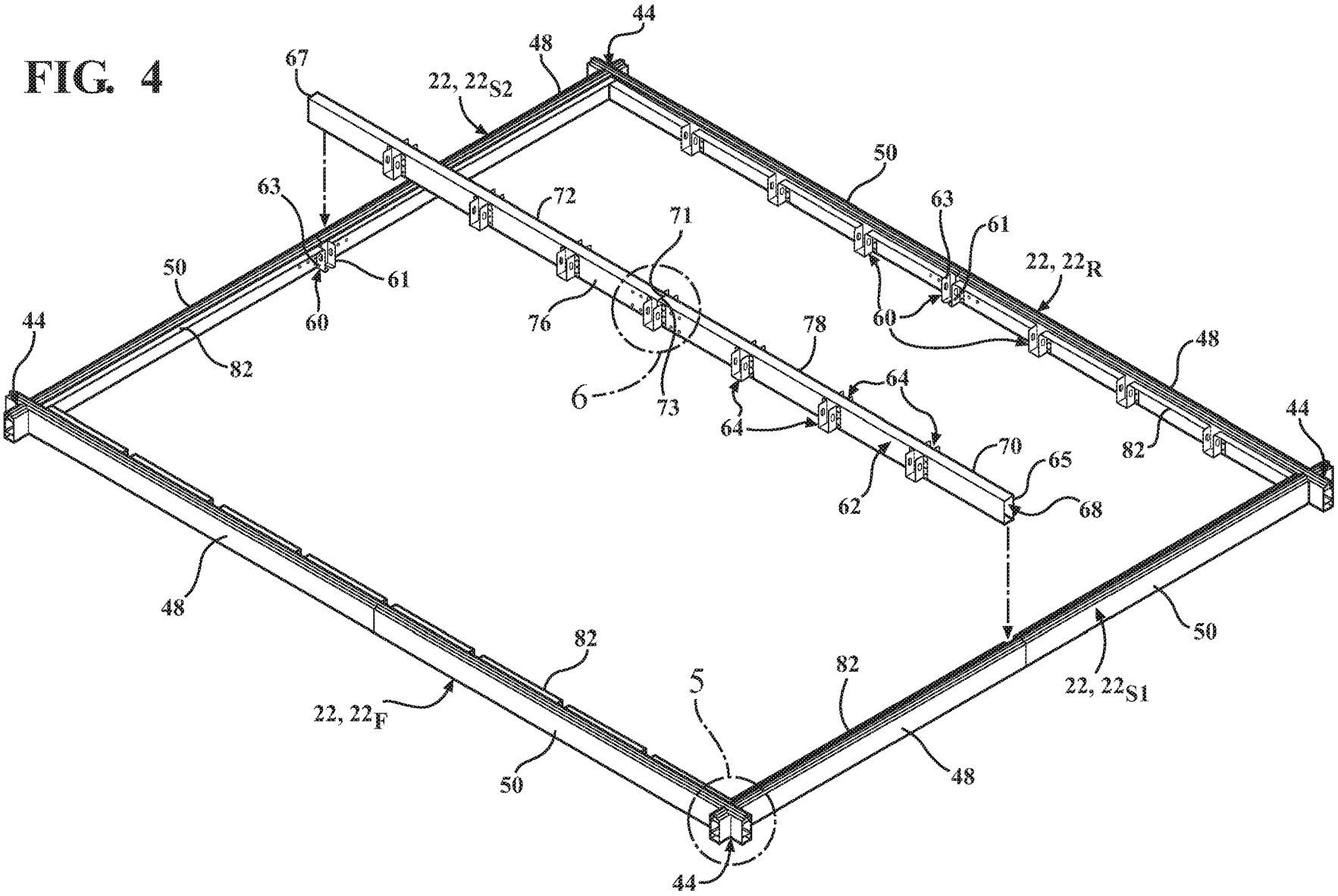
FIG. 4 is a partially exploded, perspective view of the plurality of floor panels interconnected to one another and a first floor joist partially forming the floor frame of the building assembly.

The plurality of floor panels 22 are interconnected to form the floor frame 12. For example, one of the plurality of floor panels 22 mates with an adjacent one of the plurality of floor panels 22 to interconnect the plurality of floor panels 22 and form the floor frame 12. In the illustrated embodiment where the building assembly 10 has a quadrilateral configuration, the floor frame 12 includes four floor panels 22; a front floor panel $\mathbf{22}_F$, a rear floor panel $\mathbf{22}_R$ spaced from the front floor panel $\mathbf{22}_F$, a first side floor panel $\mathbf{22}_{S1}$ extending between the front floor panel $\mathbf{22}_F$ and the rear floor panel $\mathbf{22}_R$, and a second side floor panel $\mathbf{22}_{S2}$ extending between the front floor panel $\mathbf{22}_F$ and the rear floor panel $\mathbf{22}_R$ and spaced from the first side floor panel $\mathbf{22}_{S1}$. As best shown in FIG. 4, the front floor panel $\mathbf{22}_F$ mates with the first side floor panel $\mathbf{22}_{S1}$ and forms an interlocking joint 44 between the front $\mathbf{22}_F$ and first side $\mathbf{22}_{S1}$ floor panels, the first side floor panel $\mathbf{22}_{S1}$ mates with the rear floor panel $\mathbf{22}_R$ and forms an interlocking joint 44 between the first side $\mathbf{22}_{S1}$ and rear $\mathbf{22}_R$ floor panels, the rear floor panel $\mathbf{22}_R$ mates with the second side floor panel $\mathbf{22}_{S2}$ and forms an interlocking joint 44 between the rear $\mathbf{22}_R$ and second side $\mathbf{22}_{S2}$ floor panels, and the second side floor panel $\mathbf{22}_{S2}$ mates with the front floor panel $\mathbf{22}_F$ to interconnect second side $\mathbf{22}_{S2}$ and front $\mathbf{22}_F$ floor panels and forms an interlocking joint 44 between the second side $\mathbf{22}_{S2}$ and front $\mathbf{22}_F$ floor panels. The front $\mathbf{22}_F$, rear $\mathbf{22}_R$, first side $\mathbf{22}_{S1}$, and second side $\mathbf{22}_{S2}$ floor panels are thereby interconnected to at least partially form the floor frame 12.

Referring again to FIG. 2, each of the first side $\mathbf{22}_{S1}$ and second side $\mathbf{22}_{S2}$ floor panels has an upper notch 40 formed through the top surface 32 spaced inwardly along the longitudinal axis A from each of the first 24 and second 26 ends. Each of the front $\mathbf{22}_F$ and rear $\mathbf{22}_R$ floor panels has a lower notch 42 formed through the bottom surface 34 spaced inwardly along the longitudinal axis A from each of the first 24 and second 26 ends. The lower notch 42 about the first end 24 of the front floor panel $\mathbf{22}_F$ mates with the upper notch 40 about the second end 26 of the of the first side floor panel $\mathbf{22}_{S1}$ to form the interlocking joint 44 between the front $\mathbf{22}_F$ and first side $\mathbf{22}_{S1}$ floor panels. The upper notch 40 about the first end 24 of the first side floor panel $\mathbf{22}_{S1}$ mates with the lower notch 42 about the second end 26 of the rear floor panel $\mathbf{22}_R$ to form the interlocking joint 44 between the first side $\mathbf{22}_{S1}$ and rear $\mathbf{22}_R$ floor panels. The lower notch 42 about the first end 24 of the rear floor panel $\mathbf{22}_R$ mates with the upper notch 40 about the second end 26 of the of the second side floor panel $\mathbf{22}_{S2}$ to form the interlocking joint 44 between the rear $\mathbf{22}_R$ and second side $\mathbf{22}_{S2}$ floor panels. The upper notch 40 about the first end 24 of the second side floor panel $\mathbf{22}_{S2}$ mates with the lower notch 42 about the second end 26 of the front floor panel $\mathbf{22}_F$ to form the interlocking joint 44 between the second side $\mathbf{22}_{S2}$ and front $\mathbf{22}_F$ floor panels. In an embodiment, the configuration of the upper notches 40 of the floor panels 22 may be the same as the configuration of the upper notch(es) 106 of each of a plurality of panels 84 of each of the plurality of walls 16. The configuration of the lower notches 42 of the floor panels 22 may be similar to the configuration of the lower notch(es) 108 of each of the plurality of panels 84 of each of the plurality of walls 16; however, the floor panels 22 do not have a groove 120. Further details of the upper 106 and lower 108 notches of the plurality of panels 84 of the plurality of walls 16 are described below. In another embodiment, and as shown, the upper notches 40 of the floor panels 22 may have a first depth and the lower notches of the floor panels 22 may have a second depth larger than the first depth.

The bottom surface 34 of each floor panel 22 has a flat configuration extending at least partially along the length Lip of the floor panel 22. The bottom surface 34 of the floor panel 22 is adapted to be in direct contact with the ground G of the environment E and adapted to be seated against and/or rest on the ground G. The top surface 32 of each of the floor panels 22 defines a tongue 46 extending outwardly in a direction transverse to the longitudinal axis A. The tongue 46 extends at least partially along the length $L_{FP}$. The tongue 46 is configured to mate with the groove 120 of a respective one of the plurality of panels 84 of the plurality of walls 16 to interconnect the respective one of the plurality of panels 84 with the floor panel 22. The configuration of the tongue 46 of the floor panel 22 is the same as the configuration of the tongue 118 of the panel 84, which is described below.

Figure 3:
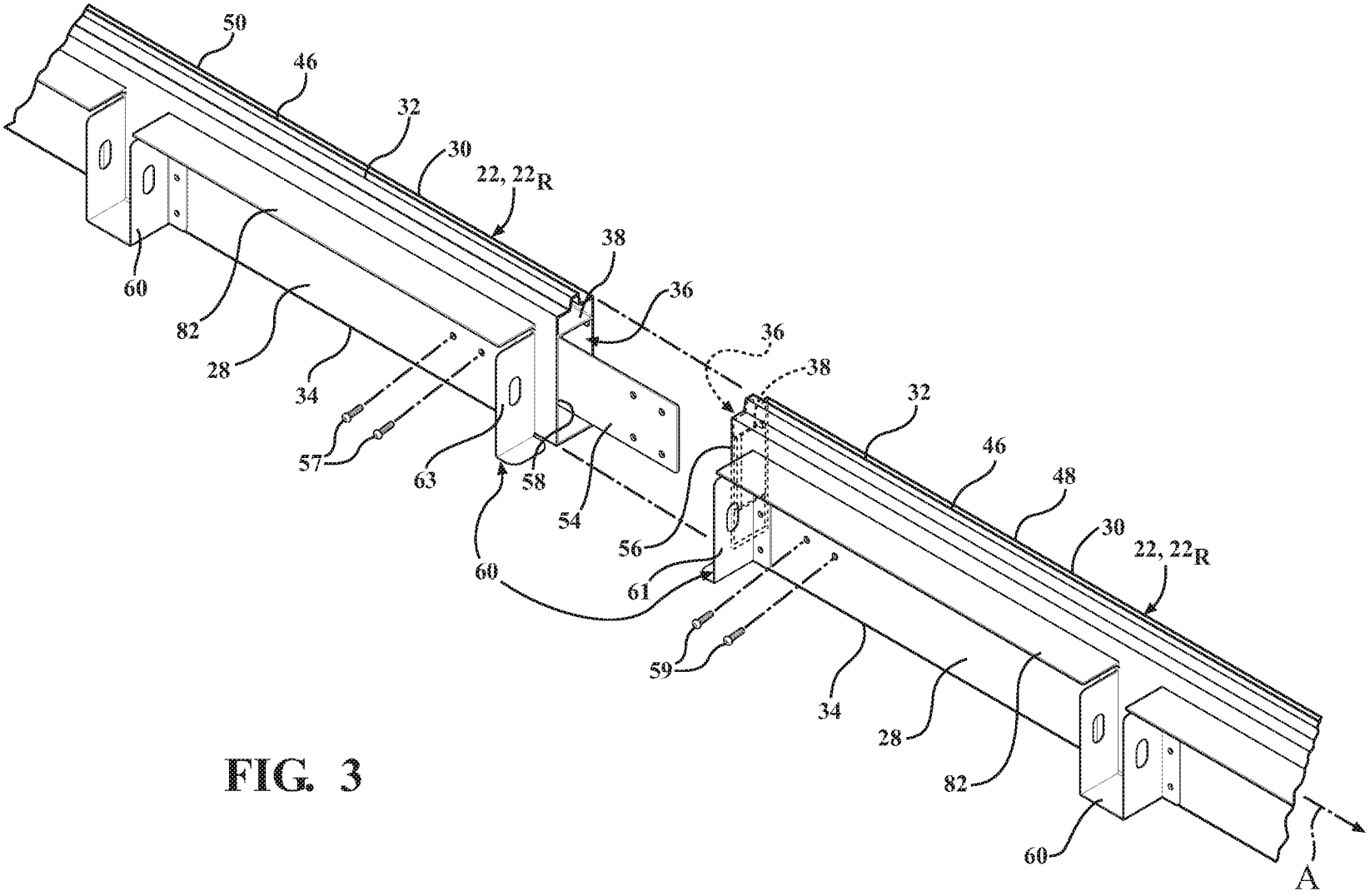
FIG. 3 is an enlarged, partially exploded view of a portion of one of the floor panels of FIG. 2.

In an embodiment, each of the floor panels 22 (i.e., the front floor panel $\mathbf{22}_F$, the rear floor panel $\mathbf{22}_R$, the first side floor panel $\mathbf{22}_{S1}$, and the second side floor panel $\mathbf{22}_{S2}$) has first 48 and second 50 floor panel segments. Each of the first 48 and second 50 floor panel segments has a length $L_{FPS}$ extending along the longitudinal axis A, and the lengths $L_{FPS}$ of the segments 48, 50 may be the same or different. Additionally, and as best shown in FIG. 3, each of the first 48 and second 50 floor panel segments defines the slot 36, and one of the first 48 and second 50 floor panel segments has a tab 54. The tab 54 of the one of the first 48 and second 50 floor panel segments is disposed within the slot 36 of the other one of the first 48 and second 50 floor panel segments to interconnect said first 48 and second 50 floor panel segments to form the floor panel 22. In an embodiment, the one of the first 48 and second 50 floor panel segments has a single tab 54. Alternatively, the one of the first 48 and second 50 floor panel segments could have any number of tabs 54.

The first floor panel segment 48 has the second end 26 of the floor panel 22 and a first segment end 56, and the second floor panel segment 50 has the first end 24 of the floor panel 22 and a second segment end 58. In the embodiment shown, the tab 54 extends from the from the second segment end 58 of the second floor panel segment 50 along the longitudinal axis A. The tab 54 may be secured to the second floor panel segment 50 about the second segment end 58 in any suitable fashion, such as with one or more fasteners 57. The tab 54 extends from the second segment end 58 of the second floor panel segment 50 and into the slot 36 of the first floor panel segment 48. The tab 54 is secured to the first floor panel segment 48 in any suitable fashion, such as with one or more fasteners 59.

Each of the plurality of floor panels 22 further includes at least one bracket 60 attached or secured to the inner side 28. Each of the first $\mathbf{22}_{S1}$ and second $\mathbf{22}_{S2}$ side floor panels has a bracket 60 attached or secured to the inner side 28. This pair of brackets 60 is opposite one another and configured to receive and support a first floor joist 62, as best shown in FIGS. 4, 7, and 8. The bracket 60 may be attached at any position along the length Lip of the first side floor panel $\mathbf{22}_{S1}$, and the other bracket 60 may be attached at a comparable or similar position along the length $L_{FP}$ of second side floor panel $\mathbf{22}_{S2}$ such that the brackets 60 are opposite one another. In an embodiment, and as shown, the bracket 60 attached to the first $\mathbf{22}_{S1}$ and second $\mathbf{22}_{S2}$ floor panels has first 61 and second 63 bracket portions, with the first bracket portion 61 attached to the first floor panel segment 48 and the second bracket portion 63 attached to the second floor panel segment 50. The first 61 and second 63 bracket portions come together to form a single bracket 60 having a U-shaped configuration in cross-section when the first 48 and second 50 floor panel segments are joined to one another.

Each of the front $\mathbf{22}_F$ and rear $\mathbf{22}_R$ floor panels has a plurality of brackets 60 attached or secured to the inner side 28. In instances where a bracket 60 is positioned where the first 48 and second 50 floor panel segments are joined together, the bracket 60 may have the first 61 and second 63 bracket portions that are brought together to form a U-shaped bracket 60 in cross section when the panel segments 48, 50 are joined together as described above. Otherwise, the bracket 60 is a single piece having a U-shaped configuration in cross section. Each one of the plurality of brackets 60 of the front floor panel $\mathbf{22}_F$ has a respective one of a plurality of brackets 64 attached or secured to the first floor joist 62 such that the brackets 60, 64 of each pair are opposite one another.

As shown at least in FIG. 4, each one of the brackets 64 of the first floor joist 62 is a single piece having a U-shaped configuration in cross-section except where the bracket 64 is located where first 70 and second 72 joist segments are joined together. The first 70 and second 72 joist segments are described below. Additionally, each pair of respective brackets 60, 64 that are opposite one another are configured to receive and support a second floor joist 66. The brackets 60, 64 may be attached or secured to the respective floor panels 22 and the first floor joist 62 by any suitable means, such as with one or more fasteners.

Figure 6:
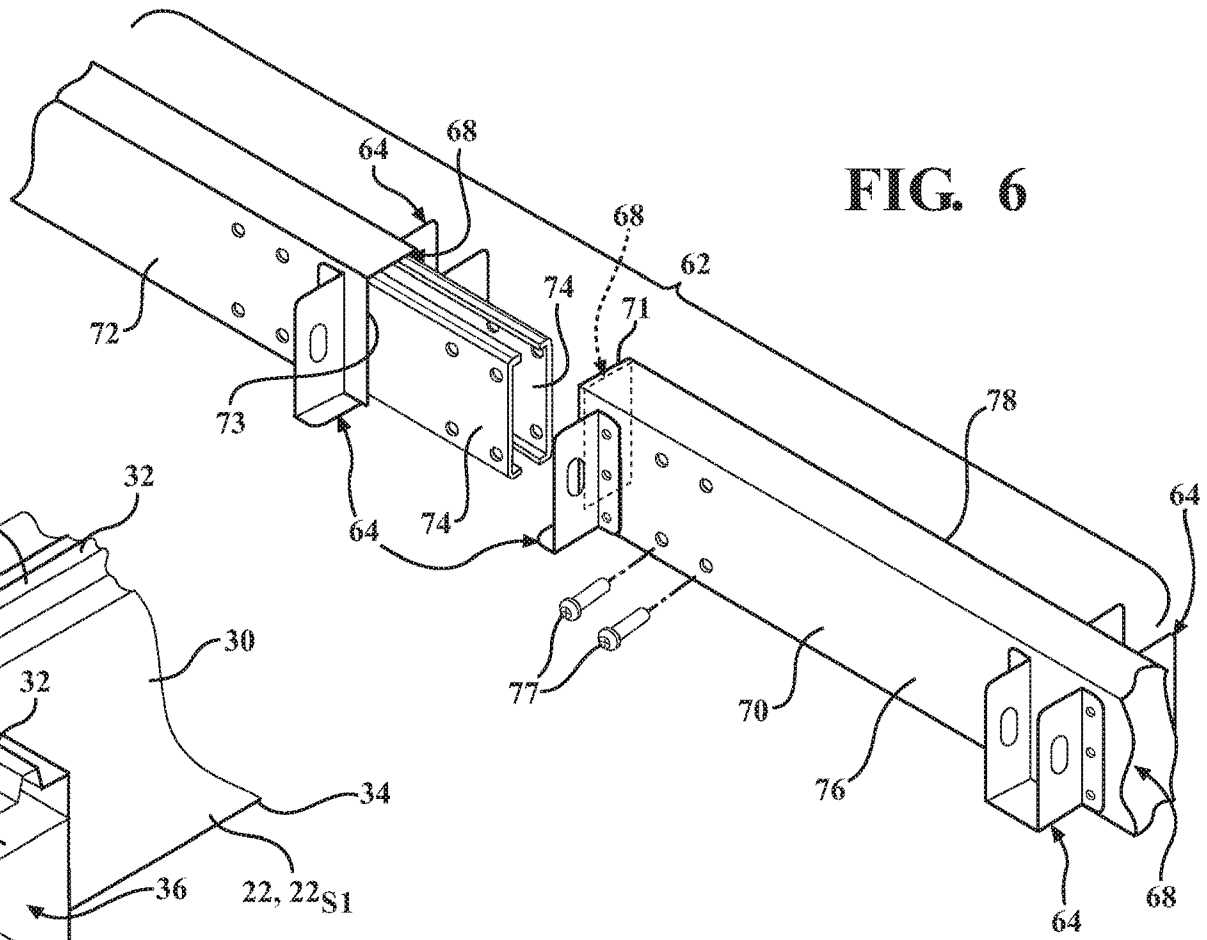
FIG. 6 is an enlarged, partially exploded view of a portion of the first floor joist.
Figure 5:
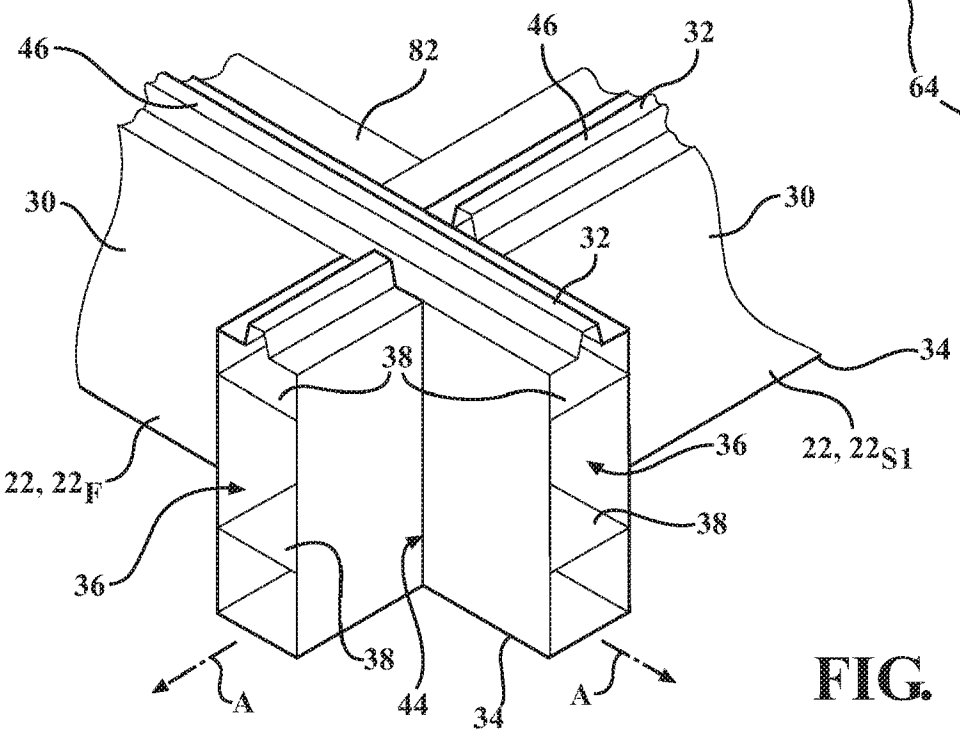
FIG. 5 is an enlarged view of a portion of adjacent floor panels interconnected to one another to form an interlocking joint.

With reference to FIGS. 4 and 6, the floor frame 12 has the first floor joist 62 extending between the first $\mathbf{22}_{S1}$ and second $\mathbf{22}_{S2}$ floor panels. The first floor joist 62 is transverse to the first $\mathbf{22}_{S1}$ and second $\mathbf{22}_{S2}$ floor panels and extends substantially parallel to the front $\mathbf{22}_F$ and rear $\mathbf{22}_R$ floor panels. The first floor joist 62 has first 65 and second 67 joist ends, with the first joist end 65 abutting and/or coupled to the first side floor panel $\mathbf{22}_{S1}$ and the second joist end 67 abutting and/or coupled to the second side floor panel $\mathbf{22}_{S2}$. In an embodiment, the first joist 62 further has the first 70 and second 72 joist segments joined to one another to form the first joist 62. The first joist segment 70 has the first joist end 65 and a first joist segment end 71, and the second joist segment 72 has the second joist end 67 and a second joist segment end 73. Each of the first 70 and second 72 joist segments defines a slot 68. In an embodiment, the second joist segment 72 has at least one tab 74 extending from the second joist segment end 73. The tab 74 of the second joist segment 72 is disposed within the slot 68 of the first joist segment 70 and attached to the first joist segment 70, such as with fasteners 77, to interconnect said first 70 and second 72 joist segments and form the first floor joist 62.

The first floor joist 62 further has first 76 and second 78 joist sides. The first joist side 76 faces the front floor panel $\mathbf{22}_F$, and the second joist side 78 faces the rear floor panel $\mathbf{22}_R$. A first plurality of the brackets 64 is attached or secured to the first joist side 76, with each one of these brackets 64 opposite a respective bracket 60 attached to the front floor panel $\mathbf{22}_F$. A second plurality of the brackets 64 is attached or secured to the second joist side 78, with each one of these brackets 64 opposite a respective bracket 60 attached to the rear floor panel $\mathbf{22}_R$. As mentioned above, each pair of brackets 60, 64 receives one of the second floor joists 66. The second floor joists 66 extend transverse to the front floor panel $\mathbf{22}_F$, the rear floor panel $\mathbf{22}_R$, and the first floor joist 62, and extend substantially parallel to the first $\mathbf{22}_{S1}$ and second $\mathbf{22}_{S2}$ side floor panels and to one another. It should be appreciated that the floor frame 12 could include any number of first floor joists 62 and second floor joists 66. Additionally, the arrangement of the first 62 and second 66 floor joists as shown in FIGS. 7 and 8 is not limited, and other arrangements of the first 62 and second 66 floor joists are also contemplated. The plurality of floor panels 22, the first floor joist 62, and the second floor joists 66 collectively form the floor frame 12.

As shown at least in FIG. 8, the building assembly 10 further includes a floor board 80 supported by the floor frame 12. The floor board 80 may be formed from any suitable flooring material, non-limiting examples of which include wood, plywood, fiberboard, synthetic materials such as laminate, etc. As shown in FIG. 8, the building assembly 10 includes a plurality of floor boards 80 disposed on the first 62 and second 64 joists and framed by the interconnected plurality of floor panels 22. In an embodiment, each of the plurality of floor panels 22 has a ledge 82 extending inwardly from the inner side 28 of the floor panel 22 and positioned below the top surface 32. The floor board(s) 80 is disposed on and supported by the ledges 82 of the interconnected floor panels 22, the first floor joist 62, and the second floor joists 66 to form a floor 83 of the building assembly 10. The floor 83 is best shown in FIGS. 9, 14, 16, 17, 21-23, 25, and 29. In an embodiment, and as shown in FIG. 8, the floor board(s) 80 rests against the ledges 82 of the floor panels 22, the first floor joist 62, and the second floor joists 66. In another embodiment, the floor board(s) 82 is secured to the ledges 82 of the floor panels 22, the first floor joist 62, and/or the second floor joists 66 with one or more fasteners.

The building assembly 10 includes the plurality of walls 16 as mentioned above. At least one of the plurality of walls 16 defines an opening 218 to provide access to the inside of the building assembly 10. In the illustrated embodiment, and with reference at least to FIG. 9, the plurality of walls 16 includes a front wall $\mathbf{16}_F$, a rear wall $\mathbf{16}_R$ opposite the front wall $\mathbf{16}_F$, a first side wall $\mathbf{16}_{S1}$, and a second side wall $\mathbf{16}_{S2}$ opposite the first side wall $\mathbf{16}_{S1}$. Each of the plurality of walls 16 includes a plurality of panels 84, with each panel 84 defining a longitudinal axis B and having a length $L_P$ extending along the longitudinal axis B. Each panel 84 has first 86 and second 88 ends, opposing inner 90 and outer 92 sides, and opposing top 94 and bottom 96 surfaces. The inner side 90 of each of the panels 84 faces inwardly toward the inside of the building assembly 10 and forms part of the building interior 18. The outer side 92 of each of the panels 84 faces outwardly toward the environment E surrounding the building assembly 10 and forms part of the building exterior 20. Additionally, and as best shown in FIG. 10, the inner 90 and outer 92 sides are spaced from one another, and each of the plurality of panels 84 has a slot 109 and first 110 and second 112 support ribs disposed in the slot 109. The first 110 and second 112 support ribs extend between the first 86 and second 88 ends. Such a configuration of each of the panels 84 may be referred to as a slatwall configuration.

With reference to FIGS. 9-12, each panel 84 includes a mounting channel 98 formed in at least one of the inner 90 and outer 92 sides extending along the longitudinal axis B for removably securing an accessory M to at least one of the interior 18 and the exterior 20 of the building assembly 10. In an embodiment, the mounting channel 98 is further defined as a first mounting channel 98 formed in the inner side 90 extending along the longitudinal axis B for removably securing the accessory M to the interior 18 of the building assembly 10. Each panel 84 further includes a second mounting channel 100 formed in the outer side 82 extending along the longitudinal axis B for removably securing another accessory M to the exterior 20 of the building assembly 10. The accessory M may be any object removably secured or attached to the interior 18 and/or exterior 20 of the building assembly 10, non-limiting examples of which include shelves, hooks, storage baskets, storage cabinets, storage cubes, household items, plants, etc.

Details of the mounting channels 98, 100 are described below at least with reference to FIGS. 10 and 11. Each of the first 98 and second 100 mounting channels are spaced from the top surface 94 of the panel 84. In the illustrated embodiment, the first 98 and second 100 mounting channels are spaced a same distance $D_{MC1}$, $D_{MC2}$ from the top surface 94 of the panel 84 such that the first mounting channel 98 is opposite the second mounting channel 100. In an alternative configuration, the first 98 and second 100 mounting channels could be spaced a different distance from the top surface 94 such that the first mounting channel 98 is offset from the second mounting channel 100. In an embodiment, each one of the plurality of panels 84 has the first 98 and second 100 mounting channels that are spaced a same distance $D_{MC1}$, $D_{MC2}$ from the top surface 94. In an alternative embodiment, some of the panels 84 could have the first 98 and second 100 mounting channels spaced the same distance from the top surface 94, while other panels 84 could have the first 98 and second 100 mounting channels spaced a different distance from the top surface 94. Additionally, one or more of the panels 84 could have only the first mounting channel 98 or only the second mounting channel 100.

Figure 11:
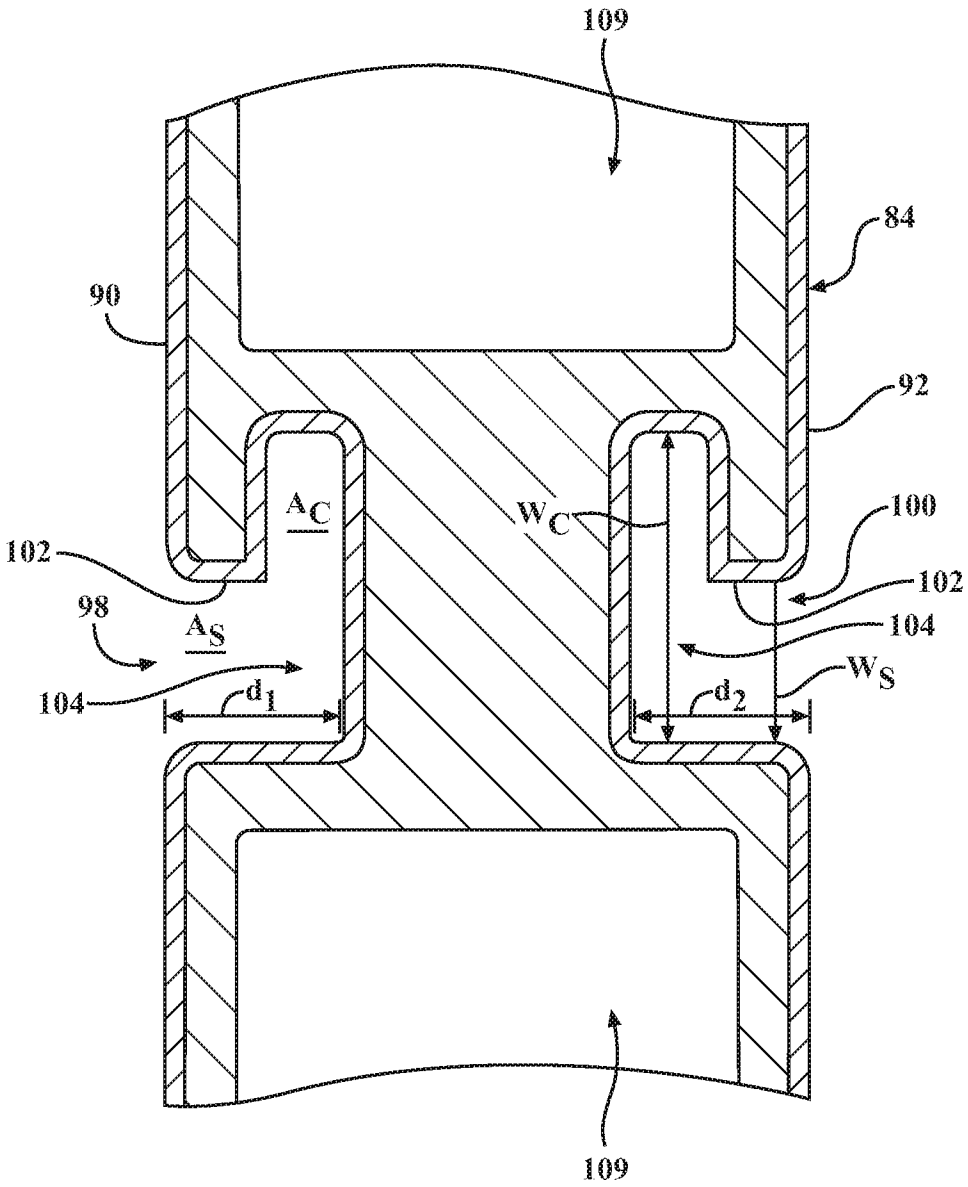
FIG. 11 is an enlarged view of a portion of the panel of FIG. 10.

As best shown in FIG. 11, the first mounting channel 98 has a first channel depth $d_1$ and the second mounting channel 100 has a second channel depth $d_2$. The first channel depth $d_1$ of the first mounting channel 98 is the same as the second channel depth $d_2$ of the second mounting channel 100. In an alternative configuration, the first $d_1$ and second $d_2$ channel depths could be different.

Figure 12:
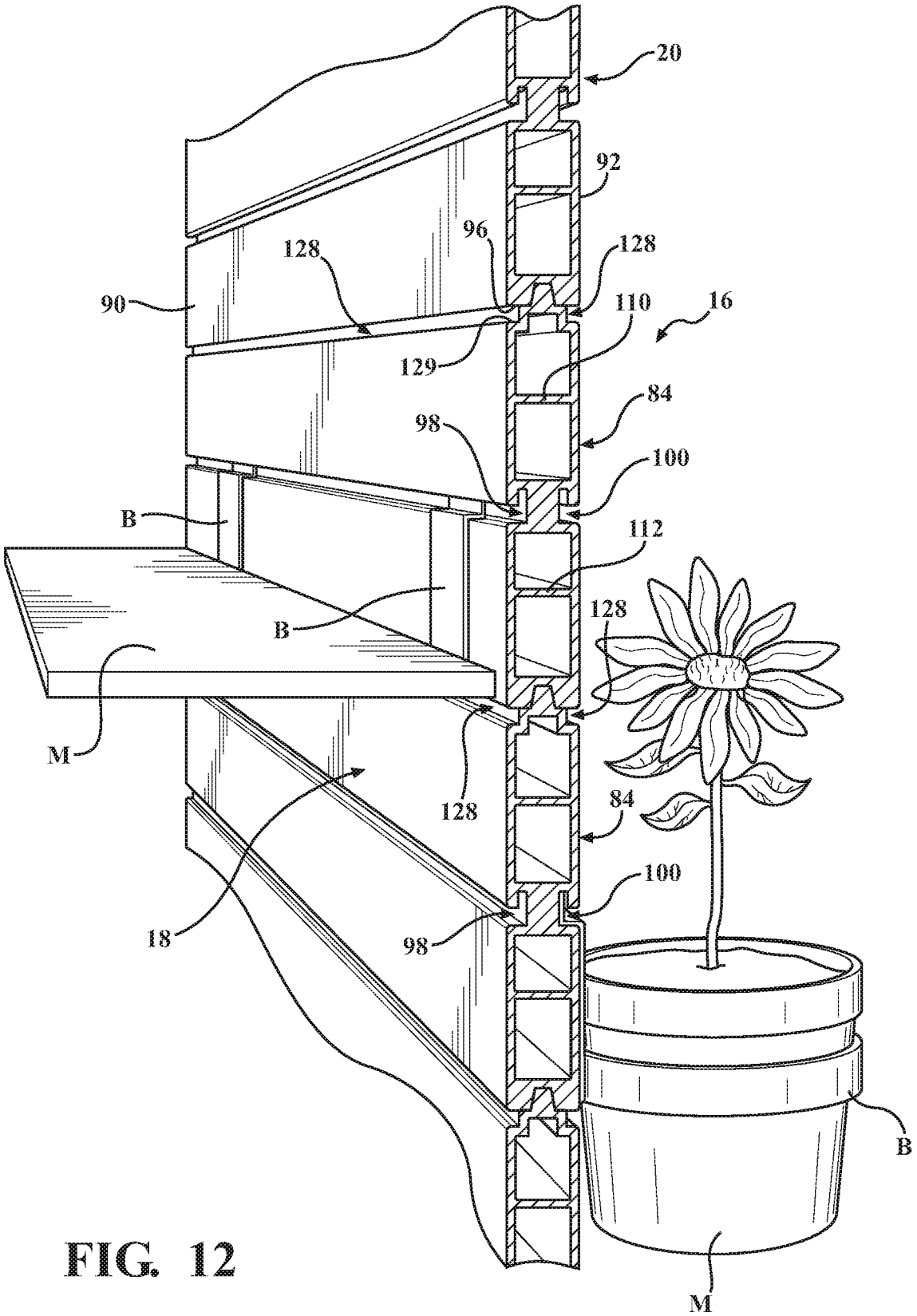
FIG. 12 is a perspective view of a portion of one of the plurality of walls with an accessory removably attached to the wall.

Each of the first 98 and second 100 mounting channels has a stem portion 102 and a chamber portion 104. The chamber portion 104 has a larger cross-sectional area $A_C$ compared to the cross-sectional area $A_S$ of the stem portion 102. Additionally, the stem portion 102 has a cross-sectional width $W_S$ and the chamber portion 104 has a cross-sectional width $W_C$ that is larger than the cross-sectional width $W_S$ of the stem portion 102. In the illustrated embodiment, each of the first 98 and second 100 mounting channels has a P-shaped configuration in cross-section. With this configuration of the first 98 and second 100 mounting channels, the accessory M can be easily attached to and removed from the interior 18 and exterior 20 of the building assembly 10. For instance, and as shown in FIG. 12, the accessory M may be removably attached to the building assembly 10 utilizing a bracket B. In an embodiment, the bracket B is an 'S' bracket, where one end of the 'S' is secured to the accessory M and the other end of the 'S' bracket is disposed within the chamber portion 104 of the mounting channel 98, 100 and held by the panel 84 defining the stem 102 and chamber 104 portions of the mounting channel 98, 100. It should be appreciated that other configurations of the mounting channel 98, 100 are also contemplated as long as the accessory M can be suitably and/or readily attached to and removed from the interior 18 and exterior 20 of the building assembly 10.

Figure 9:
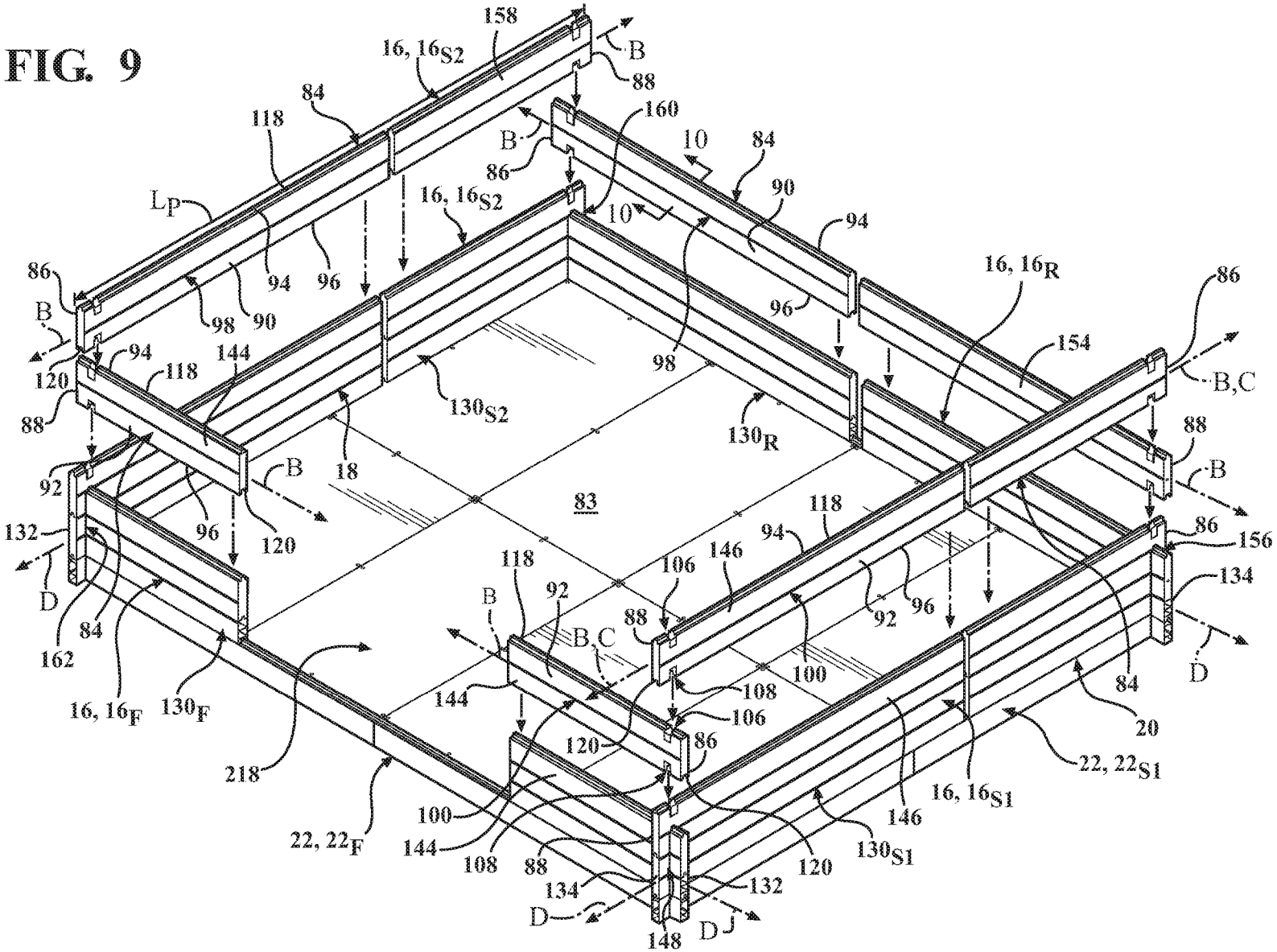
FIG. 9 is a partially exploded, perspective view of a portion of a plurality of interconnected walls supported by the floor frame with each wall formed from a plurality of panels.
Figure 10:
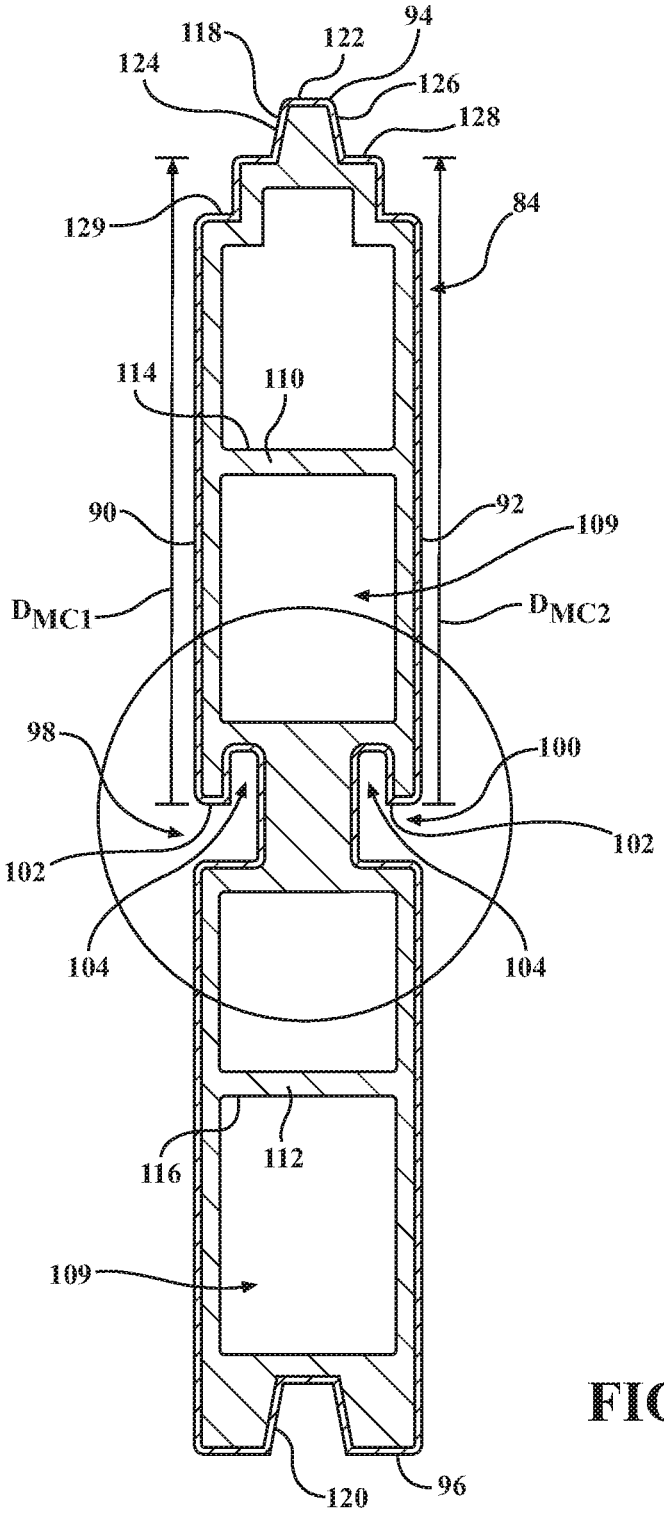
FIG. 10 is a cross-sectional view of one of the plurality of panels taken along line 10-10 in FIG. 9.
Figure 13:
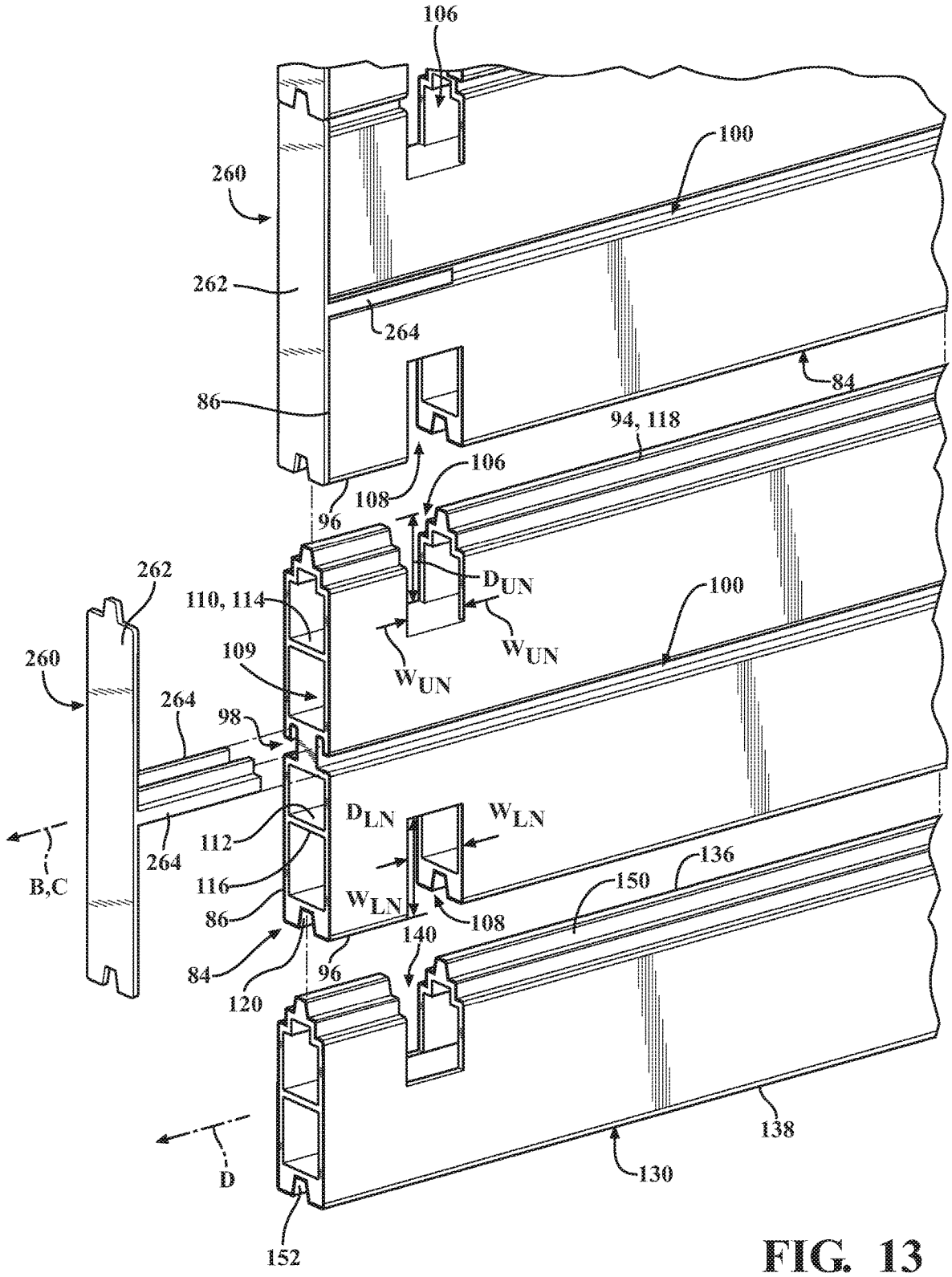
FIG. 13 is a partially exploded, perspective view of a portion of one of the plurality of walls including caps for covering the respective ends of the panels of the wall.
Figure 14:
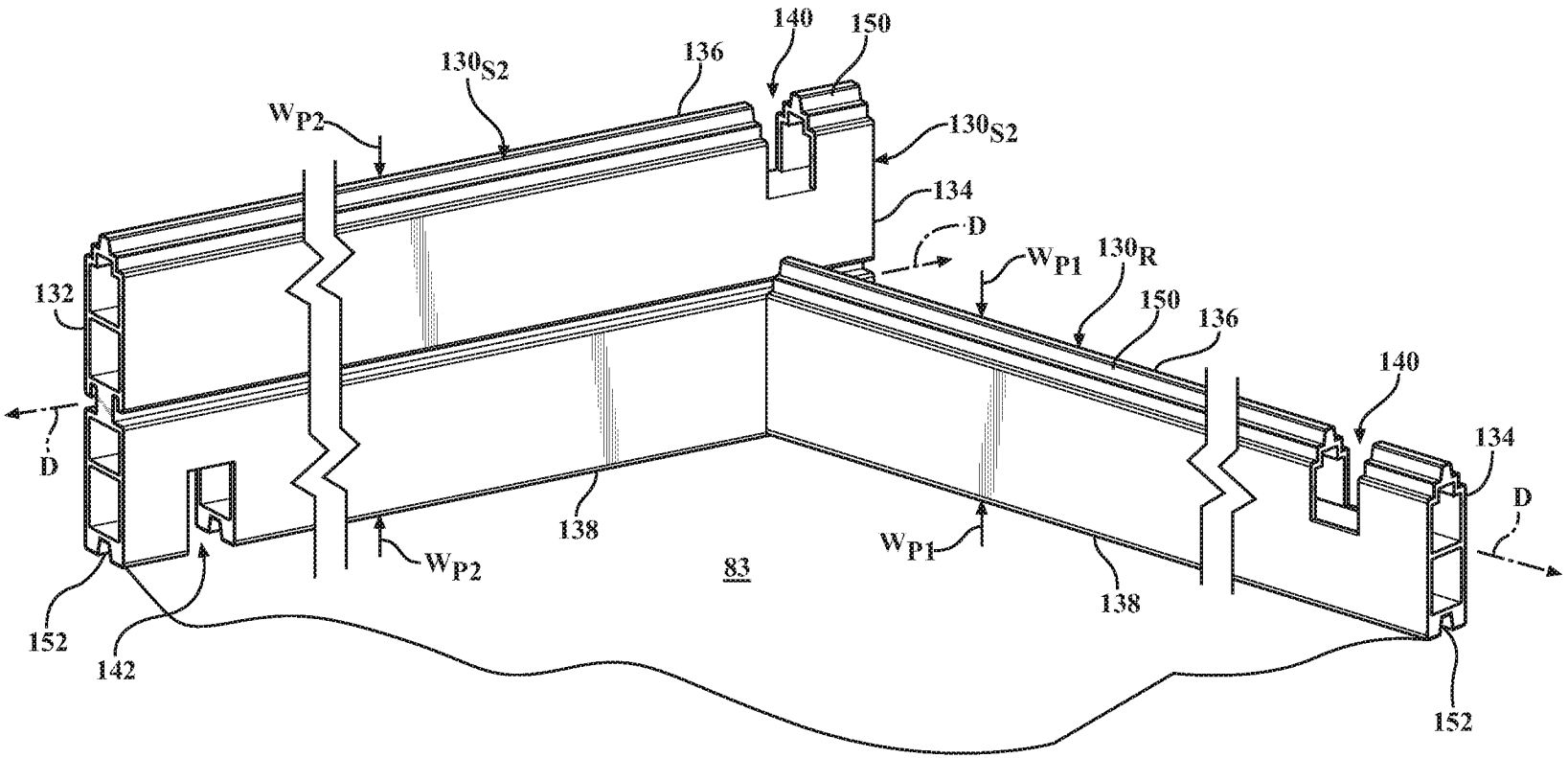
FIG. 14 is an enlarged, perspective view of a portion of the building assembly showing interconnected base panels of adjacent walls.

Referring at least to FIGS. 9 and 13, each panel 84 further includes an upper notch 106 formed through the top surface 94 and an opposing lower notch 108 formed through the bottom surface 96. Each of the upper 106 and lower 108 notches is spaced inwardly along the longitudinal axis B from at least one of the first 86 and second 88 ends of the panel 84. In an embodiment, the longitudinal axis B is further defined as a center axis C extending between the first 86 and second 88 ends of the panel 84. With reference to FIG. 13, the upper notch 106 is formed through the top surface 94 of the panel 94 and extends toward but terminates prior to the center axis C. The lower notch 108 is formed through the bottom surface 96 and extends toward but terminates prior to the center axis C. In another embodiment, the upper notch 106 has an upper notch depth $D_{UN}$ and the lower notch 108 has a lower notch depth $D_{LN}$ with the upper notch depth $D_{UN}$ the same as the lower notch depth $D_{LN}$. Additionally, the upper notch 106 has an upper notch width $W_{UN}$ and the lower notch 108 has a lower notch width $W_{LN}$ with the upper notch width $W_{UN}$ the same as the lower notch width $W_{LN}$.

Each of the upper 106 and lower 108 notches has a cross-sectional configuration. As best shown in FIG. 13, the upper notch 106 has a first cross-sectional configuration and the lower notch 108 has a second cross-sectional configuration different from the first cross-sectional configuration. In an embodiment, the top surface 94 of each of the plurality of panels 84 defines a tongue 118 extending outwardly in a direction transverse to the longitudinal axis B and the bottom surface 96 of each of the plurality of panels 84 defines a groove 120 extending inwardly in a direction transverse to the longitudinal axis B. The cross-sectional configuration of the upper notch 106 is defined by the cross-sectional configuration of the inner 90 and outer 92 sides of the panel 84 and the tongue 118. This is different from the cross-sectional configuration of the lower notch 108, which is defined by the cross-sectional configuration of the inner 90 and outer 92 sides of the panel 84 and the groove 120.

As previously mentioned, and as shown in FIGS. 10, 12, and 13, each of the plurality of panels 84 has the slot 109 and the first 110 and second 112 support ribs disposed in the slot 109 and extending between the first 86 and second 88 ends. As best shown in FIG. 13, the upper notch 106 extends between the top surface 94 and the first support rib 110, and the lower notch 108 extends between the bottom surface 96 and the second support rib 112. The first support rib 110 is substantially parallel to the top surface 94 of the panel 84 and defines a base 114 of the upper notch 106, and the second support rib 112 is substantially parallel to the bottom surface 96 of the panel 84 and defines a base 116 of the lower notch 108. Each of the support ribs 110, 112 extends along the entire length of the panel 84. In an alternative configuration, one or more of the support ribs 110, 112 could extend along a portion of the length of the panel 84. It should be appreciated that the panels 84 could have additional support ribs, and one or more of the support ribs could extend at least partially along the longitudinal axis B of each panel 84.

As mentioned above, the top surface 94 of each of the panels 84 defines the tongue 118 and the bottom surface of each of the panels 84 defines the groove 120. As best shown in FIG. 10, the top surface 94 has a stepped profile with the top step forming the tongue 118. The tongue 118 has a substantially flat upper surface 122, a base 128 opposite the upper surface 122, and first 124 and second 126 side surfaces both extending from the upper surface 122 at an angle offset from 90°. With this configuration, the base 128 of the tongue is wider in cross-section than the upper surface 122. As also mentioned above, the bottom surface 96 defines the groove 120. The cross-sectional configuration of the groove 120 is complementary to that of the tongue 118 so that the groove 120 of one panel 84 can readily receive the tongue 118 of an adjacent panel 84 to form the walls 16. As shown in FIGS. 9, 12, and 13, the tongue 118 of one of the plurality of panels 84 mates with the groove 120 of an adjacent one of the plurality of panels 84 to form one of the plurality of walls 16. This is accomplished by placing one panel 84 over an adjacent panel 84 such that the tongue 118 of the adjacent panel 84 is received within the groove 120 of the one panel 84 to stack the plurality of panels 84 and form one of the walls 16. This is illustrated at least in FIGS. 9 and 13.

The stepped profile of the top surface 94 of each of the plurality of panels 84 defines a ledge 129, as shown in FIGS. 10 and 13. As best shown in FIG. 13, when adjacent panels 84 are joined to one another (by mating the tongue 118 of one of the panels 84 with the groove 120 of an adjacent one of the panels 84), a portion of the bottom surface 96 of the panel 84 remains exposed. The exposed portion of the bottom surface 96 of the one of the panels 84 and the ledge 129 of an adjacent one of the panels 84 form a channel 128 between the adjacent panels 84. The channel 128 extends along the longitudinal axis B. In the illustrated embodiment, the channel 128 has the same configuration as the stem portion 102 of the first 98 and second 100 mounting channels such that the channel 128 and the second mounting channel 100 look similar when viewed from either the inside or the outside of the building assembly 10.

With reference to FIGS. 9 and 13-15, and in an embodiment, each of the plurality of walls 16 includes a base panel 130 defining a longitudinal axis D, and has first 132 and second 134 ends and opposing top 136 and bottom 138 surfaces. The base panel $\mathbf{130}_F$ of the front wall $\mathbf{16}_F$ and the base panel $\mathbf{130}_R$ of the rear wall $\mathbf{16}_F$ has a first base panel configuration, and the base panel $\mathbf{130}_{S1}$ of the first side wall $\mathbf{16}_{S1}$ and the base panel $\mathbf{130}_{S2}$ of the second side wall $\mathbf{16}_{S2}$ has a second base panel configuration different from the first base panel configuration. For example, the base panel $\mathbf{130}_F$, $\mathbf{130}_R$ of the front $\mathbf{16}_F$ and rear $\mathbf{16}_R$ walls has a first panel width $W_{P1}$ and the base panel $\mathbf{130}_{S1}$, $\mathbf{130}_{S2}$ of each of the first $\mathbf{16}_{S1}$ and second $\mathbf{16}_{S2}$ side panels has a second panel width $W_{P2}$ twice the first panel width $W_{P1}$. In this example, the base panel $\mathbf{130}_F$, $\mathbf{130}_R$ of each of the front $\mathbf{16}_F$ and rear $\mathbf{16}_R$ walls may be referred to herein as a half or partial base panel. The base panel $\mathbf{130}_{S1}$, $\mathbf{130}_{S2}$ of each of the first $\mathbf{16}_{S1}$ and second $\mathbf{16}_{S2}$ side walls may be referred to herein as a full or whole base panel. In an embodiment, the whole base panel $\mathbf{130}_{S1}$, $\mathbf{130}_{S2}$ has the same configuration as each of the plurality of panels 84.

Each of the base panels 130 has an upper notch 140 formed through the top surface 136 spaced inwardly along the longitudinal axis D from each of the first 132 and second 134 ends. Each of the whole base panels 130 also has a lower notch 142 formed through the bottom surface 138 spaced inwardly along the longitudinal axis D from each of the first 132 and second 134 ends. Notably, none of the half base panels 130 has a lower notch. Additionally, the top surface 136 of each of the base panels 130 defines a tongue 150 extending outwardly in a direction transverse to the longitudinal axis D, and the bottom surface 138 of each of the base panels 130 defines a groove 152 extending inwardly in a direction transverse to the longitudinal axis D.

Figure 15:
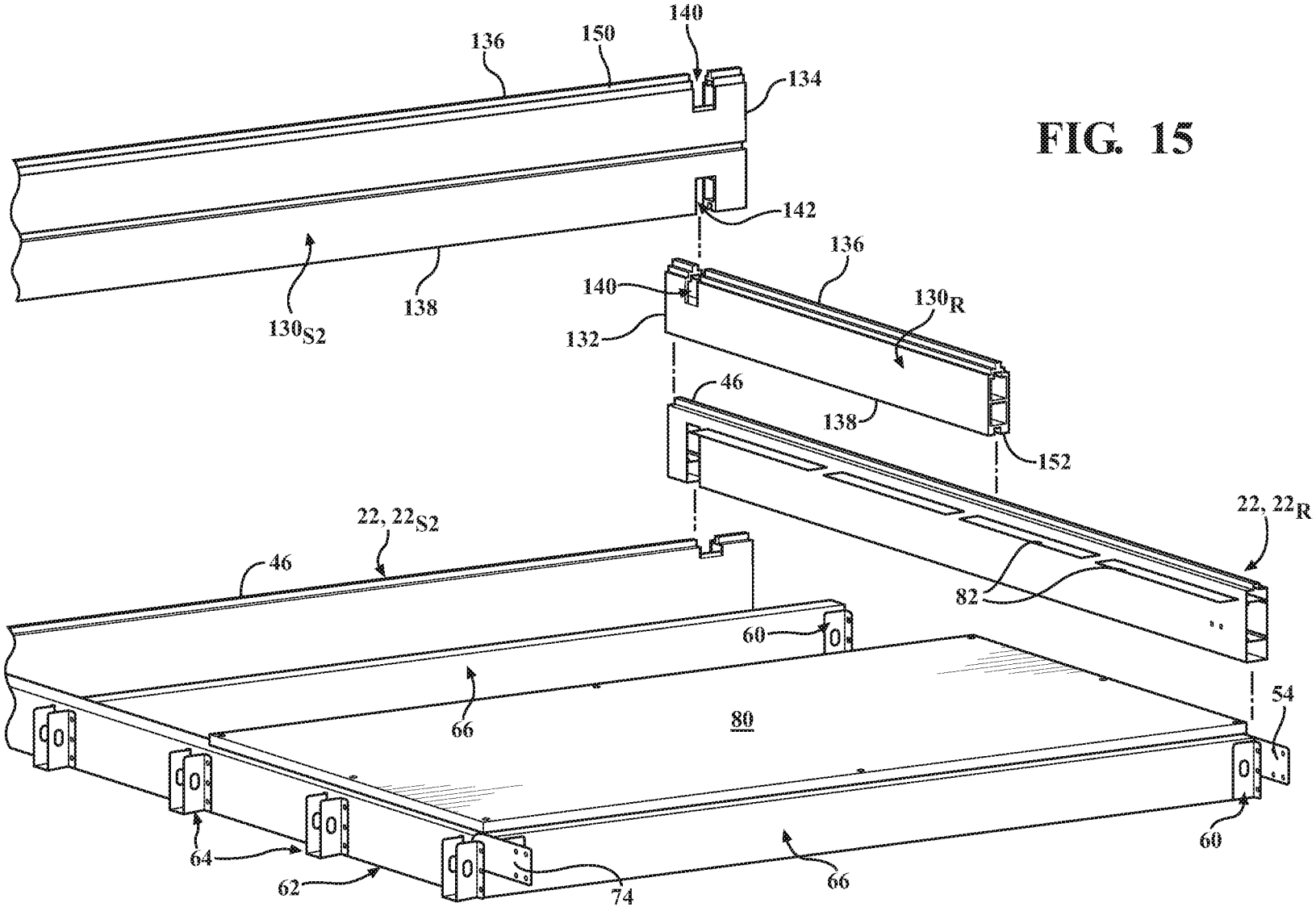
FIG. 15 is an enlarged, partially exploded view of a portion of the floor frame and the base panels of adjacent walls of the building assembly.

The base panels 130 are coupled to the floor frame 12 as follows. One of the half base panels $\mathbf{130}_R$ is disposed over and coupled to the rear floor panel $\mathbf{22}_R$ by receiving the tongue 46 of the rear floor panel $\mathbf{22}_R$ in the groove 152 of the half base panel $\mathbf{130}_R$ to initiate formation of the rear wall $\mathbf{16}_R$, as shown in FIG. 15. Another one of the half base panels $\mathbf{130}_F$ is disposed over and coupled to the front floor panel $\mathbf{22}_F$ by receiving the tongue 46 of the front floor panel $\mathbf{22}_F$ in the groove 152 of the half base panel $\mathbf{130}_F$ to initiate formation of the front wall $\mathbf{16}_F$. Then, one of the whole base panels $\mathbf{130}_{S2}$ is disposed over and coupled to the second side wall $\mathbf{16}_{S2}$ by receiving the tongue 46 of the second side floor panel $\mathbf{22}_{S2}$ in the groove 152 of the whole base panel $\mathbf{130}_{S2}$ to initiate formation of the second side wall $\mathbf{16}_{S2}$, as shown in FIG. 15. The other one of the whole base panels $\mathbf{130}_{S1}$ is disposed over and coupled to the first side floor panel $\mathbf{22}_{S1}$ by receiving the tongue 46 of the first side floor panel $\mathbf{22}_{S1}$ in the groove 152 of the whole base panel $\mathbf{130}_{S1}$ to initiate formation of the first side wall $\mathbf{16}_{S1}$. Additionally, the lower notches 142 formed in the bottom surface 138 of the whole base panel $\mathbf{130}_{S1}$, $\mathbf{130}_{S2}$ mates with respective upper notches 140 formed in the top surface 136 of the half base panel $\mathbf{130}_F$, $\mathbf{130}_R$ to interconnect the base panels $\mathbf{130}_F$, $\mathbf{130}_R$, $\mathbf{130}_{S1}$, $\mathbf{130}_{S2}$.

The plurality of walls 16 are interconnected to one another as the individual walls 16 are formed by stacking the panels 84. Interconnection of the plurality of walls 16 is described below at least with reference to FIG. 9. In an embodiment, the plurality of panels 84 includes first 144 and second 146 panels. The lower notch 108 of the first panel 144 mates with the upper notch 106 of the second panel 146 to form an interlocking joint 148 between the first 144 and second 146 panels to interconnect the first 144 and second 146 panels and form adjacent interconnected walls 16 of the plurality of walls 16 of the building assembly 10. Such a connection between the first 144 and second 146 panels may be referred to as a saddle notch connection, which is accomplished without requiring any tools. In an embodiment, the first panel 144 is one of a plurality of first panels 144 each having the first 86 and second 88 ends, and the second panel 146 is one of a plurality of second panels 146 each having the first 86 and second ends 88. The interlocking joint 148 is further defined as a plurality of interlocking joints 148 each formed between one of the plurality of first panels about the first end 86 of the first panel 144 and one of the plurality of second panels about the second end 88 of the second panel 146 to interconnect the plurality of first panels 144 and the plurality of second panels 146 to partially form adjacent walls 16 of the plurality of walls 16 of the building assembly 10.

In an embodiment, the adjacent walls 16 are further defined as the front $\mathbf{16}_F$ and first side $\mathbf{16}_{S1}$ walls, and the plurality of panels 84 further includes a third panel 154. The lower notch 108 of third panel 154 mates with the upper notch 106 of the second panel 146 to form a second interlocking joint 156 between the second 146 and third 154 panels. Additionally, the third panel 154 is one of a plurality of third panels 154 each having the first 86 and second 88 ends and the second interlocking joint 156 is further defined as a plurality of second interlocking joints 156. Each of the second interlocking joints 156 is formed between one of the plurality of second panels 146 about the first end 86 of the second panel 146 and one of the plurality of third panels 154 about the second end 88 of the third panel 154 to interconnect the plurality of second panels 146 and the plurality of third panels 154 to partially form the rear wall $\mathbf{16}_R$ adjacent the first side wall $\mathbf{16}_{S1}$ of the plurality of walls 16 of the building assembly 10.

The plurality of panels 84 further includes a fourth panel 158 and the lower notch 108 of the third panel 154 mates with the upper notch 106 of the fourth panel 158 to form a third interlocking joint 160 between the third 154 and fourth 158 panels. The fourth panel 158 is one of a plurality of fourth panels 158 each having the first 86 and second 88 ends, and the third interlocking joint 160 is further defined as a plurality of third interlocking joints 160. Each of the third interlocking joints 160 is formed between one of the plurality of third panels 154 about the first end 86 of the third panel 154 and one of the plurality of fourth panels 158 about the second end 88 of the fourth panel 158 to interconnect the plurality of third panels 154 and the plurality of fourth panels 158 to partially form the second side wall $\mathbf{16}_{S2}$ adjacent the rear wall $\mathbf{16}_R$ of the plurality of walls 16 of the building assembly 10.

The upper notch 106 of the fourth panel 158 mates with the lower notch 108 of the first panel 144 to form a fourth interlocking joint 162 between the first 144 and fourth 158 panels. The fourth interlocking joint 162 is further defined as a plurality of fourth interlocking joints 162 each formed between one of the plurality of fourth panels 158 about the first end 86 of the fourth panel 158 and one of the plurality of first panels 144 about the second end 88 of the first panel 144 to interconnect the plurality of fourth panels 158 and the plurality of first panels 144.

In an embodiment, and as shown at least in FIG. 13, the building assembly 10 further includes a plurality of caps 260 coupled to at least one of the first 86 and second 88 ends of each of the plurality of panels 84. Each cap 260 is configured to enclose the slot 109 of a respective one of the panels 84 at one or more of the first 86 and second 88 ends. Each of the plurality of caps 260 has a head 262 disposed over the at least one of the first 86 and second 88 ends of a respective one of the plurality of panels 84. Each of the plurality of caps 260 further has a stem 264 extending from the head 262. The stem 264 is disposed within the mounting channel 98, 100 to mount the cap 260 to the at least one of the first 86 and second 88 ends of the respective one of the plurality of panels 84. In the illustrated embodiment, the cap 260 has two stems 264, with one of the stems 264 disposed within the first mounting channel 98 and the other one of the stems 264 disposed within the second mounting channel 100. Other configurations of the cap 260 are also contemplated.

Figure 16:
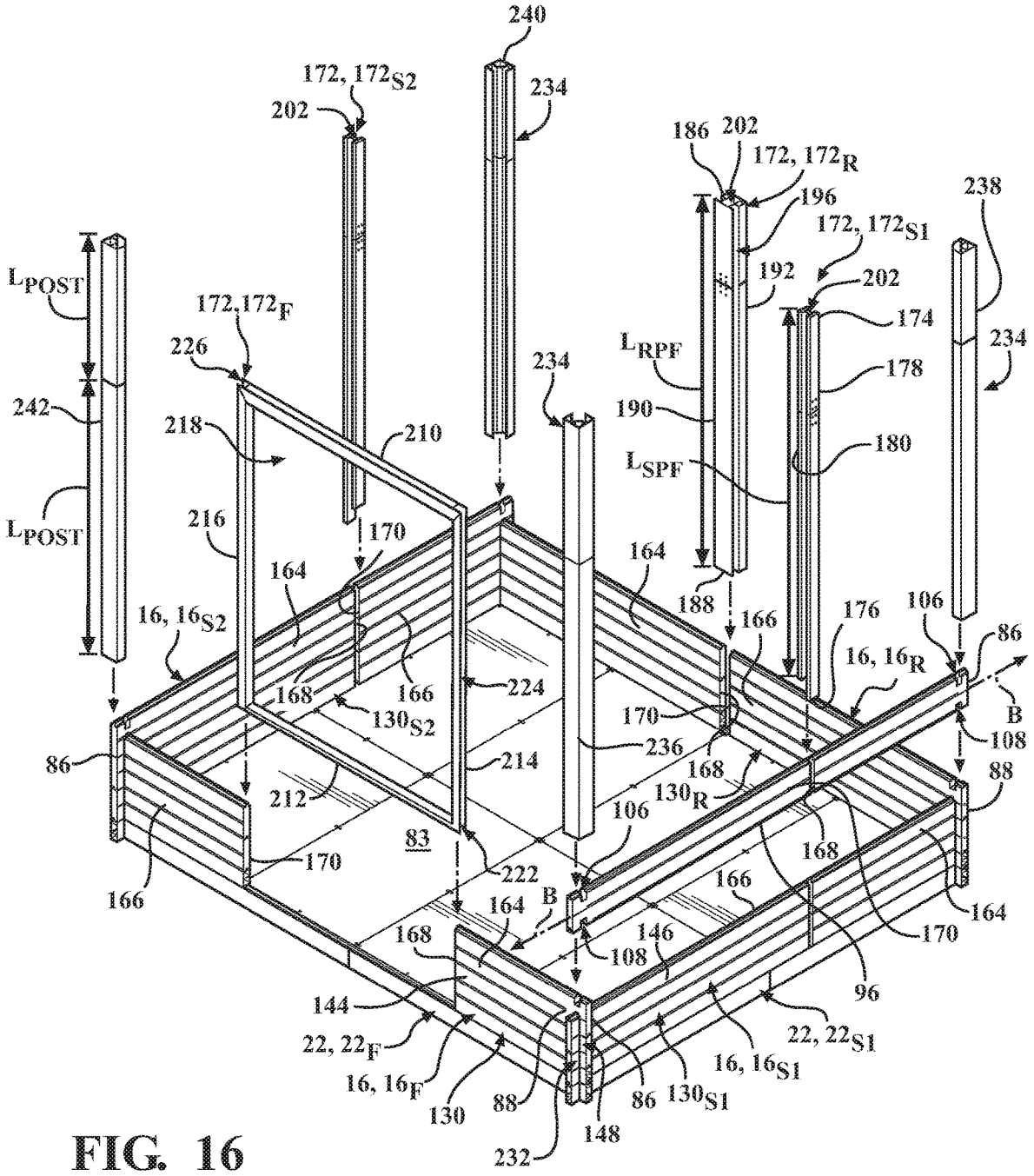
FIG. 16 is a partially exploded, perspective view of the building assembly showing the floor frame, the plurality of walls, a plurality of panel frames, and a plurality of posts.

In an embodiment, and with reference at least to FIG. 16, the plurality of panels 84 of each of the plurality of walls 16 has a first section of panels 164 and a second section of panels 166 spaced from the first section of panels 164. Each panel 84 of the first section of panels 164 has the first end 86, a first segment end 168 opposite the first end 86, the upper notch 106 formed through the top surface 94, and the opposing lower notch 108 formed through the bottom surface 96. The upper 106 and lower 108 notches are spaced inwardly along the longitudinal axis B from the first end 86. Each panel 84 of the second section of panels 166 has the second end 88, a second segment end 170 opposite the second end 88, the upper notch 106 formed through the top surface 94, and the opposing lower notch 108 formed through the bottom surface 96. The upper 106 and lower 108 notches are spaced inwardly along the longitudinal axis B from the second end 88.

Figure 17:
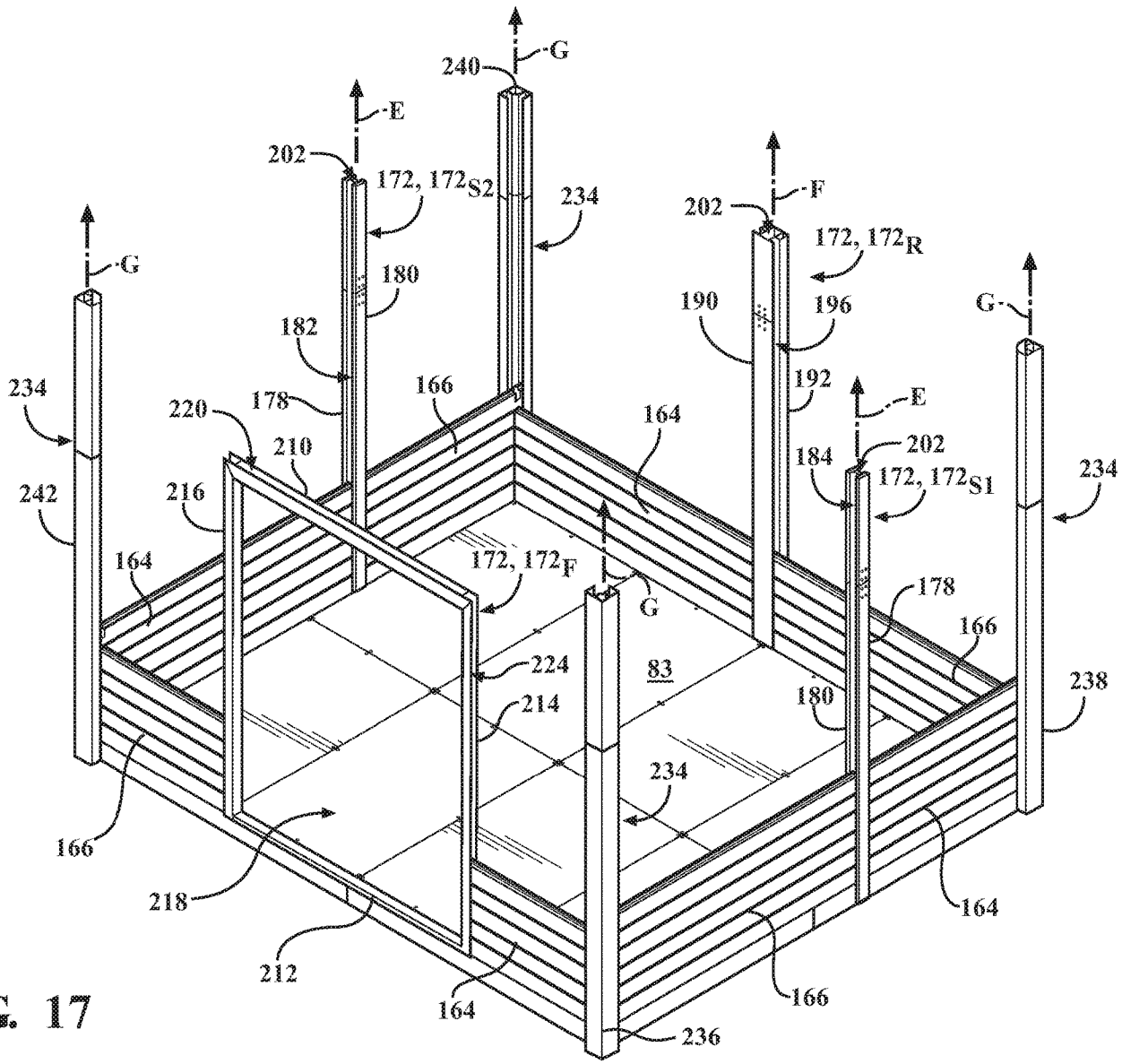
FIG. 17 is a perspective view of the building assembly showing the floor frame, the plurality of walls, a plurality of panel frames, and a plurality of posts.

The building assembly 10 further includes a panel frame 172 disposed between the first 164 and second 166 sections of panels. With reference to FIGS. 16 and 17, the panel frame 172 is connected to the first segment end 168 of each panel 84 of the first section of panels 164 and connected to the second segment end 170 of each panel 84 of the second section of panels 166 to interconnect the first 164 and second 166 sections of panels of the wall 16. In an embodiment, the panel frame 172 is further defined as a first side panel frame $\mathbf{172}_{S1}$ connected to the first 164 and second 166 sections of panels of the first side wall $\mathbf{16}_{S1}$. The building assembly 10 further includes a rear panel frame $\mathbf{172}_R$ connected to the first segment end 168 of each panel 84 of the first section of panels 164 and connected to the second segment end 170 of each panel 84 of the second section of panels 166 to interconnect the first 168 and second 170 sections of panels of the rear wall $\mathbf{16}_R$. The building assembly 10 further includes a second side panel frame $\mathbf{172}_{S2}$ connected to the first segment end 168 of each panel 84 of the first section of panels 164 and connected to the second segment end 170 of each panel 84 of the second section of panels 166 to interconnect the first 168 and second 170 sections of panels of the second side wall $\mathbf{16}_{S2}$. Additionally, the building assembly 10 further includes a front panel frame $\mathbf{172}_F$ connected to the first segment end 168 of each panel 84 of the first section of panels 164 and connected to the second segment end 170 of each panel 84 of the second section of panels 166 to interconnect the first 168 and second 170 sections of panels of the front wall $\mathbf{16}_F$.

Figure 18:
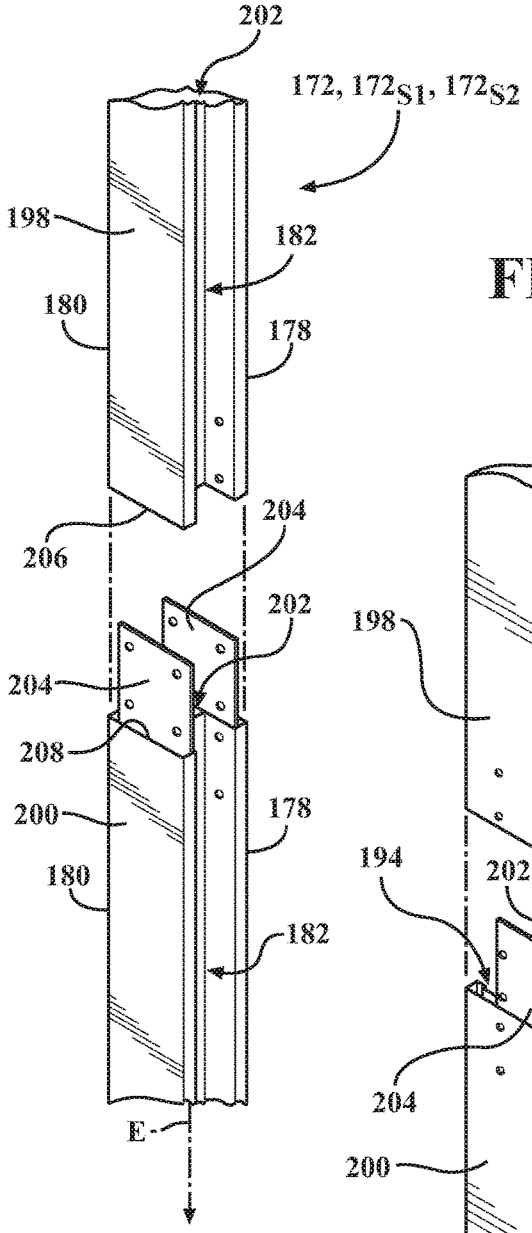
FIG. 18 is an enlarged, partially exploded view of a portion of a panel frame for a side wall of the building assembly.

The configuration of the panel frame $\mathbf{172}_{S1}$ and $\mathbf{172}_{S2}$ of the first $\mathbf{16}_{S1}$ and second $\mathbf{16}_{S2}$ walls, respectively, is described with reference to FIGS. 16-18. Each of the panel frames $\mathbf{172}_{S1}$, $\mathbf{172}_{S2}$ defines a longitudinal axis E, and has a length $L_{SPF}$ extending along the longitudinal axis E. Each of the panel frames $\mathbf{172}_{S1}$, $\mathbf{172}_{S2}$ further has first 174 and second 176 ends and opposing first 178 and second 180 sides. The first side 178 defines a first channel 182 extending along the longitudinal axis E, and the second side 180 defines a second channel 184 also extending along the longitudinal axis E. The first channel 182 receives the first segment end 168 of each of the panels 84 of the first section of panels 164 of the first side wall $\mathbf{16}_{S1}$ and the second channel 184 receives the second segment end 170 of each of the panels 84 of the second section of panels 166 of the first side wall $\mathbf{16}_{S1}$ to interconnect the first 164 and second 166 sections of panels of the first side wall $\mathbf{16}_{S1}$. Similarly, the first channel 182 receives the first segment end 168 of each of the panels 84 of the first section of panels 164 of the second side wall $\mathbf{16}_{S2}$ and the second channel 184 receives the second segment end 170 of each of the panels 84 of the second section of panels 166 of the second side wall $\mathbf{16}_{S2}$ to interconnect the first 164 and second 166 sections of panels of the second side wall $\mathbf{16}_{S2}$.

Figure 19:
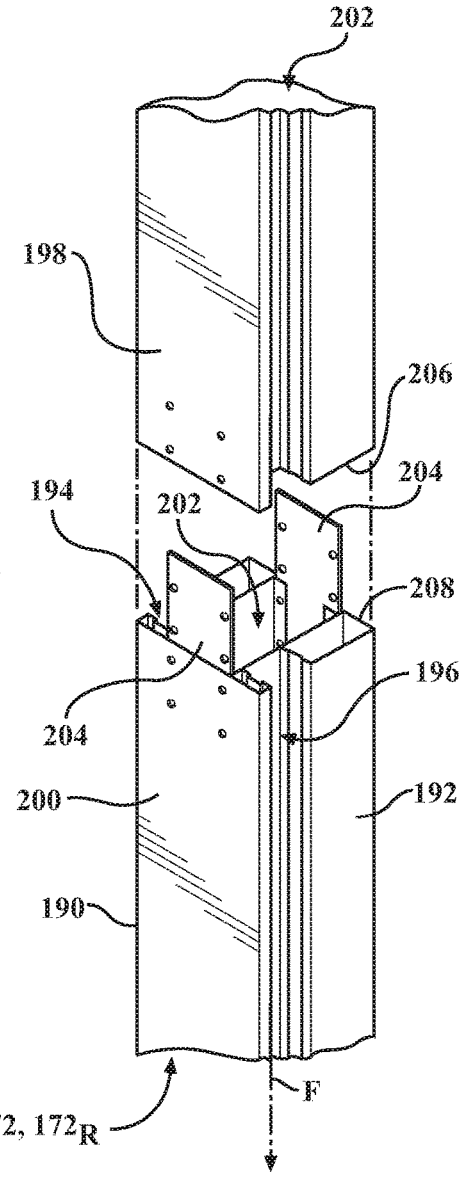
FIG. 19 is an enlarged, partially exploded view of a portion of a panel frame for a rear wall of the building assembly.

The configuration of the panel frame $\mathbf{172}_R$ of the rear wall $\mathbf{16}_R$ is described with reference to FIGS. 16, 17, and 19. The panel frame $\mathbf{172}_R$ of the rear wall $\mathbf{16}_R$ defines a longitudinal axis F, and has a length $L_{RPF}$ extending along the longitudinal axis F. The panel frame $\mathbf{172}_R$ further has first 186 and second 188 ends and opposing first 190 and second 192 sides. The first side 190 defines a first channel 194 extending along the longitudinal axis F, and the second side 192 defines a second channel 196 also extending along the longitudinal axis F. The first channel 194 receives the first segment end 168 of each of the panels 84 of the first section of panels 164 of the rear wall $\mathbf{16}_R$, and the second channel 184 receives the second segment end 170 of each of the panels 84 of the second section of panels 166 of the rear wall $\mathbf{16}_R$.

In an embodiment, each of the panel frames $\mathbf{172}_{S1}$, $\mathbf{172}_{S2}$, $\mathbf{172}_R$ has first 198 and second 200 frame segments each defining a slot 202. Additionally, one of first 198 and second 200 frame segments of the panel frame $\mathbf{172}_{S1}$, $\mathbf{172}_{S2}$, $\mathbf{172}_R$ has a tab 204. The tab 204 of the one of the first 198 and second 200 frame segments is disposed within the slot 202 of the other one of the first 198 and second 200 frame segments to interconnect said first 198 and second 200 frame segments to form the panel frame $\mathbf{172}_{S1}$, $\mathbf{172}_{S2}$, $\mathbf{172}_R$. In an embodiment, the one of the first 198 and second 200 frame segments has two tabs 204. It should be appreciated that the one of the first 198 and second 200 frame segments may any number of tabs 204.

The first frame segment 198 has the first end 186 of the panel frame 172 and a first segment end 206, and the second frame segment 200 has the second end 186 of the panel frame 172 and a second segment end 208. In the embodiment shown, the tab 204 extends from the second segment end 208 of the second frame segment 200 along the longitudinal axis F. The tab 204 may be secured to the second frame segment 200 about the second segment end 208 in any suitable fashion, such as with one or more fasteners. The tab 204 extends from the second segment end 208 of the second frame segment 200 and into the slot 202 of the first frame segment 198. The tab 204 may be secured to the first frame segment 198 in any suitable fashion, such as with one or more fasteners.

The configuration of the panel frame $\mathbf{172}_F$ of the front wall $\mathbf{16}_F$ is described with reference to FIGS. 16 and 17. The panel frame $\mathbf{172}_F$ has an upper side 210, a lower side 212 opposite the upper side 210, a first side 214, and a second side 216 opposite the first side 214. The upper 210, lower 212, first 214, and second 216 sides are interconnected to define the opening 218 for providing access to the inside of the building assembly 10. This panel frame $\mathbf{172}_F$ may be further defined herein as a door frame. The upper side 210 of the panel frame $\mathbf{172}_F$ defines a first channel 220, the lower (or bottom) side 212 of the panel frame $\mathbf{172}_F$ defines a second channel 222, the first side 214 of the panel frame $\mathbf{172}_F$ defines a third channel 224, and the second side 216 of the panel frame $\mathbf{172}_F$ defines a fourth channel 226. In an embodiment, the building assembly includes a bracket 209 coupled to the upper side 210 of the panel frame $\mathbf{172}_F$, and the building assembly 10 includes a window frame 298 configured to mate with the bracket to secure the window frame 298 to the panel frame $\mathbf{172}_F$. In another embodiment, the first channel 220 of the upper side 210 could receive a tongue of the window frame 298 to at least partially support the window frame 298. Further details of the window frame 298 are described below. Additionally, the second channel 222 of the lower side 212 receives the tongue 46 of the front floor panel $\mathbf{22}_F$ such that the panel frame $\mathbf{172}_F$ is supported by the floor frame 12. The third channel 224 of the first side 214 receives the first segment end 168 of each of the panels 84 of the first section of panels 164 of the front wall $\mathbf{16}_F$ and the fourth channel 226 of the second side 216 receives the second segment end 170 of each of the panels 84 of the second section of panels 166 of the front wall $\mathbf{16}_F$ to interconnect the first 164 and second 166 sections of panels of the front wall $\mathbf{16}_F$. The panels 84 could rest within the channels 224, 226, or could be secured to the panel frame $\mathbf{172}_F$ with one or more fasteners.

In an embodiment, and as best shown in FIG. 1, the building assembly 10 includes a door 230 coupled to at least one of the plurality of walls 16. As previously mentioned, the panel frame (or door frame) $\mathbf{172}_F$ defines the opening 218. The door 230 is coupled to the panel frame $\mathbf{172}_F$ and movable between an open position in which the door 230 is spaced from the opening 218 and a closed position in which the door 230 covers the opening 218. The door 230 in the closed position is shown in FIG. 1. In an embodiment, the building assembly 10 could include a plurality of doors 230 coupled to the same or different walls 16. For example, the building assembly 10 could have two doors 230 (as illustrated in FIG. 1) coupled to the panel frame $\mathbf{172}_F$ and both movable (such as in opposite directions) between the open and closed positions. The door 230 may be formed from any suitable material, including hard materials, soft materials, transparent materials, opaque materials, etc. Additionally, the door 230 may have any suitable configuration. In another embodiment, the building assembly 10 does not include door and the opening 218 remains open for access to the inside of the building assembly 10.

Figure 20:
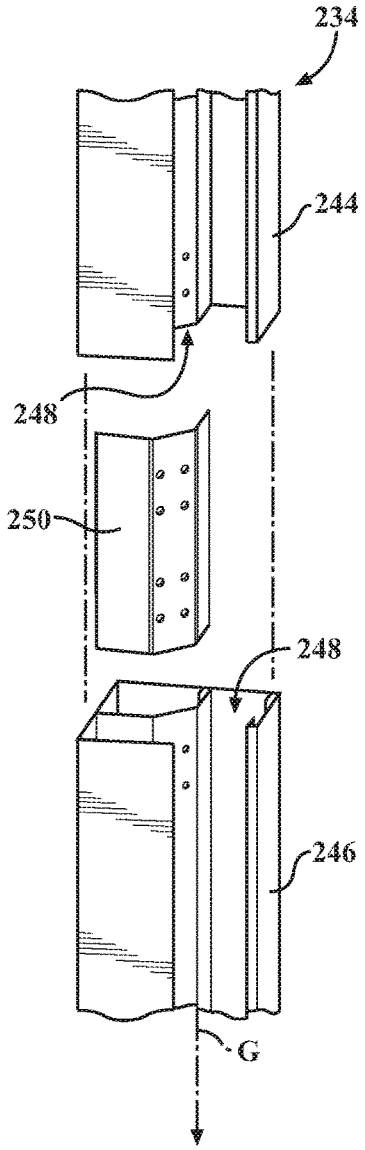
FIG. 20 is an enlarged, partially exploded view of a portion of one of the posts for the building assembly.

As the first 144 and second 146 panels of the plurality of walls 16 are interconnected at a position inward from the ends 86, 88, the interconnected panels 144, 146 form a space 232 defined between respective portions of the first 144 and second 146 panels extending outwardly from the interlocking joint 148. This is shown, for example, in FIG. 16. Referring to FIGS. 16, 17, and 20, the building assembly 10 includes a post 234 extending between the floor frame 12 and the roof 14 enclosing the space 232 defined by the respective portions of the first 144 and second 146 panels extending outwardly from the interlocking joint 148. The post 232 defines a corner 236 of the exterior 20 of the building assembly 10.

In the illustrated embodiment, the building assembly has a quadrilateral configuration and includes four posts 234, with one of the posts 234 defining one of four corners of the building assembly 10. Accordingly, one of the posts 234 encloses a space 232 defined by the respective portions of the first 144 and second 146 panels extending outwardly from the interlocking joint 148 to define the corner 236. This corner 236 is referred to herein as a first corner 236. Another one of the posts 234 encloses a space 232 defined by respective portions of the second 146 and third 154 panels extending outwardly from the second interlocking joint 156 to define a second corner 238. Another one of the posts 234 encloses a space 232 defined by respective portions of the third 154 and fourth 158 panels extending outwardly from the third interlocking joint 160 to define a third corner 240. Additionally, another one of the posts 234 encloses a space 232 defined by respective portions of the fourth 158 and first 144 panels extending outwardly from the fourth interlocking joint 162 to define a fourth corner 242.

In an embodiment, the post 234 has first 244 and second 246 post segments. Each of the first 244 and second 246 post segments defines a longitudinal axis G, and has a length $L_{POST}$ extending along the longitudinal axis G. The lengths $L_{POST}$ of the segments 244, 246 may be the same or different. Additionally, each of the first 244 and second 246 post segments defines a slot 248, and one of the first 244 and second 246 post segments has a tab 250. The tab 250 of the one of the first 244 and second 246 post segments is disposed within the slot 248 of the other one of the first 244 and second 246 post segments to interconnect said first 244 and second 246 post segments to form the post 234. In an embodiment, the one of the first 244 and second 246 post segments has a single tab 250. Alternatively, the one of the first 244 and second 246 post segments could have any number of tabs 250. The tab 250 may be secured to each of the first 244 and second 246 post segments in any suitable fashion, such as with one or more fasteners.

In certain embodiments, the posts 234 may operate to cover the space 232 defined between adjacent panels 84 to form the corners 236, 238, 240, 242 of the building assembly 10. In this respect, the posts 234 contribute to the ornamentality of the building assembly 10. In other embodiments, the panels 84 of adjacent walls 16 could be secured to the respective post 234, such as with one or more fasteners, and/or the roof 14 may be coupled to the posts 234 such that the posts 234 also operate as a structural feature of the building assembly 10. In these embodiments, and the posts 234 become part of a skeleton 400 of the building assembly 10. Further details of the skeleton 40 are described below.

Details of the roof 14 and how the roof 14 is interconnected to the walls 16 and the floor frame 12 of the building assembly 10 are described below with reference to FIGS. 21-30. The roof 14 has a plurality of roof beams 266 coupled to the plurality of panels 84 of each of the plurality of walls 16. Each roof beam 266 has a roof panel 268 and a roof bracket 270 coupled to the roof panel 268. The roof bracket 270 has a C-shaped configuration defining a channel 272. The roof panel 268 has opposing top 274 and bottom 276 surfaces. The roof bracket 270 is disposed on the roof panel 268 with the top surface 274 of the roof panel 268 received within the channel 272 of the roof bracket 270. The bottom surface 276 of the roof panel 268 defines a groove 278. The tongue 118 of the upper-most panel 84 of the wall 16 is received within the groove 278 of the roof panel 268 to couple the roof panel 268 to the upper-most panel 84 of the wall 16.

In an embodiment, building assembly 10 has a first side roof beam $266_{S1}$, a second side roof beam $266_{S2}$, and a rear roof beam $266_R$. The first side roof beam $266_{S1}$ is coupled to the upper-most panel 84 of the first section of panels 164 of the first side wall $16_{S1}$. The second side roof bream $266_{S2}$ is coupled to the upper-most panel 84 of the second section panels 166 of the second side wall $16_{S2}$. The roof panel 268 of each of the first $266_{S1}$ and second $266_{S2}$ side roof beams defines a longitudinal axis H, and has first 280 and second 282 ends and an upper notch 284 spaced inwardly along the longitudinal axis H from the first end 280. The roof bracket 270 is shorter in length than the roof panel 268 of each of the first $266_{S1}$ and second $266_{S2}$ side roof beams and is positioned adjacent the second end 282 such that the roof bracket 270 does not cover the upper notch 284.

Figure 21:
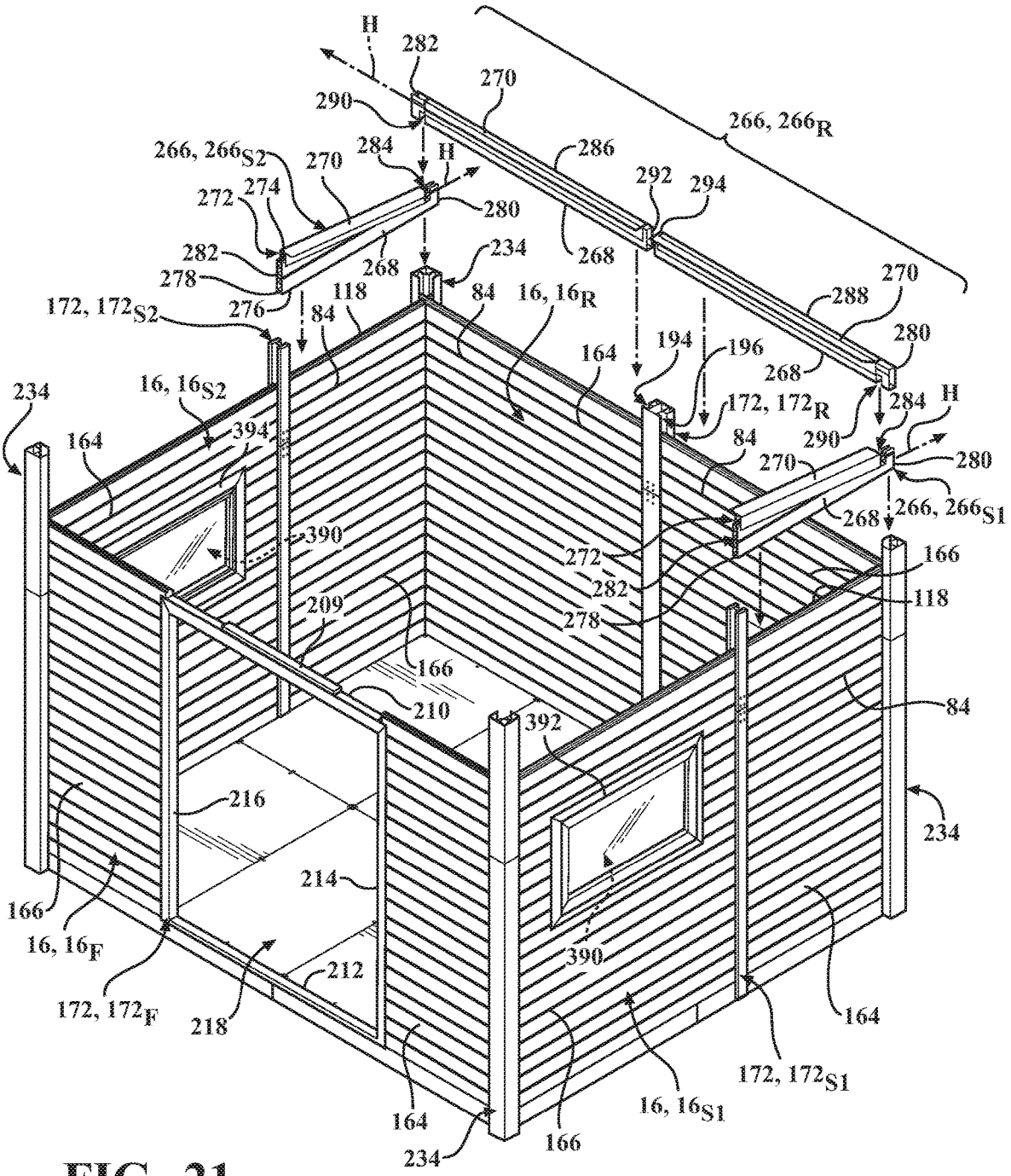
FIG. 21 is a partially exploded, perspective view of the building assembly including the floor frame, the plurality of walls, the plurality of panel frames, the plurality of posts, and a plurality of roof beams.

The rear roof beam $266_R$ is coupled to the upper-most panel 84 of both the first 164 and second 166 sections of panels of the rear wall $16_R$. For example, and as best shown in FIG. 21, the rear roof beam $266_R$ has first 286 and second 288 roof beam segments, with the first roof beam segment 286 coupled to the first section of panels 164 of the rear wall $16_R$ and the second roof beam segment 288 coupled to the second section of panels 166 of the rear wall $16_R$. The first roof beam segment 286 has a lower notch 290 spaced inwardly from the second end 282 of the roof panel 268, and the second roof beam segment has a lower notch 290 spaced inwardly from the first end 280 of the roof panel 268.

The first roof beam segment 286 has the second end 282 and a first segment end 292, and the second roof beam segment 288 has the first end 280 and a second segment end 294. The first segment end 292 is received within the first channel 194 of the rear panel frame $172_R$, and the second segment end 294 is received within the second channel 196 of the rear panel frame $172_R$. Fasteners may be used to interconnect the rear roof beam $266_R$ with the panel frame $172_R$.

Figure 22:
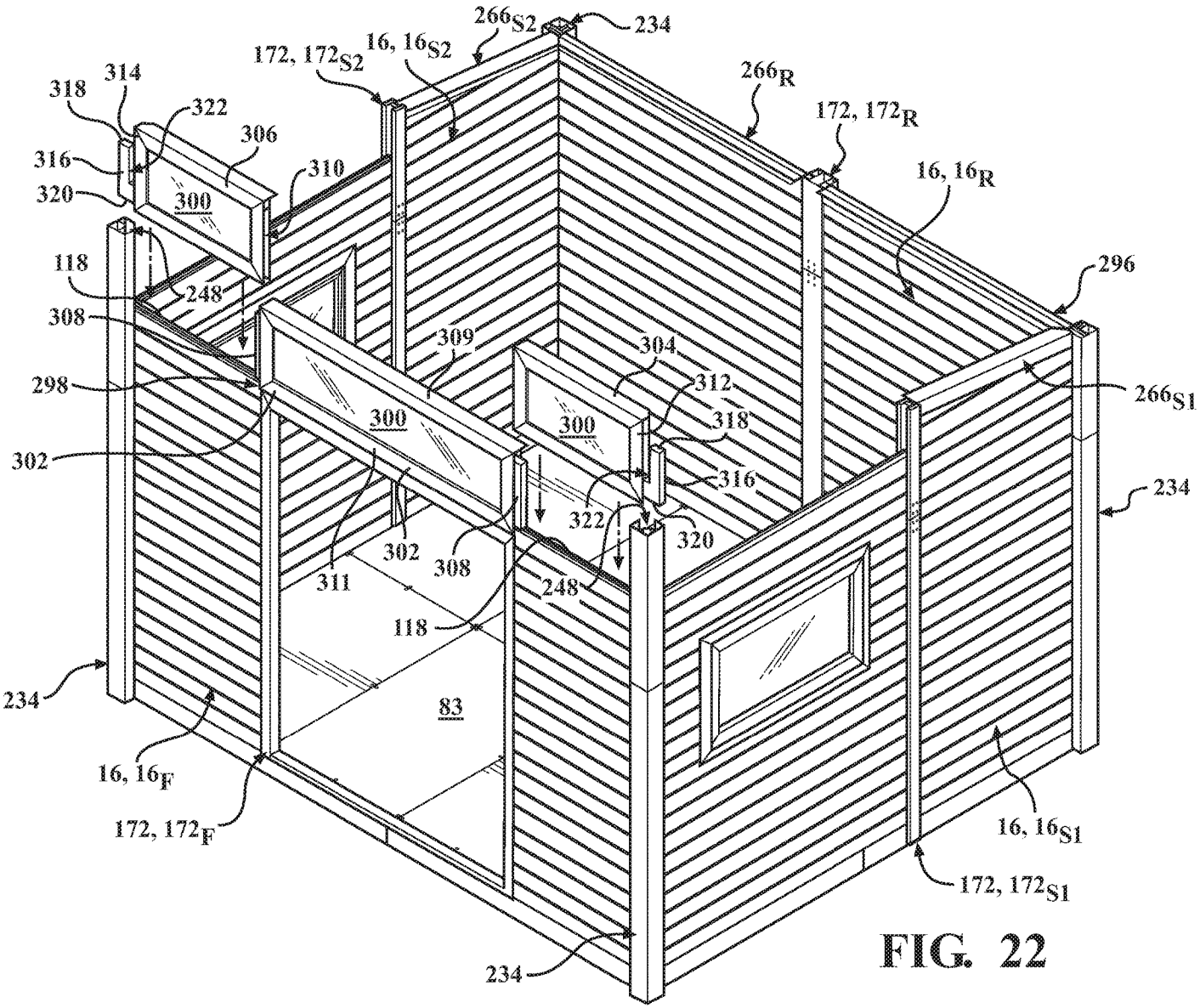
FIG. 22 is a partially exploded, perspective view of the building assembly including the floor frame, the plurality of walls, the plurality of panel frames, the plurality of posts, the plurality of roof beams, and a front window frame.

During assembly, and with reference to FIGS. 21 and 22, the roof beam $266_{S1}$ of the first side wall $16_{S1}$ is coupled to the upper-most panel 84 of the first side wall $16_{S1}$, and the roof beam $266_{S2}$ of the second side wall $16_{S2}$ is coupled to the upper-most panel 84 of the second side wall $16_{S2}$. The rear roof beam $266_R$ is coupled to the upper-most panel 84 of the rear wall $16_R$. In doing so, the lower notch 290 about the first end 280 of the roof panel 268 of the rear roof beam $266_R$ mates with the upper notch 284 of the roof panel 268 of the roof beam $266_{S1}$ of the first side wall $16_{S1}$. The lower notch 290 about the second end 282 of the roof panel 268 of the rear roof beam $266_R$ mates with the upper notch 284 of the roof panel 268 of the roof beam $266_{S2}$ of the second side wall $16_{S2}$. The coupling of the upper 284 and lower 290 notches interconnects the roof beams $266_{S1}$, $266_R$, $266_{S2}$ to partially form a roof frame 296.

In an alternative embodiment, adjacent roof beams $266_{S1}$, $266_R$ could be secured to a respective post 234, and adjacent roof beams $266_R$, $266_{S2}$ could be secured to a respective post 234. The roof beams $266_{S1}$, $266_R$, $266_{S2}$ may be secured to the posts 234 by any suitable means, such as with one or more fasteners. Additionally, the roof beam $266_{S1}$ may be secured to the panel frame $172_{S1}$ of the first side wall $16_{S1}$, and the roof beam $266_{S2}$ may be secured to the panel frame $172_{S2}$ of the second side wall $16_{S2}$. The roof beams $266_{S1}$, $266_{S2}$ may be secured to the respective panel frames $172_{S1}$, $172_{S2}$ by any suitable means, such as with one or more fasteners. As mentioned above, the roof beam segments 292, 294 of the roof beam $266_R$ are secured to the panel frame $172_R$. In this alternative embodiment, the roof beams $266_{S1}$, $266_R$, $266_{S2}$, the posts 234, and the panel frames $172_{S1}$, $172_R$, $172_{S2}$ form part of the skeleton 400 of the building assembly 10.

Figure 23:
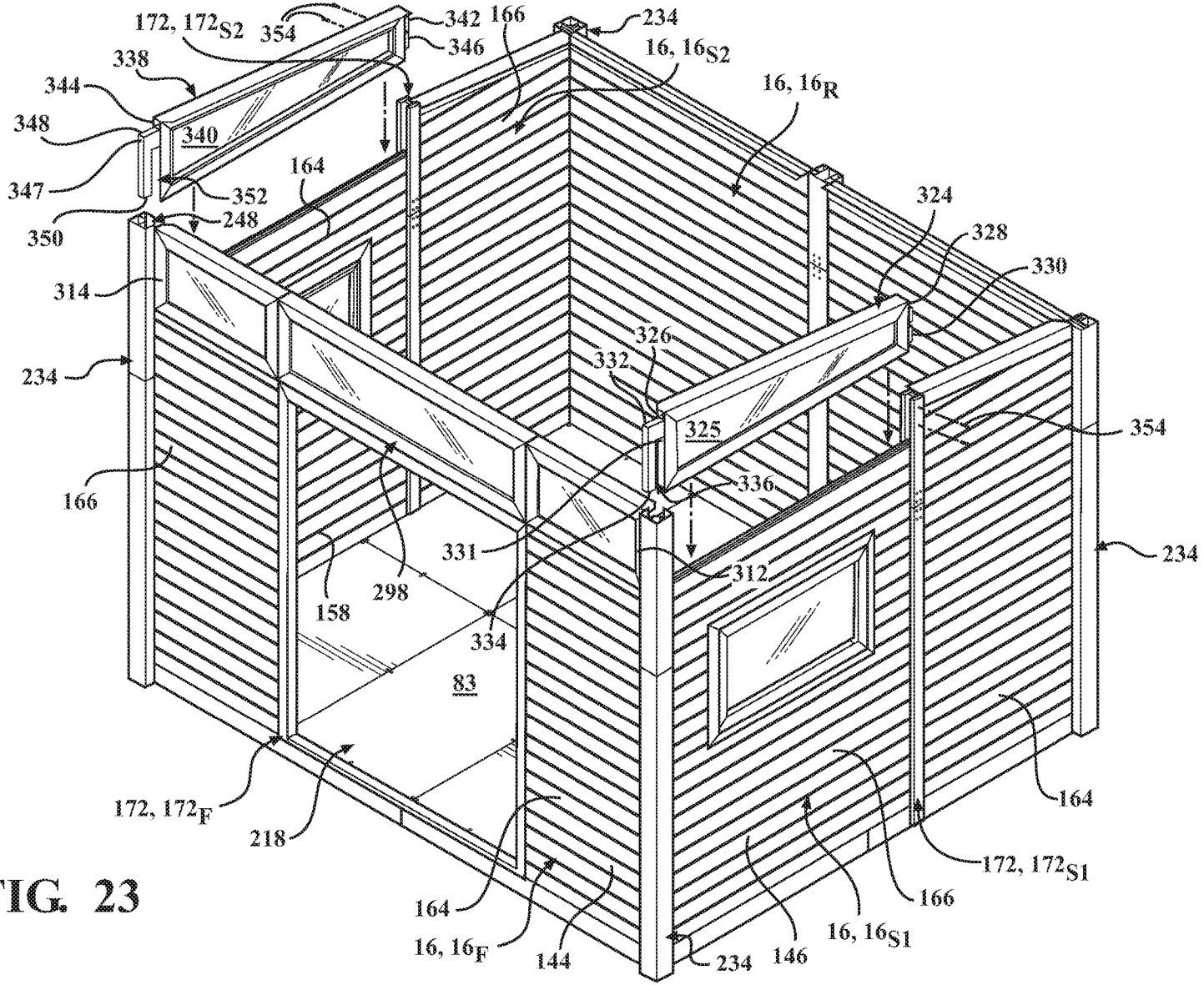
FIG. 23 is a partially exploded, perspective view of the building assembly including the floor frame, the plurality of walls, the plurality of panel frames, the plurality of posts, the plurality of roof beams, the front window frame, and a plurality of side window frames.
Figure 31:
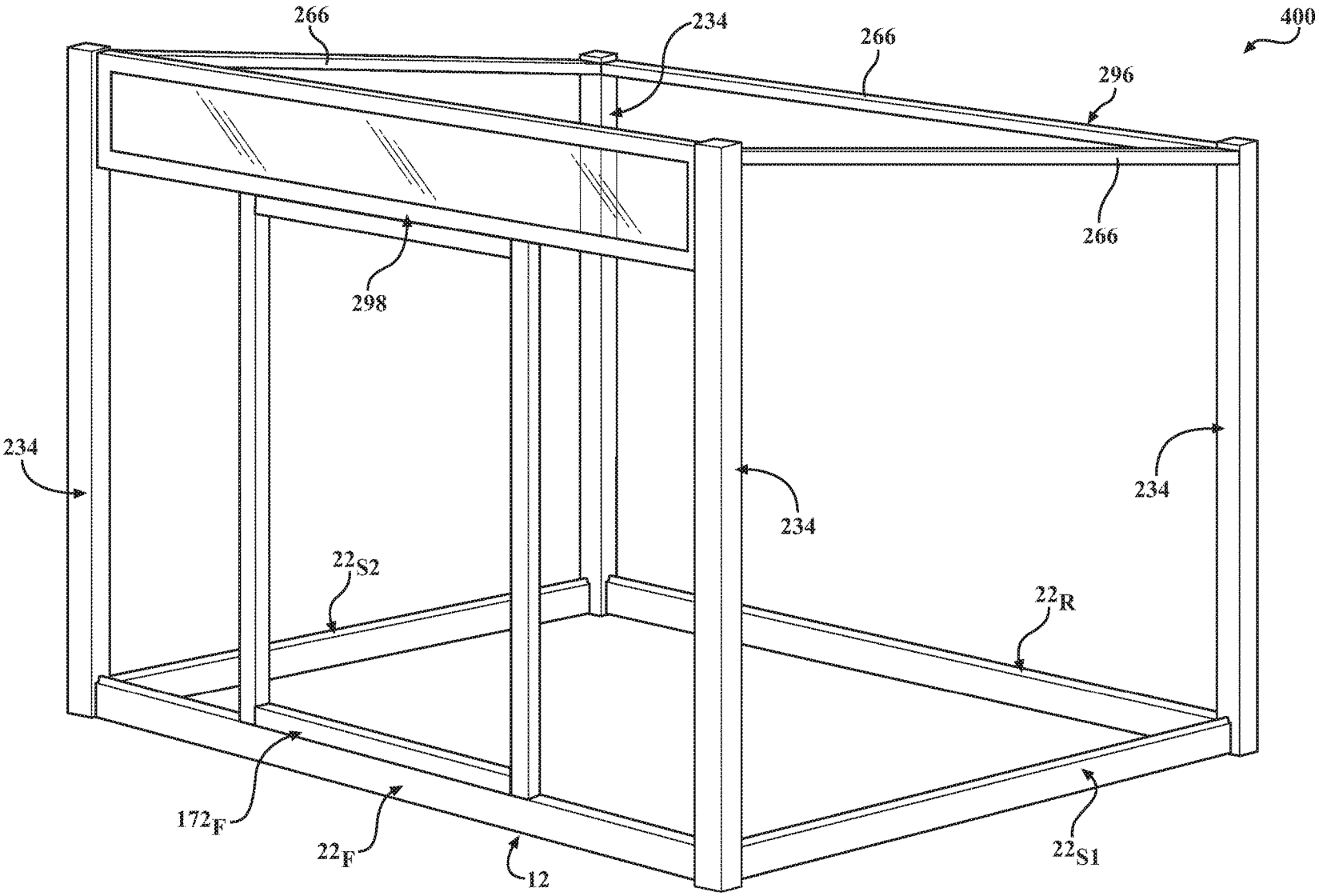
FIG. 31 is a perspective view of a skeleton of the building assembly according to another embodiment of the present disclosure.

With reference to FIGS. 22 and 23, the front wall $16_F$ is formed from the plurality of first panels 144 and further includes the front window frame 298 supported by the plurality of first panels 144. The front window frame 298 supports at least one window pane 300. In an embodiment, the front window frame 298 is a single piece supporting a single window pane 300, such as shown in FIG. 31. In another embodiment, the front window frame 298 has multiple pieces supporting a plurality of window panes 300, such as shown at least in FIGS. 22 and 23. For example, as shown in FIG. 22, the front window frame 298 has first 302, second 304, and third 306 frame members. The first frame member 302 is sandwiched between the second 304 and third 306 frame members, and the frame members 302, 304, 306 are interconnected. For example, the first frame member 302 includes brackets 308 extending from opposing sides, and each of the second 304 and third 306 frame members defines a channel 310 for receiving the brackets 308. The brackets 308 may be secured to the frame members 304, 306 by any suitable means, such as with fasteners, to secure the side frame members 304, 306 to the first frame member 302.

As show in FIG. 22, the front window frame 298 has top 309 and bottom 311 segments, first 312 and second 314 side segments, and a front window bracket 316 extending from at least one of the first 312 and second 314 side segments. In the illustrated embodiment, a front window bracket 316 extends from each of the first 312 and second 314 side segments. The front window bracket 316 has upper 318 and lower 320 surfaces and a slot 322 defined through the upper surface 318.

During assembly, the first frame member 302 of the front window frame 298 is coupled to the panel frame (door frame) $\mathbf{172}_F$ of the front wall $\mathbf{16}_F$, as shown in FIG. 22. In an embodiment, the bottom segment 311 of the front window frame 298 defines a channel configured to receive the bracket 209 coupled to the upper side 210 of the panel frame $\mathbf{172}_F$, to secure the window frame 298 to the panel frame $\mathbf{172}_F$. Alternatively, the bottom segment 311 of the front window frame 298 could include a tongue configured to mate with the first channel 220 of the upper side 210 of the panel frame $\mathbf{172}_F$. Then, the second 304 and third 306 frame members are coupled to opposite sides of the first frame member 302 (via the bracket/channel mechanism described above). The front window brackets 316 extending from the first 312 and second 314 side segments are disposed within the slot 248 of the respective posts 234. Additionally, the panel frame $\mathbf{172}_F$ and the plurality of panels 84 of the front wall $\mathbf{16}_F$ supports the front window frame 298.

Figure 23A:
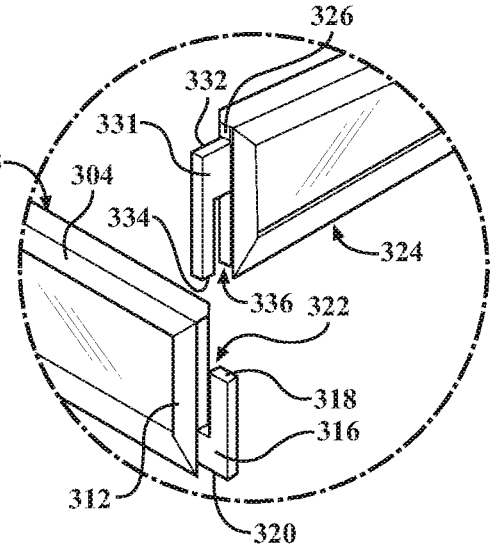
FIG. 23A is an enlarged exploded view of adjacent front and side window frames.

Turning to FIGS. 23 and 23A, the first side wall $\mathbf{16}_{S1}$ adjacent the front wall $\mathbf{16}_F$ is formed from the plurality of second panels 146 and includes a side window frame 324 supported by the plurality of second panels 146. The side window frame 324 supports a window pane 325. The side window frame 324 has first 326 and second 328 side segments, a first window bracket 330 extending from the first side segment 326, and a second window bracket 331 extending from the second side segment 328. The first window bracket 330 is received within the channel 184 of the panel frame $\mathbf{172}_{S1}$. In an embodiment, the first window bracket 330 is secured to the panel frame $\mathbf{172}_{S1}$ by any suitable means, such as with one or more fasteners 354. The second window bracket 331 has upper 332 and lower 334 surfaces and a slot 336 defined through the lower surface 334.

The first side wall $\mathbf{16}_{S2}$ adjacent the front wall $\mathbf{16}_F$ is formed from the plurality of fourth panels 158 and includes a side window frame 338 supported by the plurality of fourth panels 158. The side window frame supports a window pane 340. The side window frame 338 has first 342 and second 344 side segments, a first window bracket 346 extending from the first side segment 342, and a second window bracket 347 extending from the second side segment. The first window bracket 346 is received within the channel 182 of the panel frame $\mathbf{172}_{S2}$. In an embodiment, the first window bracket 346 is secured to the panel frame $\mathbf{172}_{S2}$ by any suitable means, such as with one or more fasteners 354. The second window bracket 347 has upper 348 and lower 350 surfaces and a slot 352 defined through the lower surface 350.

During assembly, the side window frame 324 is coupled to the upper-most panel 84 of the plurality of second panels 146 of the first side wall $\mathbf{16}_{S1}$. At the same time, the slot 336 of the bracket 331 extending from the second side segment 326 mates with the slot 322 of the first window frame segment 312 of the front window frame 298 to interconnect the front 298 and side 324 window frames. Similarly, the side window frame 338 is coupled to the upper-most panel 84 of the plurality of fourth panels 158 of the second side wall $\mathbf{16}_{S2}$. At the same time, the slot 352 of the bracket 347 extending from the second side segment 344 of the side window frame 338 mates with the slot 322 of the second window frame segment 314 of the front window frame 298 to interconnect the front 298 and side 338 window frames.

Figure 24:
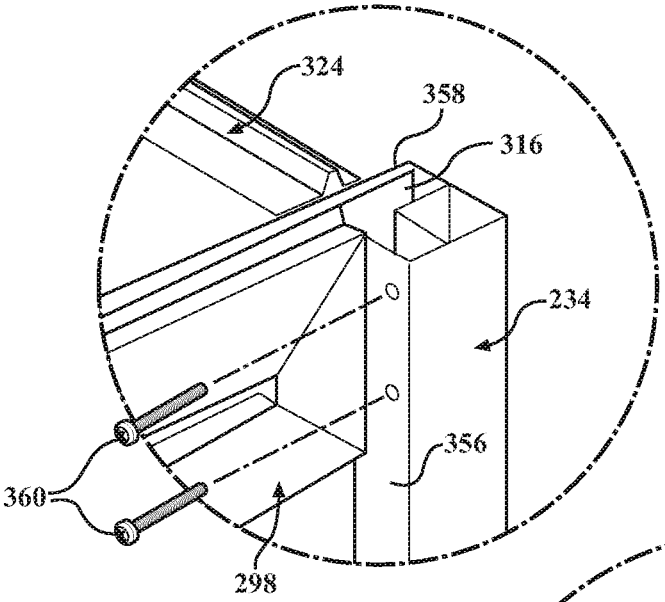
FIG. 24 is an enlarged, perspective view of a portion of the post interconnected to adjacent front and side window frames.

In certain embodiments, and with reference to FIG. 24, the post 234 extending between the floor frame 12 and the roof 14 adjacent the front $\mathbf{16}_F$ and first side $\mathbf{16}_{S1}$ walls further has first 356 and second 358 post sides arranged adjacent one another. When the brackets 316, 331 are coupled, the front window bracket 316 is positioned adjacent the second post side 358 and the side window bracket 331 is positioned adjacent the first post side 356. Fasteners 360 may be used to secure the front window bracket 316 to the second post side 358 and fasteners may be used to secure the side window bracket 331 to the first post side 356 to interconnect the front window frame 298, the side window frame 324, and the post 234. It is to be appreciated that the front window frame 298 and the side window frame 338 may be secured to the post 234 extending between the front wall $\mathbf{16}_F$ and the second side wall $\mathbf{16}_{S2}$ in the same fashion to interconnect the front window frame 298, the side window frame 338, and the post 234. The front window frame 298, the side window frames 324, 338, and the posts 234, in this embodiment, form part of the skeleton 400 of the building assembly.

Figure 25:
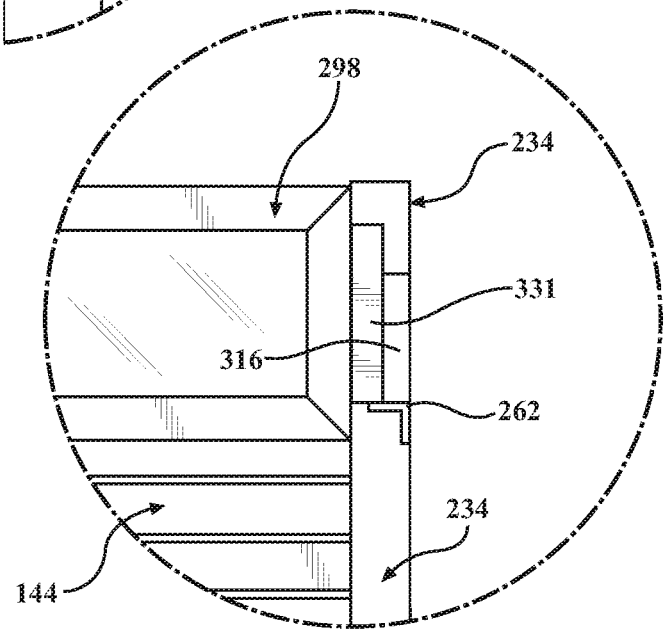
FIG. 25 is a semi-schematic, enlarged view of a portion of the post interconnected to adjacent front and first side walls of the building assembly with the post including a shelf.

In another embodiment, and as shown in FIG. 25, the post 234 extending between the floor frame 12 and the roof 14 adjacent the front $\mathbf{16}_F$ and first side $\mathbf{16}_{S1}$ walls has a shelf 362. The shelf 322 is disposed within the slot 248 and secured to the post 234. For example, the shelf 362 may be integral with the post 234, or may be secured to the post 234 with one or more fasteners. The shelf 362 is located below the coupled brackets 316, 331 of the window frames 298, 324 and is configured to separate the front 298 and side 324 window frames from the plurality of panels 84. In an embodiment, the lower surface of the front window bracket 316 and the lower surface of the side window bracket 331 are spaced from the shelf 362. In an alternative embodiment, the lower surface of the front window bracket 316 and the lower surface of the side window bracket 331 could be seated against the shelf 362. In an embodiment, the post 234 adjacent the front $\mathbf{16}_F$ and second side $\mathbf{16}_{S2}$ walls also includes a shelf 362. A further description of the shelf 362 is set forth below in connection with FIG. 31.

Figure 26:
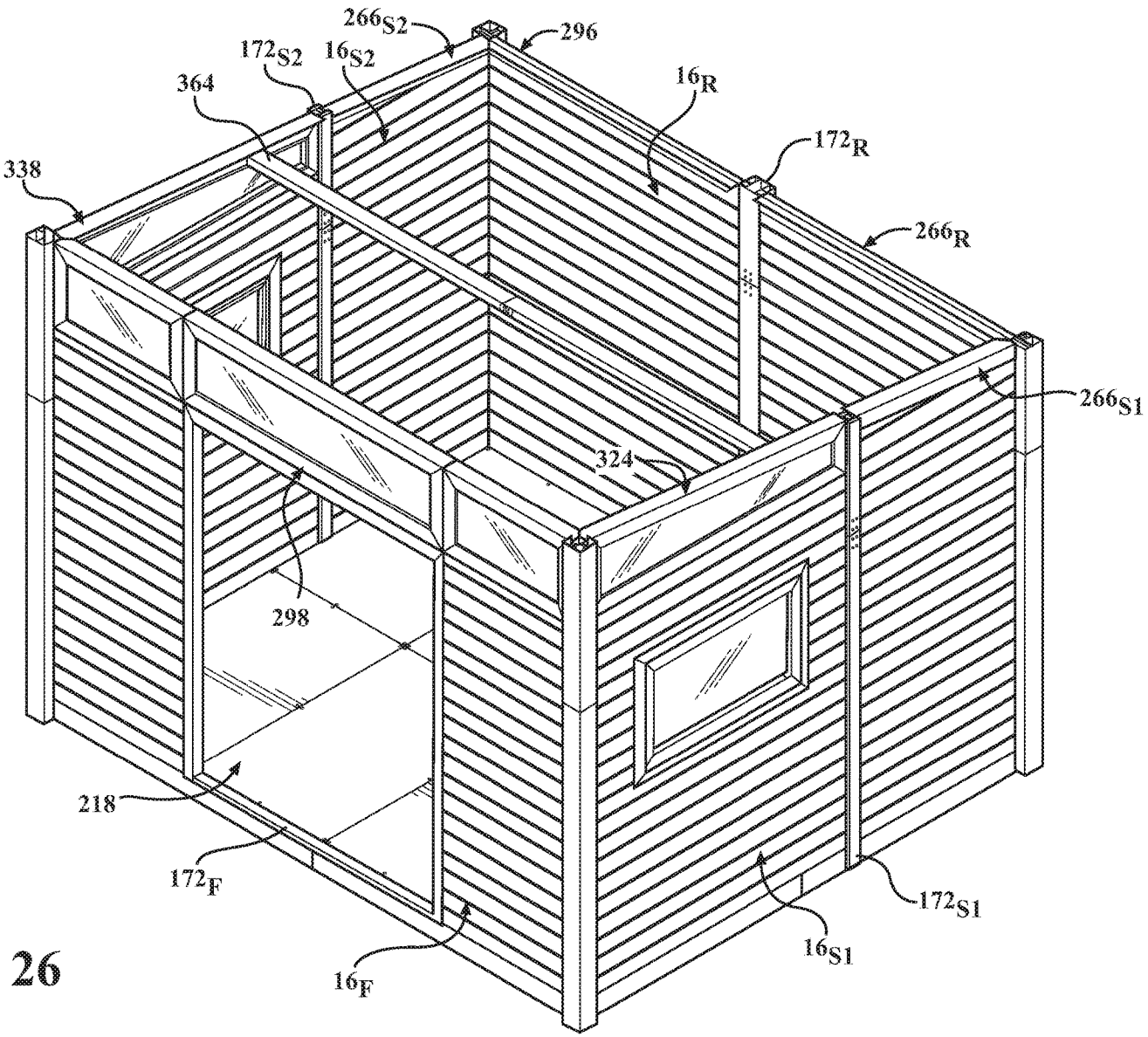
FIG. 26 is a perspective view of the building assembly including the floor frame, the plurality of walls, the plurality of panel frames, the plurality of posts, the plurality of roof beams, the front window frame, the plurality of side window frames, and a roof joist.
Figure 27:
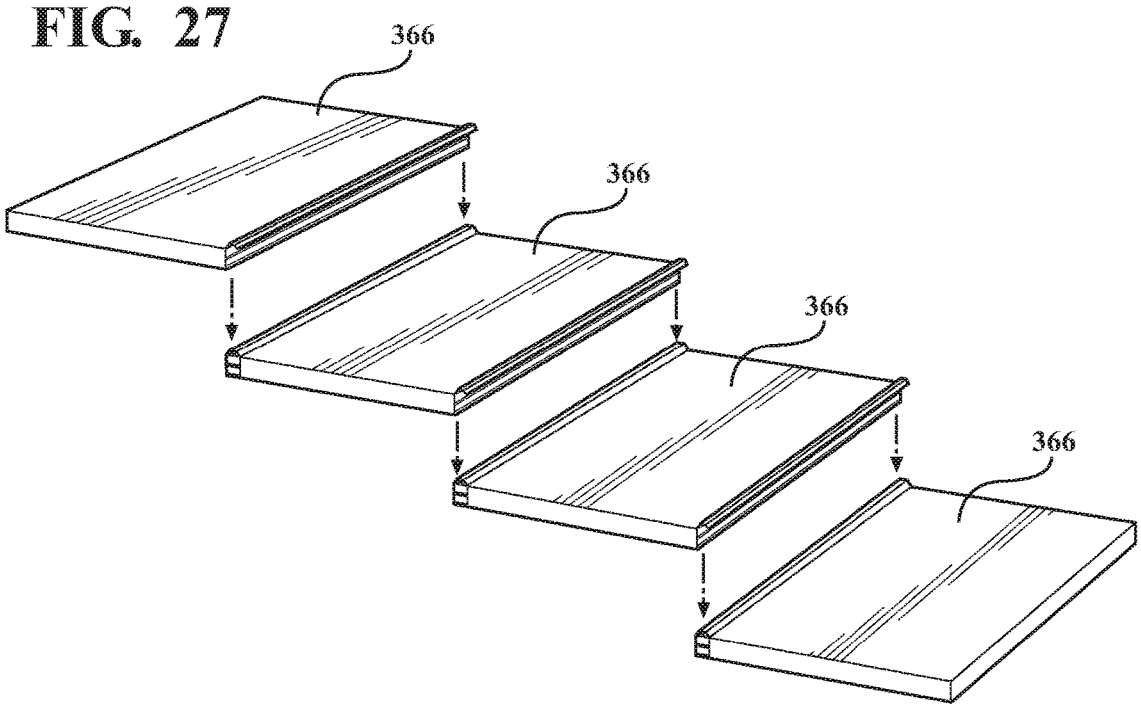
FIG. 27 is an exploded, perspective view of a plurality of roof boards interconnected to one another.
Figure 28:
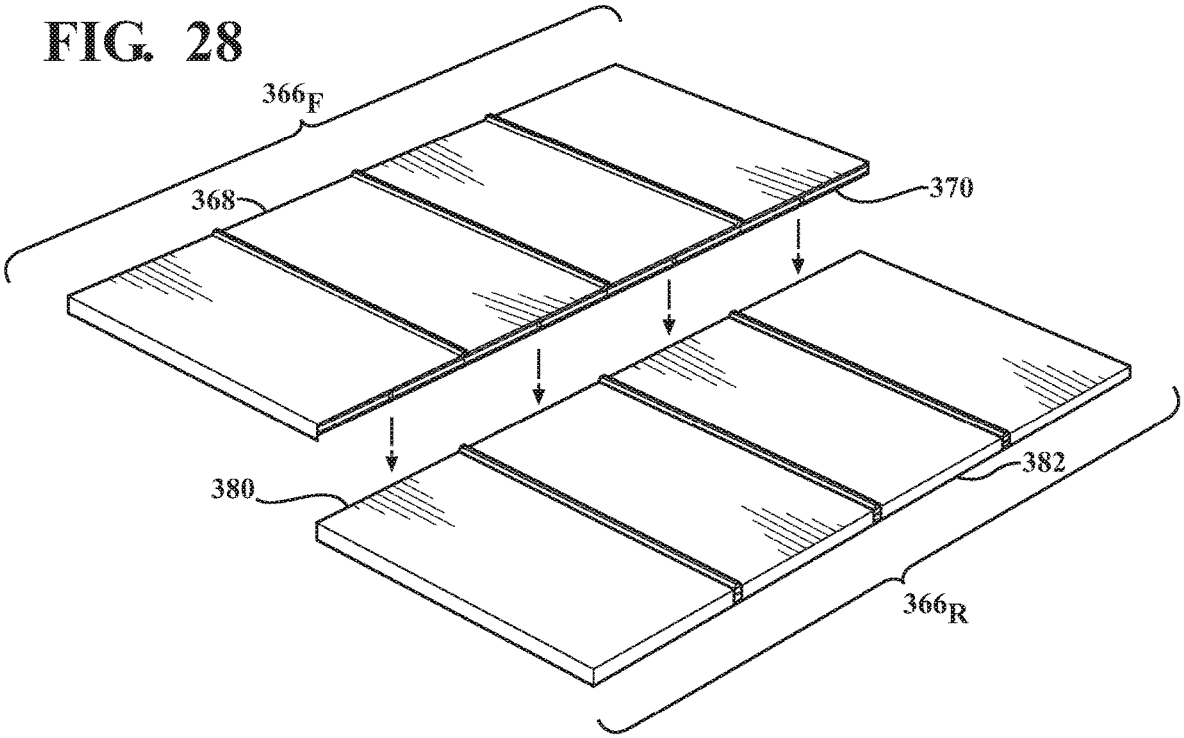
FIG. 28 is an exploded, perspective view of a plurality of front roof boards interconnected to a plurality of rear roof boards.
Figure 29:
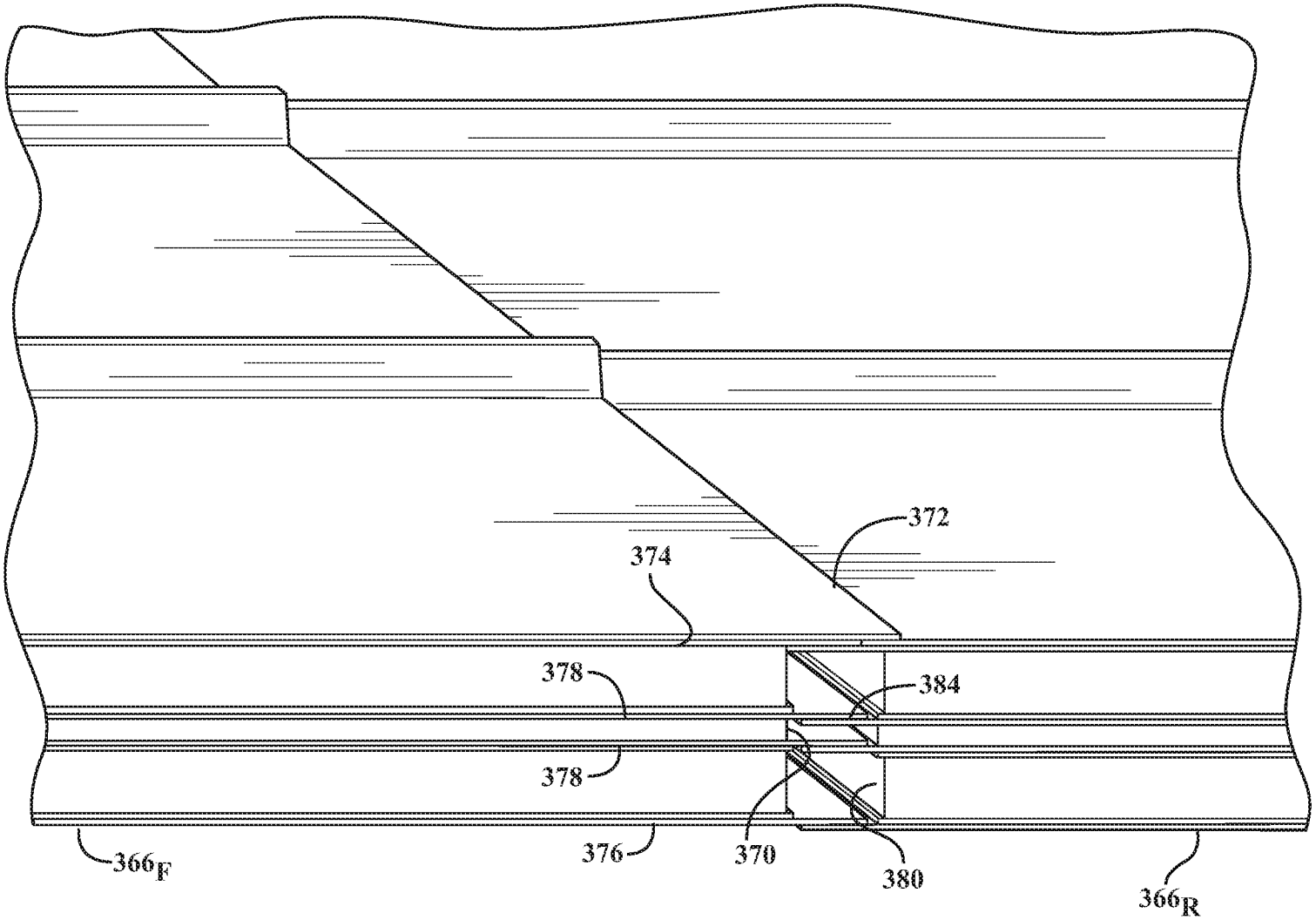
FIG. 29 is an enlarged, perspective view of a portion of the interconnected front and rear roof boards.
Figure 30:
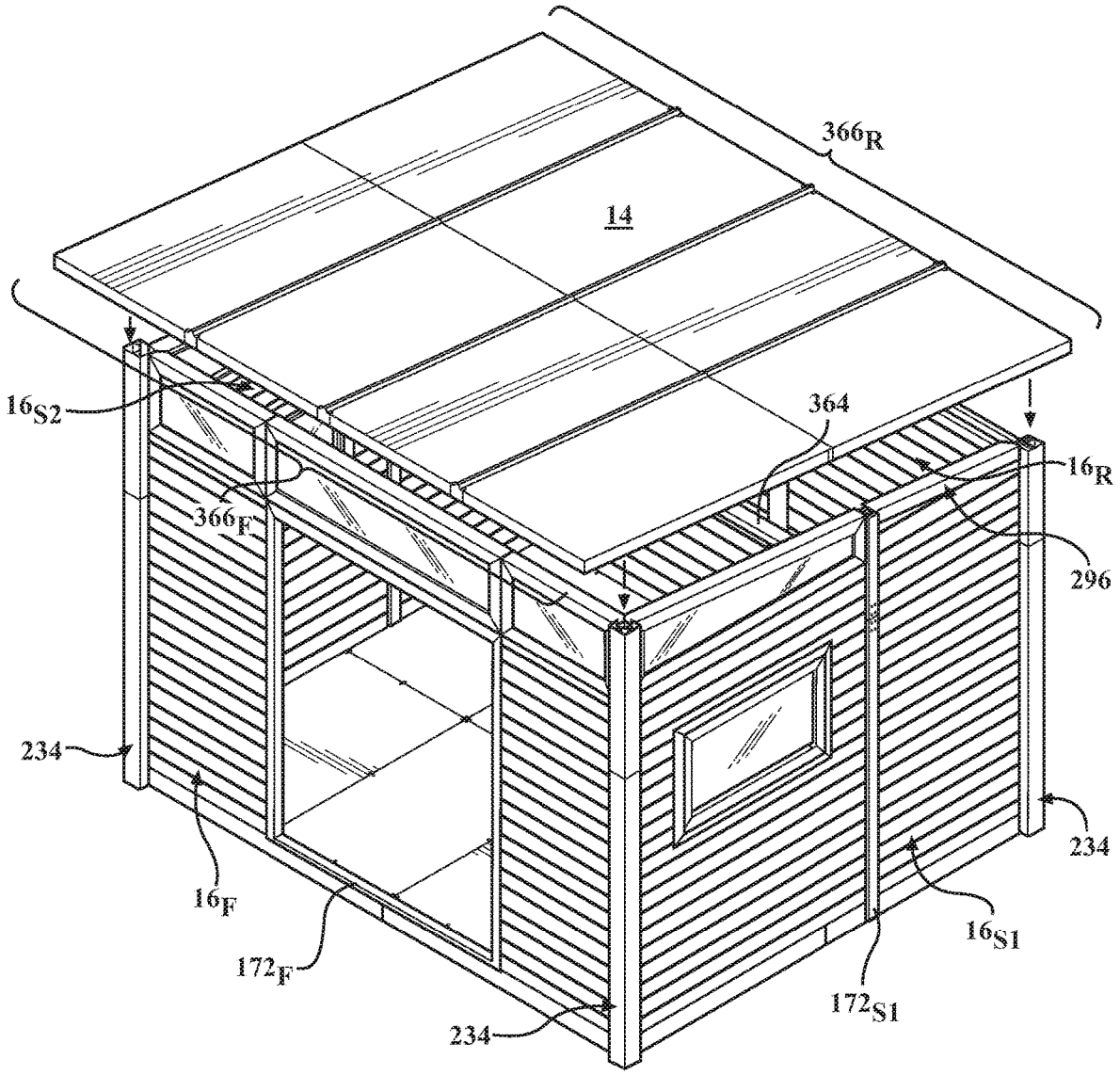
FIG. 30 is an exploded, perspective view of the building assembly including the floor frame, the plurality of walls, the plurality of panel frames, the plurality of posts, the plurality of roof beams, the front window frame, the plurality of side window frames, the roof joint, and the roof board(s).

As previously mentioned, the interconnected roof beams 266 at least partially form the roof frame 296. In an embodiment, the front window frame 298 and the side window frames 324, 338 in combination with the interconnected roof beams 266 at least partially form the roof frame 296. In another embodiment, and as shown in FIG. 26, the roof frame 296 further includes a roof joist 364. The roof joist 364 is coupled to and extends between the panel frames $\mathbf{172}_{S1}$ and $\mathbf{172}_{S2}$ of the first $\mathbf{16}_{S1}$ and second $\mathbf{16}_{S2}$ side walls, and extends substantially parallel to the front $\mathbf{16}_F$ and rear $\mathbf{16}_R$ walls. Alternatively, the roof joist 364 could extend between the front $\mathbf{16}_F$ and rear $\mathbf{16}_R$ walls and substantially parallel to the first $\mathbf{16}_{S1}$ and second $\mathbf{16}_{S2}$ side walls. The roof joist 364 is attached to the panel frames $\mathbf{172}_{S1}$ and $\mathbf{172}_{S2}$ by any suitable means, such as with brackets as described above for attaching the floor joist 62 to the floor panels $\mathbf{22}_{S1}$ and $\mathbf{22}_{S2}$. The roof joist 364 may have the same configuration as the floor joist 62 described in detail above. The roof joist 364 becomes part of the roof frame 296 and serves to add additional support for at least one roof board 366 disposed on and secured to the roof frame 296.

Referring to FIGS. 27-30, the roof 14 of the building assembly 10 further includes the at least one roof board 366 secured to the roof frame 296. In an embodiment, the at least one roof board 366 is secured to at least one of the roof beams 266, the window frames 298, 324, 338, and the roof joist 364 utilizing fasteners or the like. The roof board(s) 366 may be formed from any suitable roofing material, such as hard materials, soft materials, transparent materials, opaque materials, etc. In an embodiment, the roof 14 could also include roof tiles or shingles.

In an embodiment, the at least one roof board 366 is further defined as a plurality of front roof boards $\mathbf{366}_F$ and a plurality of rear roof boards $\mathbf{366}_R$ adjacent the plurality of front roof boards $\mathbf{366}_F$. Each of the front roof boards $\mathbf{366}_F$ has front 368 and back 370 sides. At least the front roof board $\mathbf{366}_F$ has a flange 372 extending from the back side 370 and overlapping a respective one of the plurality of rear roof boards $\mathbf{366}_R$ to form a first seal between the plurality of front roof boards $\mathbf{366}_F$ and the plurality of rear roof boards $\mathbf{366}_F$.

In another embodiment, the plurality of front roof boards $\mathbf{366}_F$ has a plurality of interconnected sheets of material including a top sheet 374, a bottom sheet 376 spaced from the top sheet 374, and at least one middle sheet 378 sandwiched between the top 374 and bottom 376 sheets. Each one of the rear roof boards $\mathbf{366}_R$ has front 380 and back 382 sides and at least one flange 384 extending from the front side 380 of the rear roof panel $\mathbf{366}_R$ and with the at least one middle sheet 378 of the plurality of front roof boards $\mathbf{366}_F$ overlapping the flange 384 of the rear roof board $\mathbf{366}_R$ to form a second seal between the plurality of front roof panels $\mathbf{366}_F$ and the plurality of rear roof boards 3668. It should be appreciated that the front $\mathbf{366}_F$ and rear $\mathbf{366}_R$ roof panels could be reversed, and the rear roof panel $\mathbf{366}_R$ could have a flange overlapping the top sheet of the front roof panel $\mathbf{366}_F$ and the front roof panel $\mathbf{366}_F$ could have a flange with the middle sheet of the rear roof panel $\mathbf{366}_R$ overlapping the flange of the front roof panel $\mathbf{366}_F$. Additionally, the panels $\mathbf{366}_F$, $\mathbf{366}_R$ could be configured such that the flanges overlap the respective sheets, rather than as described above.

Once the front $\mathbf{366}_F$ and rear $\mathbf{366}_R$ roof boards have been interconnected, the roof boards $\mathbf{366}_F$, $\mathbf{366}_R$ are disposed on and secured to the roof frame 296 with, for example, one or more fasteners. Alternatively, the roof boards $\mathbf{366}_F$, $\mathbf{366}_R$ may be interconnected as each roof board $\mathbf{366}_F$, $\mathbf{366}_R$ is disposed on and secured to the roof frame 296.

As previously mentioned, at least one of the plurality of walls 16 defines an opening 218 to provide access to the inside of the building assembly 10. The plurality of walls 16 may also define an additional opening(s) 390 for forming a window of the building assembly 10. As shown in FIG. 21, for example, additional openings 390 are defined by each of the first $\mathbf{16}_{S1}$ and second $\mathbf{16}_{S2}$ side walls. In an embodiment, the building assembly 10 includes a window frame 392 coupled to the plurality of panels 84 of the first side wall $\mathbf{16}_{S1}$, and the window frame 392 defines one of the openings 390. The building assembly 10 further includes another window frame 394 coupled to the plurality of panels 84 of the second side wall $\mathbf{16}_{S2}$, and the window frame 394 defines another one of the openings 390. The window frames 392, 394 may be coupled to the panels 84 in the same fashion as the panel frames 172 described in detail above.

In certain embodiments, the building assembly 10 relies at least on the stacked panels 84 of the plurality of walls 16 for structural support. In other embodiments, the building assembly 10 relies on the floor frame 12, the posts 234, at least one roof beam 266, at least one of the panel frames 172, and at least one of the window frames 298, 324, 338 for structural support. These components in combination form a skeleton 400 of the building assembly 10, such as shown in FIG. 31. For example, the skeleton 400 includes the floor frame 12 having the plurality of interconnected floor panels 22, at least one of the roof beams 266 spaced from the floor frame 12, and the plurality of posts 234 extending between and coupled to the floor frame 12 and the roof beams 234 to interconnect the floor frame 12 and the at least one roof beam 266. The skeleton 400 further includes at least one of the panel frames 172 extending between the floor frame and the at least one roof beam 266 to interconnect the floor frame 12 and the at least one roof beam 266, and at least one window frame 298, 324, 338. FIG. 31 shows the skeleton 400 including the front window frame 298 and roof beams 266 interconnected with the front window frame 298. It should be appreciated that the skeleton 400 could include one or more side window frames, such as the side window frames 324, 338 described above. The roof beam 266 is interconnected to the at least one window frame 298, 324, 338 such that the at least one roof beam 266 and an upper segment of the window frame 298, 324, 338 define at least a portion of the roof frame 296 such that the interconnected roof frame 296, the plurality of posts 234, the panel frame 172, and the floor frame 12 collectively form the skeleton 40 of the building assembly 10.

It should be appreciated that the skeleton 400 is independent of the plurality of panels 84 forming the walls 16 of the building assembly 10. In this way, the panels 84 do not contribute to the structural framework, and the skeleton 400 is solely responsible for the structural integrity of the building assembly 10. The skeleton 400 also provides sufficient clearance between the panels 84 of each wall 16 and the floor 12 and roof 296 frames to allow for expansion and contraction of the panels 84. In an embodiment, at least one of the posts 234 includes the shelf 362 mentioned above. In embodiments where the skeleton 400 includes both side window frames 324, 338, the shelf 362 disposed in the post(s) 234 separates the front 298 and side 324, 338 window frames from the plurality of panels 84 of the walls 16. For example, the shelf 362 serves as a stop for the underlying plurality of panels 84 of adjacent walls 16 to maintain the clearance for the plurality of panels 84 forming the individual walls 16 of the building assembly 10 to allow for the expansion and contraction. By supporting the front 298 and side 324, 338 window frames by the posts 234 (such as by securing the frames 298, 324, 338 to the post 234 with the fasteners 360 described above), the window frames 298, 324, 338, as part of the skeleton 400, remain independent of the underlying panels 84 of the walls 16. This allows the panels 84 to float between the floor frame 12 and the window frames 298, 324, 338. The shelf 362 also serves to prevent the floating panels 84 from pressing against the window frames 298, 324, 338 during expansion of the panels 84.

A method of manufacturing the building assembly 10 is also disclosed. The method includes forming a floor 83. With reference to FIGS. 1-8, the floor 83 is formed by providing the plurality of floor panels 22 each having the first 24 and second 26 ends with the plurality of floor panels 22 including the front floor panel $\mathbf{22}_F$, the rear floor panel $\mathbf{22}_R$, and the first $\mathbf{22}_{S1}$ and second $\mathbf{22}_{S2}$ side floor panels. The method of forming the floor 83 further includes mating the first end 24 of one of the plurality of floor panels 22 with the second end 26 of an adjacent one of the plurality of floor panels 22 to interconnect the plurality of floor panels. Mating of the adjacent floor panels 22 may be accomplished by mating one of the upper 40 and lower 42 notches of the one of the plurality of floor panels 22 with the other one of the upper 40 and lower 42 notches of the adjacent one of the plurality of floor panels 22 as previously described. The method of forming the floor 83 further includes attaching the plurality of joists 62, 66 to at least the front $\mathbf{22}_F$ and rear $\mathbf{22}_F$ floor panels to interconnect at least the front $\mathbf{22}_F$ and rear $\mathbf{22}_R$ floor panels and the plurality of joists 62, 66 to form the floor frame 12, and attaching the plurality of interconnected floor boards 80 to the floor frame 12.

The method of manufacturing the building assembly 10 further includes forming the roof 14 spaced from the floor 83 and forming the plurality of walls 16 extending between the floor 83 and the roof 14. Each of the plurality of walls 16 includes the plurality of panels 84 as described in detail above in connection with FIGS. 9-22. The step of forming the plurality of walls 16 includes mating the tongue 118 of one of the plurality of panels 84 with the groove 120 of an adjacent one of the plurality of walls 16, as shown at least in FIGS. 9 and 13-15. Adjacent panels 84 are stacked utilizing the tongue/groove mechanism to form each of the walls 16.

As described in detail above, each of the plurality of panels 84 has the upper notch 106 and the opposing lower notch 108. The method of manufacturing the building assembly 10 further includes mating the lower notch 108 of a first panel 144 of the plurality of panels 84 with the upper notch 106 of a second panel 146 of the plurality of panels 84 to form the interlocking joint 148 between the first 144 and second 146 panels thereby interconnecting the first 144 and second 146 panels and forming adjacent interconnected walls 16 of the plurality of walls 16. The interconnected walls 16 defines the interior 18 and the exterior 20 of the building assembly 10 with at least one of the walls 16 defining the opening 218.

In an embodiment, the first panel 144 is one of a plurality of first panels 144 each having first 86 and second 88 ends and the second panel 146 is one of a plurality of second panels 146 each having first 86 and second 88 ends. The mating step includes mating the lower notch 108 of each of the plurality of first panels 144 about the first end 86 of the first panel 144 with the upper notch 106 of each of the plurality of second panels 146 about the second end 88 of the second panel 146 to form a plurality of first interlocking joints 148 between the plurality of first panels 144 and the plurality of second panels 146 thereby interconnecting the plurality of first panels 144 and the plurality of second panels 146 forming adjacent front $\mathbf{16}_F$ and first side $\mathbf{16}_{S1}$ walls of the plurality of walls 16.

The plurality of panels 84 further includes the plurality of third panels 154 each having first 86 and second 88 ends, and the method further includes the step of mating the lower notch 108 of each of the plurality of third panels 154 about the second 88 of the third panel 154 with the upper notch 106 of each of the plurality of second panels 146 about the first end 86 of the second panel 146 to form a plurality of second interlocking joints 156 between the plurality of second panels 146 and the plurality of third panels 154 thereby interconnecting the plurality of second panels 146 and the plurality of third panels 154 and partially forming the rear wall $\mathbf{16}_R$ adjacent the first side wall $\mathbf{16}_{S1}$ of the building assembly 10.

The plurality of panels 84 further includes the plurality of fourth panels 158 each having first 86 and second 88 ends, and the method further includes the step of mating the lower notch 108 of each of the plurality of third panels 154 about the first end 86 of the third panel 154 with the upper notch 106 of each of the plurality of fourth panels 158 about the second end 88 of the fourth panel 158 to form a plurality of third interlocking joints 160 between the plurality of third panels 154 and the plurality of fourth panels 158 thereby interconnecting the plurality of third panels 154 and the plurality of fourth panels 158 and partially forming the second side wall $\mathbf{16}_{S2}$ adjacent the rear wall $\mathbf{16}_R$ of the building assembly 10.

The method further includes the step of mating the upper notch 106 of each of the plurality of fourth panels 158 about the first end 86 of the fourth panel 158 with the lower notch 108 of each of the plurality of first panels 144 about the second end 88 of the first panel 144 to form a plurality of fourth interlocking joints 162 between the plurality of first panels 144 and the plurality of fourth panels 158 thereby interconnecting the plurality of first panels 144 and the plurality of fourth panels 158.

The step of forming the plurality of walls 16 further includes providing front $\mathbf{130}_F$ and rear $\mathbf{130}_R$ base panels each having a first panel width $W_{P1}$ and attaching the front $\mathbf{130}_F$ and rear $\mathbf{130}_R$ base panels to the front $\mathbf{22}_F$ and rear $\mathbf{22}_R$ floor panels of the floor frame 12, as described above. The method further includes providing the first $\mathbf{130}_{S1}$ and second $\mathbf{130}_{S2}$ base panels each having a second panel width $W_{P2}$ twice the first panel width $W_{P1}$ of the front $\mathbf{130}_F$ and rear $\mathbf{130}_R$ base panels, and attaching the first $\mathbf{130}_{S1}$ and second $\mathbf{130}_{S2}$ side base panels to the first $\mathbf{22}_{S1}$ and second $\mathbf{22}_{S2}$ side floor panels of the floor frame.

The walls 16 of the building assembly 10 may be further formed by attaching the plurality of first panels 144 to the front base panel $\mathbf{130}_F$ to form a front wall $\mathbf{16}_F$ of the plurality of walls 16, attaching the plurality of second panels 146 to the first side base panel $\mathbf{130}_{S1}$ to form a first side wall $\mathbf{16}_{S1}$ of the plurality of walls 16, attaching the plurality of third panels 154 to the rear base panel $\mathbf{130}_R$ to form a rear wall $\mathbf{16}_R$ of the plurality of walls 16, and attaching the plurality of fourth panels 158 to the second side base panel $\mathbf{130}_{S2}$ to form the second side wall $\mathbf{16}_{S2}$ of the plurality of walls 16.

The roof 14 is formed by attaching at least one roof board 366 to the plurality of panels 84 of the plurality of walls 16 of the building assembly 10.

The embodiments of the building assembly 10 described in detail above provide a simplified construction requiring minimal tools for coupling the various components of the building assembly 10 together. The components are formed from lightweight materials for easier handling by the user at least when constructing the building assembly 10. Additionally, various elongated components of the building assembly 10, such as floor panels 22, floor joist 62, wall panels 84, window frame 298, posts 235, panel frames 172, etc., are provided in two parts, enabling all of the components of the building assembly to be easily packaged into a kit. Alternatively, the building assembly 10 could be constructed with elongated components that are formed from a single piece rather than two. The building assembly 10 is a free-standing structure and may be configured to be as large or as small as desired.

The invention has been described in an illustrative manner, and it is to be understood that the terminology which has been used is intended to be in the nature of words of description rather than of limitation. It is now apparent to those skilled in the art that many modifications and variations of the present invention are possible in light of the above teachings. It is, therefore, to be understood that the invention may be practiced otherwise than as specifically described.

What is claimed is:

1. A building assembly comprising:

a floor frame;

a roof spaced from said floor frame;

a plurality of walls extending between said floor frame and said roof and interconnected to define an interior and an exterior of said building assembly with at least one of said plurality of walls defining an opening and each of said plurality of walls including a plurality of panels with each panel defining a longitudinal axis and each panel having:

first and second ends;

opposing top and bottom surfaces; and an upper notch formed through said top surface and an opposing lower notch formed through said bottom surface with each of said upper and lower notches spaced inwardly along said longitudinal axis from at least one of said first and second ends, wherein said plurality of panels includes first and second panels and said lower notch of said first panel mates with said upper notch of said second panel to form an interlocking joint between said first and second panels to interconnect said first and second panels and form adjacent interconnected walls of said plurality of walls of said building assembly; and a post extending between and coupled to said floor frame and said roof, said post enclosing a space defined by respective portions of said first and second panels extending outwardly from said interlocking joint with said post defining a corner of said exterior of said building assembly, said post further having a slot with said first and second ends of each of said first and second panels extending outwardly from said interlocking joint and received within said slot.

2. The building assembly as set forth in claim 1 wherein said longitudinal axis is further defined as a center axis extending between said first and second ends with said upper notch formed through said top surface and extending toward but terminating prior to said center axis, and said lower notch formed through said bottom surface and extending toward but terminating prior to said center axis.

3. The building assembly as set forth in claim 1 wherein said upper notch has an upper notch depth and said lower notch has a lower notch depth with said upper notch depth the same as said lower notch depth.

4. The building assembly as set forth in claim 1 wherein said upper notch has an upper notch width and said lower notch has a lower notch width with said upper notch width the same as said lower notch width.

5. The building assembly as set forth in claim 1 wherein said upper notch has a first cross-sectional configuration and said lower notch has a second cross-sectional configuration different from said first cross-sectional configuration.

6. The building assembly as set forth in claim 1 wherein each of said plurality of panels has first and second support ribs extending between said first and second ends with said upper notch extending between said top surface and said first support rib and said lower notch extending between said bottom surface and said second support rib.

7. The building assembly as set forth in claim 6 wherein said first support rib is substantially parallel to said top surface and defines a base of said upper notch, and said second support rib is substantially parallel to said bottom surface and defines a base of said lower notch.

8. The building assembly as set forth in claim 1 wherein said top surface of each of said plurality of panels defines a tongue extending outwardly in a direction transverse to said longitudinal axis and said bottom surface of each of said plurality of panels defines a groove extending inwardly in a direction transverse to said longitudinal axis with said tongue of one of said plurality of panels mating with said groove of an adjacent one of said plurality of panels to form one of said plurality of walls.

9. The building assembly as set forth in claim 1 wherein each panel of said plurality of panels further has opposing inner and outer sides and a mounting channel formed in at least one of said inner and outer sides extending along said longitudinal axis for removably securing an accessory to at least one of said interior and said exterior of said building assembly.

10. The building assembly as set forth in claim 9 wherein said mounting channel is further defined as a first mounting channel formed in said inner side extending along said longitudinal axis for removably securing said accessory to said interior of said building assembly and each panel further has a second mounting channel formed in said outer side extending along said longitudinal axis for removably securing another accessory to said exterior of said building assembly.

11. The building assembly as set forth in claim 10 wherein said first and second mounting channels are spaced a same distance from said top surface such that said first mounting channel is opposite said second mounting channel.

12. The building assembly as set forth in claim 10 wherein said first mounting channel has a first channel depth and said second mounting channel has a second channel depth with said first channel depth the same as said second channel depth, and each of said first and second mounting channels has a stem portion and a chamber portion with said chamber portion having a larger cross-sectional area compared to said stem portion.

13. The building assembly as set forth in claim 10 wherein each of said first and second mounting channels has a P-shaped configuration in cross section.

14. The building assembly as set forth in claim 10 further comprising a plurality of caps coupled to at least one of said first and second ends of each of said plurality of panels with each of said plurality of caps having a head disposed over said at least one of said first and second ends of a respective one of said plurality of panels and each of said plurality of caps having first and second stems each extending from said head with said first stem disposed within said first mounting channel and said second stem disposed within said second mounting channel to mount said cap to said at least one of said first and second ends of said respective one of said plurality of panels.

15. The building assembly as set forth in claim 1 wherein each of said plurality of walls includes a base panel defining a longitudinal axis and having first and second ends, opposing top and bottom surfaces, and an upper notch formed through said top surface spaced inwardly along said longitudinal axis from each of said first and second ends.

16. The building assembly as set forth in claim 15 wherein said plurality of walls includes a front wall, a rear wall opposite said front wall, a first side wall, and a second side wall opposite said first side wall, and said base panel of said front wall and said rear wall having a first panel width and said base panel of said first and second side walls having a second panel width twice the first panel width.

17. The building assembly as set forth in claim 1 wherein said first panel is one of a plurality of first panels each having said first and second ends, said second panel is one of a plurality of second panels each having said first and second ends with said interlocking joint being further defined as a plurality of first interlocking joints each formed between one of said plurality of first panels about said first end of said first panel and one of said plurality of second panels about said second end of said second panel to interconnect said plurality of first panels and said plurality of second panels to partially form adjacent walls of said plurality of walls of said building assembly.

18. The building assembly as set forth in claim 17 wherein said adjacent walls are further defined as front and first side walls, said plurality of panels further includes a third panel and said lower notch of said third panel mates with said upper notch of said second panel to form a second interlocking joint between said second and third panels, and wherein said third panel is one of a plurality of third panels each having said first and second ends and said second interlocking joint being further defined as a plurality of second interlocking joints each formed between one of said plurality of second panels about said first end of said second panel and one of said plurality of third panels about said second end of said third panel to interconnect said plurality of second panels and said plurality of third panels to partially form a rear wall adjacent said first side wall of said plurality of walls of said building assembly.

19. The building assembly as set forth in claim 18 wherein said plurality of panels further includes a fourth panel and said lower notch of said third panel mates with said upper notch of said fourth panel to form a third interlocking joint between said third and fourth panels, and wherein said fourth panel is one of a plurality of fourth panels each having said first and second ends and said third interlocking joint being further defined as a plurality of third interlocking joints each formed between one of said plurality of third panels about said first end of said third panel and one of said plurality of fourth panels about said second end of said fourth panel to interconnect said plurality of third panels and said plurality of fourth panels to partially form a second side wall adjacent said rear wall of said plurality of walls of said building assembly.

20. The building assembly as set forth in claim 19 wherein said upper notch of said fourth panel mates with said lower notch of said first panel to form a fourth interlocking joint between said first and fourth panels, and wherein said fourth interlocking joint is further defined as a plurality of fourth interlocking joints each formed between one of said plurality of fourth panels about said first end of said fourth panel and one of said plurality of first panels about said second end of said first panel to interconnect said plurality of fourth panels and said plurality of first panels.

21. The building assembly as set forth in claim 17 wherein said plurality of panels of each of said adjacent walls has a first section of panels and a second section of panels spaced from said first section of panels, each panel of said first section of panels has said first end, a first segment end opposite said first end, said upper notch formed through said top surface, and said opposing lower notch formed through said bottom surface with said upper and lower notches spaced inwardly along said longitudinal axis from said first end, and each panel of said second section of panels has said second end, a second segment end opposite said second end, said upper notch formed through said top surface, and said opposing lower notch formed through said bottom surface with said upper and lower notches spaced inwardly along said longitudinal axis from said second end, and further comprising a panel frame disposed between said first and second sections of panels with said panel frame connected to said first segment end of each of said first section of panels and connected to said second segment end of each of said second section of panels to interconnect said first and second sections of panels of said first side wall.

22. The building assembly as set forth in claim 21 wherein said panel frame has first and second frame segments each defining a slot, and said panel frame further has a tab extending from one of said first and second frame segments and coupled to another one of said first and second frame segments to interconnect said first and second frame segments and form said panel frame of said first side wall.

23. The building assembly as set forth in claim 21 wherein said panel frame has an upper side, a lower side opposite said upper side, a first side, and a second side opposite said first side with said upper side, lower side, first side, and second side interconnected to define an opening for providing access to an inside of said building assembly.

24. The building assembly as set forth in claim 1 wherein said post has first and second post segments and said post further having a tab extending from one of said first and second post segments and coupled to another one of said first and second post segments to interconnect said first and second post segments and form said post at said corner of said exterior of said building assembly.

25. The building assembly as set forth in claim 1 wherein said first panel is one of a plurality of first panels and said second panel is one of a plurality of second panels and said plurality of walls includes:

a front wall formed from said plurality of first panels and a front window frame supported by said plurality of first panels with said front window frame having first and second side segments and a front window bracket extending from at least one of said first and second side segments with said front window bracket having upper and lower surfaces and a slot defined through said lower surface;

a first side wall adjacent said front wall and formed from said plurality of second panels and a side window frame supported by said plurality of second panels with said side window frame having first and second side segments and a side window bracket extending from at least one of said first and second side segments with said side window bracket having upper and lower surfaces and a slot defined through said upper surface, wherein said slot of said front window bracket mates with said slot of said side window bracket to interconnect said front and side window frames to partially interconnect said front and side walls.

26. The building assembly as set forth in claim 25, wherein said post extends adjacent to said front and first side walls with said post having first and second post sides with said front window bracket adjacent said first post side and said side window bracket adjacent said second post side, and wherein said building assembly further comprises:

a plurality of fasteners with one of said fasteners securing said front window bracket to said first post side and another one of said fasteners securing said side window bracket to said second post side.

27. The building assembly as set forth in claim 25, wherein said post is adjacent to said front and first side walls with said post having a shelf separating said front and side window frames from said plurality of panels.

28. The building assembly as set forth in claim 1 wherein said plurality of walls includes a front wall and said plurality of panels forming said front wall has a first section of panels and a second section of panels spaced from said first section of panels, with each panel of said first section of panels having a first end and a first segment end opposite said first end and each panel of said second section of panels having a second end and a second segment end opposite said second end, and further comprising:

a door frame disposed between said first and second sections of panels with said door frame having an upper side, a lower side, a first side, and a second side with each of said upper, lower, first, and second sides defining a channel, with said first segment end of each panel of said first section of panels received within said channel of said first side of said door frame and secured to said first side of said door frame and said second segment end of each panel of said second section of panels received within said channel of said second side of said door frame and secured to said second side of said door frame; and a front window frame having top and bottom segments with said bottom segment of said window frame coupled to said upper side of said door frame such that said door frame partially supports said front window frame.

29. The building assembly as set forth in claim 1 wherein said roof includes a plurality of interconnected roof beams coupled to said plurality of panels of each of said plurality of walls, and said roof further including at least one roof board secured to said plurality of interconnected roof beams.

30. The building assembly as set forth in claim 29 wherein said at least one roof board is further defined as a plurality of front roof boards and a plurality of rear roof boards adjacent said plurality of front roof boards, with each one of said plurality of front roof boards having front and back sides and a flange extending from said back side and overlapping a respective one of said plurality of rear roof boards to form a first seal between said plurality of front roof boards and said plurality of rear roof boards.

31. The building assembly as set forth in claim 30 wherein said plurality of front roof boards has a plurality of interconnected sheets of material including a top sheet, a bottom sheet, and at least one middle sheet, and each one of said plurality of rear roof boards has front and back sides and at least one flange extending from said front side of said rear roof board with said at least one middle sheet of said plurality of front roof boards overlapping said flange of said rear roof board to form a second seal between said plurality of front roof boards and said plurality of rear roof boards.

32. The building assembly as set forth in claim 1 wherein said floor frame comprises a plurality of floor panels with one of said plurality of floor panels mating with an adjacent one of said plurality of floor panels to interconnect said plurality of floor panels and form said floor frame, and wherein said plurality of floor panels includes a front floor panel, a rear floor panel spaced from said front floor panel, a first side floor panel extending between said front and rear floor panels, and a second side floor panel extending between said front and rear floor panels and spaced from said first side floor panel.

33. The building assembly as set forth in claim 32 wherein each of said plurality of floor panels has first and second floor panel segments each defining a slot, and one of said first and second floor panel segments having a tab disposed within said slot of the other one of said first and second floor panel segments to interconnect said first and second floor panel segments to form said floor panel.

34. The building assembly as set forth in claim 32 wherein said floor frame further has a first floor joist extending between said first and second side floor panels, a plurality of second floor joists extending between said front floor panel and said first floor joist, and another plurality of second floor joists extending between said first floor joist and said rear floor panel.

35. The building assembly as set forth in claim 34 wherein each of said plurality of floor panels has a ledge and further comprising at least one floor board supported by said first floor joist, said plurality of second floor joists, and said ledges to form a floor of said building assembly.

36. The building assembly as set forth in claim 1 further comprising a door coupled to said at least one of said plurality of walls and movable between an open position in which said door is spaced from said opening and a closed position in which said door covers said opening.

37. A method of manufacturing a building assembly comprising the steps of:

forming a floor;

forming a roof spaced from the floor;

forming a plurality of walls extending between the floor and the roof with each of the plurality of walls including a plurality of panels with each panel defining a longitudinal axis and each panel having first and second ends, opposing inner and outer sides, opposing top and bottom surfaces, an upper notch formed through the top surface and an opposing lower notch formed through the bottom surface with each of the upper and lower notches spaced inwardly along the longitudinal axis from at least one of the first and second ends, a first mounting channel formed in the inner side extending along the longitudinal axis, and a second mounting channel formed in the outer side extending along the longitudinal axis, with the plurality of panels including first and second panels;

mating the lower notch of the first panel with the upper notch of the second panel to form an interlocking joint between the first and second panels thereby interconnecting the first and second panels and forming adjacent interconnected walls of the plurality of walls, wherein the first and second ends of the first and second panels extend outwardly from said interlocking joint, and wherein said interconnected plurality of walls defines an interior and an exterior of the building assembly with at least one of the plurality of walls defining an opening;

coupling a post between the floor frame and the roof with the post having a slot and with the first and second ends of the first and second panels received within the slot; and coupling a door to at least one of the plurality of walls such that the door is movable between an open position in which the door is spaced from the opening and a closed position in which the door covers the opening.

38. The method as set forth in claim 37 wherein the top surface of each of the plurality of panels defines a tongue extending outwardly in a direction transverse to the longitudinal axis and the bottom surface of each of the plurality of panels defines a groove extending inwardly in a direction transverse to the longitudinal axis and further comprising the step of mating the tongue of one of the plurality of panels with the groove of an adjacent one of the plurality of panels to form one of the plurality of walls.

39. The method as set forth in claim 37 wherein the first panel is one of a plurality of first panels each having first and second ends and the second panel is one of a plurality of second panels each having first and second ends and the mating step includes mating the lower notch of each of the plurality of first panels about the first end of the first panel with the upper notch of each of the plurality of second panels about the second end of the second panel to form a plurality of first interlocking joints between the plurality of first panels and the plurality of second panels thereby interconnecting the plurality of first panels and the plurality of second panels and partially forming adjacent front and side walls of the plurality of walls.

40. The method as set forth in claim 39 wherein the plurality of panels further includes a plurality of third panels each having first and second ends and further comprising the step of mating the lower notch of each of the plurality of third panels about the second end of the third panel with the upper notch of each of the plurality of second panels about the first end of the second panel thereby interconnecting the plurality of second panels and the plurality of third panels and partially forming a rear wall adjacent the first side wall of the building assembly.

41. The method as set forth in claim 40 wherein the plurality of panels further includes a plurality of fourth panels each having first and second ends and further comprising the step of mating the lower notch of each of the plurality of third panels about the first end of the third panel with the upper notch of each of the plurality of fourth panels about the second end of the fourth panel thereby interconnecting the plurality of third panels and the plurality of fourth panels and partially forming a second side wall adjacent the rear wall of the building assembly.

42. The method as set forth in claim 41 further comprising the step of mating the upper notch of the each of the plurality of fourth panels about the first end of the fourth panel with the lower notch of each of the plurality of first panels about the second end of the first panel to form a plurality of fourth interlocking joints between the plurality of first panels and the plurality of fourth panels thereby interconnecting the plurality of first panels and the plurality of fourth panels.

43. The method as set forth in claim 37 wherein the step of forming the floor includes the steps of:

providing a plurality of floor panels each having first and second ends with the plurality of floor panels including a front floor panel, a rear floor panel, and first and second side floor panels;

mating the first end of one of the plurality of floor panels with the second end of an adjacent one of the plurality of floor panels to interconnect the plurality of floor panels;

attaching at least one joist to said plurality of floor panels to interconnect said plurality of floor panels and said at least one joist to form a floor frame; and attaching a plurality of interconnected floor boards to the floor frame.

44. The method as set forth in claim 43 wherein the plurality of walls includes a front wall, a rear wall spaced from the front wall, a first side wall extending between the front and rear walls, and a second side wall spaced from the first side wall and extending between the front and rear walls and the step of forming the plurality of walls includes:

providing front and rear base panels each defining a longitudinal axis and having first and second ends, opposing top and bottom surfaces, an upper notch formed through the top surface spaced inwardly along the longitudinal axis from each of the first and second ends, and a first panel width;

attaching the front and rear base panels to the front and rear floor panels of the frame;

providing first and second side base panels each defining a longitudinal axis and having first and second ends, opposing top and bottom surfaces, an upper notch formed through the top surface spaced inwardly along the longitudinal axis from each of the first and second ends, a lower notch formed through the bottom surface spaced inwardly along the longitudinal axis from each of the first and second ends, and a second panel width twice the first panel width of the front and rear base panels; and attaching the first and second side base panels to the first and second side floor panels of the frame.

45. The method as set forth in claim 44 wherein the first panel is one of a plurality of first panels, the second panel is one of a plurality of second panels, and the plurality of panels further includes a plurality of third panels and a plurality of fourth panels and further comprising the steps of:

attaching the plurality of first panels to the front base panel to form a front wall of the plurality of walls;

attaching the plurality of second panels to the first side base panel to form a first side wall of the plurality of walls;

attaching the plurality of third panels to the rear base panel to form a rear wall of the plurality of walls; and attaching the plurality of fourth panels to the second side base panel to form a second side wall of the plurality of walls.

46. A building assembly comprising:

a floor frame;

a roof spaced from said floor frame;

a plurality of walls extending between said floor frame and said roof and interconnected to define an interior and an exterior of said building assembly with at least one of said plurality of walls defining an opening and each of said plurality of walls including a plurality of panels with each panel defining a longitudinal axis and each panel having:

first and second ends;

opposing top and bottom surfaces; and an upper notch formed through said top surface and an opposing lower notch formed through said bottom surface with each of said upper and lower notches spaced inwardly along said longitudinal axis from at least one of said first and second ends, wherein said plurality of panels includes first and second panels and said lower notch of said first panel mates with said upper notch of said second panel to form an interlocking joint between said first and second panels to interconnect said first and second panels and form adjacent interconnected walls of said plurality of walls of said building assembly, wherein each panel of said plurality of panels further has opposing inner and outer sides and a mounting channel formed in at least one of said inner and outer sides extending along said longitudinal axis for removably securing an accessory to at least one of said interior and said exterior of said building assembly, wherein said mounting channel is further defined as a first mounting channel formed in said inner side extending along said longitudinal axis for removably securing said accessory to said interior of said building assembly and each panel further has a second mounting channel formed in said outer side extending along said longitudinal axis for removably securing another accessory to said exterior of said building assembly, and a plurality of caps coupled to at least one of said first and second ends of each of said plurality of panels with each of said plurality of caps having a head disposed over said at least one of said first and second ends of a respective one of said plurality of panels and each of said plurality of caps having first and second stems each extending from said head with said first stem disposed within said first mounting channel and said second stem disposed within said second mounting channel to mount said cap to said at least one of said first and second ends of said respective one of said plurality of panels.

47. A building assembly comprising:

a floor frame;

a roof spaced from said floor frame; and a plurality of walls extending between said floor frame and said roof and interconnected to define an interior and an exterior of said building assembly with at least one of said plurality of walls defining an opening and each of said plurality of walls including a plurality of panels with each panel defining a longitudinal axis and each panel having:

first and second ends;

opposing top and bottom surfaces; and an upper notch formed through said top surface and an opposing lower notch formed through said bottom surface with each of said upper and lower notches spaced inwardly along said longitudinal axis from at least one of said first and second ends, wherein said plurality of panels includes first and second panels and said lower notch of said first panel mates with said upper notch of said second panel to form an interlocking joint between said first and second panels to interconnect said first and second panels and form adjacent interconnected walls of said plurality of walls of said building assembly, wherein said first panel is one of a plurality of first panels and said second panel is one of a plurality of second panels and said plurality of walls includes:

a front wall formed from said plurality of first panels and a front window frame supported by said plurality of first panels with said front window frame having first and second side segments and a front window bracket extending from at least one of said first and second side segments with said front window bracket having upper and lower surfaces and a slot defined through said lower surface;

a first side wall adjacent said front wall and formed from said plurality of second panels and a side window frame supported by said plurality of second panels with said side window frame having first and second side segments and a side window bracket extending from at least one of said first and second side segments with said side window bracket having upper and lower surfaces and a slot defined through said upper surface, wherein said slot of said front window bracket mates with said slot of said side window bracket to interconnect said front and side window frames to partially interconnect said front and side walls.

48. The building assembly as set forth in claim 47, wherein said building assembly further comprises:

a post extending between said floor frame and said roof and adjacent said front and first side walls with said post having first and second post sides with said front window bracket adjacent said first post side and said side window bracket adjacent said second post side; and a plurality of fasteners with one of said fasteners securing said front window bracket to said first post side and another one of said fasteners securing said side window bracket to said second post side.

49. The building assembly as set forth in claim 47, further comprising a post extending between said floor frame and said roof adjacent to said front and first side walls with said post having a shelf separating said front and side window frames from said plurality of panels.

* * * * *